US008499727B1

(12) United States Patent
Pett, Jr.

(10) Patent No.: US 8,499,727 B1
(45) Date of Patent: Aug. 6, 2013

(54) PARALLEL CYCLE INTERNAL COMBUSTION ENGINE

(76) Inventor: Stuart B. Pett, Jr., Albuquerque, NM (US)

( * ) Notice: Subject to any disclaimer, the term of this patent is extended or adjusted under 35 U.S.C. 154(b) by 1178 days.

(21) Appl. No.: 12/156,831

(22) Filed: Jun. 5, 2008

(51) Int. Cl.
*F02B 75/18* (2006.01)

(52) U.S. Cl.
USPC ..... 123/53.6; 123/70 R; 123/190.1; 123/52.1; 123/53.5

(58) Field of Classification Search
USPC ..... 123/53.5, 53.6, 55.2, 55.6, 55.7, 123/190.1, 190.4, 190.5, 190.8, 190.14, 190.15, 123/25 R, 25 A, 197.1, 70 R
See application file for complete search history.

(56) References Cited

U.S. PATENT DOCUMENTS

| | | | | |
|---|---|---|---|---|
| 1,320,954 | A | 11/1919 | Woodford | |
| 1,411,384 | A | 4/1922 | Schaffer | |
| 1,702,816 | A | 2/1929 | Danford | |
| 1,740,758 | A | 12/1929 | White | |
| 2,183,024 | A | 12/1939 | Large | |
| 3,547,094 | A | 12/1970 | Yasuda | |
| 3,687,117 | A * | 8/1972 | Panariti | 123/43 A |
| 3,808,818 | A * | 5/1974 | Cataldo | 60/620 |
| 3,880,126 | A | 4/1975 | Thurston et al. | |
| 3,886,805 | A * | 6/1975 | Koderman | 74/52 |
| 3,948,227 | A | 4/1976 | Guenther | |
| 4,026,252 | A * | 5/1977 | Wrin | 123/54.2 |
| 4,261,303 | A * | 4/1981 | Ramsey | 123/50 R |
| 4,392,460 | A | 7/1983 | Williams | |
| 4,418,658 | A * | 12/1983 | DiRoss | 123/80 D |
| 4,485,768 | A | 12/1984 | Heniges | |
| 4,506,636 | A | 3/1985 | Negre et al. | |
| 4,546,743 | A | 10/1985 | Eickmann | |
| 4,556,023 | A | 12/1985 | Giocastro et al. | |
| 4,566,411 | A | 1/1986 | Summerlin | |
| 4,572,116 | A | 2/1986 | Hedelin | |
| 4,715,326 | A | 12/1987 | Thring | |
| 4,739,737 | A | 4/1988 | Kruger | |
| 4,741,296 | A | 5/1988 | Jackson | |
| 4,898,042 | A * | 2/1990 | Parsons | 74/68 |
| 4,970,995 | A | 11/1990 | Parsons | |
| 5,067,456 | A | 11/1991 | Beachley et al. | |
| 5,072,589 | A | 12/1991 | Schmitz | |
| 5,158,046 | A | 10/1992 | Rucker | |
| 5,309,876 | A | 5/1994 | Schiattino | |
| 5,311,739 | A | 5/1994 | Clark | |
| 5,325,824 | A | 7/1994 | Wishart | |
| 5,410,996 | A | 5/1995 | Baird | |
| 5,474,036 | A | 12/1995 | Hansen et al. | |
| 5,546,897 | A | 8/1996 | Brackett | |

(Continued)

*Primary Examiner* — Noah Kamen
*Assistant Examiner* — Grant Moubry
(74) *Attorney, Agent, or Firm* — Rod D. Baker

(57) ABSTRACT

The disclosed invention includes a heat engine where combustion, expansion, and compression are independent, continuous, parallel cycles. Compression and expansion ratios are continuously controllable variables. The disclosed engine includes a crankcase situated between two axially-aligned, opposed cylinder blocks. Each opposed cylinder block contains four zero-clearance cylinders. An oscillating piston head separates each cylinder into external expansion and internal compression chambers. A single connecting rod rigidly connects the piston heads of opposed cylinder pairs, and articulates with a central, linear-throw, planetary crank mechanism. A single, rotary disk valve mates with each external expander face of the paired, opposed cylinder blocks and regulate all expansion and exhaust functions. Controllable intake and outlet valves, integrated within each internal compressor face of the paired, opposed cylinder blocks and regulates intake, compression, and regenerative engine braking functions. A separate combustion chamber with heat regeneration capabilities and at least one compressed-air storage reservoir are included.

25 Claims, 65 Drawing Sheets

(56) References Cited

U.S. PATENT DOCUMENTS

| | | | | |
|---|---|---|---|---|
| 5,558,049 | A * | 9/1996 | Dubose | 123/80 D |
| 5,560,327 | A * | 10/1996 | Brackett | 123/55.7 |
| 5,579,730 | A | 12/1996 | Trotter | |
| 5,579,734 | A | 12/1996 | Muth | |
| 5,711,265 | A | 1/1998 | Duve | |
| 5,727,513 | A * | 3/1998 | Fischer | 123/197.4 |
| 5,857,436 | A | 1/1999 | Chen | |
| 5,964,087 | A | 10/1999 | Tort-Oropeza | |
| 6,006,619 | A | 12/1999 | Gindentuller et al. | |
| 6,024,067 | A * | 2/2000 | Takachi et al. | 123/197.1 |
| 6,098,477 | A * | 8/2000 | Takachi et al. | 74/52 |
| 6,209,495 | B1 * | 4/2001 | Warren | 123/55.2 |
| 6,289,666 | B1 | 9/2001 | Ginter | |
| 6,568,186 | B2 | 5/2003 | Zaleski | |
| 6,672,263 | B2 * | 1/2004 | Vallejos | 123/43 A |
| 6,886,326 | B2 | 5/2005 | Holtzapple et al. | |
| 7,121,236 | B2 | 10/2006 | Scuderi et al. | |
| 7,140,182 | B2 | 11/2006 | Warren | |
| 7,185,557 | B2 | 3/2007 | Venettozzi | |
| 7,263,966 | B1 * | 9/2007 | Robison | 123/197.1 |
| 7,370,630 | B2 * | 5/2008 | Turner et al. | 123/299 |
| 7,418,929 | B2 * | 9/2008 | Zajac | 123/70 R |
| 7,455,038 | B2 * | 11/2008 | Sic et al. | 123/55.5 |
| 7,469,664 | B2 * | 12/2008 | Hofbauer et al. | 123/54.1 |
| 7,481,189 | B2 * | 1/2009 | Zajac | 123/70 R |
| 7,481,195 | B2 * | 1/2009 | Nelson | 123/193.5 |
| 7,552,703 | B2 * | 6/2009 | Zajac | 123/70 R |
| 7,634,988 | B1 * | 12/2009 | Salminen | 123/663 |
| 7,739,998 | B2 * | 6/2010 | Dougherty | 123/197.4 |
| 7,942,116 | B2 * | 5/2011 | Major | 123/62 |
| 2004/0083729 | A1 * | 5/2004 | Teacherson | 60/517 |

* cited by examiner $P_5 > P_2 = P_1$

PARALLEL CYCLE INTERNAL COMBUSTION ENGINE

BACKGROUND

1. Technical Field

The apparatus and methods disclosed, illustrated, and claimed in this document pertain generally to internal combustion engines. More particularly, the new and useful parallel cycle internal combustion engine pertains to an engine having two opposed cylinder blocks each containing four dual-chambered cylinders arranged in two-by-two cloverleaf fashion. The four dual-chambered cylinders employ four working members, including (i) double-headed and double-sided pistons in (ii) dual-chambered cylinders. The double-headed and double-sided pistons in dual-chambered cylinders cooperate with (a) a unique linear throw crank mechanism, (b) a multipurpose and multifunctional rotatable disk valve, (c) an integrated internal compressor, and (d) a multi-fuel combustion subsystem that, in combination, provide an engine capable of delivering fuel efficient, nontoxic, nonpolluting, inexpensive, safe vehicular travel without sacrificing power, environmental concerns, or load capacities. While the parallel cycle internal combustion engine can be manufactured in a wide range of sizes, a dynamic operating range is achievable with a smaller, lighter engine than has been customary.

2. Technical Background

Environmental pollution, global warming, and an almost exclusive reliance on petroleum to fuel commerce and vehicles conspire to jeopardize the stability of many nations. The need for significant energy alternatives is axiomatic. Equally evident is the need for dramatic improvement in efficient utilization of existing resources as the cost of petroleum continues to escalate. The apparatus described, illustrated, and claimed in this document is responsive to overcoming many direct and indirect problems presented by those challenges.

Conventional four-stroke engines function by implementing a series of discrete, discontinuous, rigidly linked, thermodynamic events. Conventional engines sequentially perform the well-known thermodynamic events of compression, combustion and power. Each event is conducted in a common location. In contrast, the parallel cycle internal combustion engine disclosed hereby performs the thermodynamic processes continuously in distinct, separate locations. Thus, for example, while conventional engines cannot capture, store or use surplus energy generated during operation of an engine, the apparatus of this document does.

In general, a conventional four-stroke engine alternates between functioning substantially as an air compressor and a heat-enhanced compressed air motor. Each phase of the four-stroke cycle must be completed within a defined time interval that is completely predicated on engine speed. Each cycle is also interdependent, meaning that each event results from a predecessor event. For example, power is generated only if a preceding compression created a charge necessary for combustion; compression results only if sufficient power is generated by a previous expansion. Individual thermodynamic events also are subject to synergistic restrictions. Ultimate capabilities of most engines are limited by a specific compression ratio defined during engine design by the bore and stroke.

The conventional four-stroke thermodynamic process results in several limitations. As indicated, all thermodynamic events must occur within a common space location. Excess energy, in the form of heat and pressure, produced during operation of an engine must be eliminated from a cylinder before the next intake stroke begins, and is unavailable for direct regenerative processes. Conventional engines also require a minimum idling RPM ("revolutions per minute") and an auxiliary energy storage mechanism, like a flywheel, to continue a cycle when there is no power stroke.

Conventional engine designs are approaching the limit of their capabilities. Recent innovations involve hybrid concepts that are not specifically improvements of the engine per se. Hybrid concepts address some limitations of conventional four-stroke engines; regenerative braking appears to be the major advantage of the so-called "hybrids." Reversing an electric motor allows a generator, when loaded, to decelerate a vehicle. Regrettably, however, a hybrid vehicle also requires addition of a separate energy system to achieve regenerative braking, not required by the parallel cycle internal combustion engine.

Environmental and efficiency concerns have stimulated decades of incremental engine refinements. Yet current engine design and manufacture remain based on principles identified more than a century ago. Innovative alternatives in structure and function have failed to demonstrate compelling advantages; none has displaced traditional Otto and Diesel cycle engines except in certain specific domains, such as turbine jet engines. Although alternatives, such as the hydrogen fuel cell, are widely investigated as eventual solutions, the weight of electric motor/fuel cell devices remains problematic. Until fuel cell applications develop a power density sufficient to fly a helicopter, for example, the need for internal combustion engines will persist.

However, environmental deterioration and depletion of oil reserves ultimately will limit use of internal combustion engines. The only question is whether viable alternatives can be deployed before social, environmental, and/or economic problems preclude an orderly transition. A new engine design that offers enhanced performance, with both reduced emissions and fuel consumption, would be a highly desirable component of such an orderly transition.

The presently disclosed parallel cycle internal combustion engine promises significant improvements in overall efficiency, enhanced dynamic performance, and decreased environmental emissions. The engine is scalable, versatile, and easily integrates with existing structural components. Some advantages of the apparatus disclosed, illustrated and claimed in this document are the result of innovation in three areas, (i) thermodynamic concepts, (ii) mechanical and operational processes, and (iii) engine and vehicle design.

The thermodynamic concepts implemented in the parallel cycle internal combustion engine represent a fundamental departure from conventional two- and four-stroke cycles. A variety of distinctive mechanical and operational processes are disclosed that amplify advantages inherent in the proposed thermodynamic concepts. A compact and dynamic engine design emerges from a unique association of these thermodynamic, mechanical, and operational innovations. The resulting engine provides opportunities for a paradigm shift in vehicular design with important environmental and economic advantages.

An understanding of the concepts associated with conventional engine design will enable an appreciation of the parallel cycle internal combustion engine. Distinguishing patents issued in connection with conventional engine design also will contribute to an appreciation of the apparatus disclosed, illustrated, and claimed in this document.

The defining distinction between parallel cycle engines earlier disclosed, also known as Brayton or split-cycle engines, and conventional four-stroke engines, also known as Otto and Diesel engines, is the physical rather than temporal separation of compression and expansion functions. Separation of compression and expansion functions was disclosed more than a century ago in, for example, U.S. Pat. No. 125,166 to Brayton in 1872. In Otto and Diesel cycle engines, a single working chamber alternately performs compression and expansion processes in series. In Brayton cycle engines, different working chambers simultaneously perform compression and expansion functions in parallel. Although a number of potential advantages are associated with the Brayton cycle concept, the need for separate compression chambers, in part, has inhibited development of a successful Brayton cycle engine.

Parallel cycle engines also are distinct from common two-stroke engines such as the Clerk et al. design disclosed in U.S. Pat. No. 230,470 in 1880, and British Patent No. 4,050 to Robson, also issued in 1880. Although single cylinder two-stroke engines can be manufactured that are capable of continuously performing compression and expansion functions in substantially parallel fashion, the thermodynamic components are neither distinct nor complete processes. The requisite scavenging of two-stroke engines is associated with unwelcome mixing, inefficiency, and waste. Accordingly, despite the compact, powerful characteristics of two-stroke engines, they are significantly less efficient, and produce excessive environmental emissions.

Therefore, an engine in which a single working chamber simultaneously performs distinct compression and expansion functions in parallel would be advantageous.

Previous patents, for example U.S. Pat. No. 1,320,954 to Woodford and U.S. Pat. No. 1,411,384 to Shaeffer, have taught the theoretical advantages of separation of compression (intake) and expansion (exhaust) processes. However, although Brayton cycle concepts are successfully applied in conventional turbine engines, a successful reciprocating piston embodiment has not displaced the familiar Otto and Diesel engines.

Environmental and economic concerns related to petroleum once again suggest exploration of the advantages inherent in a split-cycle engine as disclosed in this document. Advantages include increased efficiency through variable compression and expansion ratios; heat regeneration; complete combustion of an array of different fuels; simplified, compact design; and options for regenerative braking. New and novel features, and new and novel combinations and improvements of existing characteristics of split-cycle engines, may be exploited to achieve those benefits, including separate combustion chambers, compressed air accumulators, rectilinear connecting rod motion, double-headed double-sided working member pistons, motive fluid conditioning, rotating disk valves, and structurally integrated but functionally independent compressors.

Significant differences appear in earlier patents regarding the structure and co-operation of structural components to achieve the foregoing goals. Accordingly, references that might be cited as prior art fail to disclose a device that, either alone or in combination, includes the structure, method, and cooperation of the structural components disclosed, claimed, and illustrated in this document.

As acknowledged by those skilled in the art, a significant feature of parallel cycle engines is separation of compression and expansion chambers. Two fundamental characteristics distinguish the capabilities of previously disclosed parallel cycle engine: (1) what happens to the compressed air as it travels between compression and expansion chambers; and (2) the nature of the driving forces between the compression and expansion chambers.

Thus, the compressed air may pass directly from a compressor to an expansion chamber as shown in U.S. Pat. No. 1,320,954 to Woodford; U.S. Pat. No. 1,411,384 to Shaeffer; U.S. Pat. No. 3,880,126 Thurston; U.S. Pat. No. 4,566,411 Summerlin; U.S. Pat. No. 4,715,326 to Thring; U.S. Pat. No. 4,741,296 Jackson; U.S. Pat. No. 5,072,589 Schmitz; U.S. Pat. No. 5,325,824 Wishart; U.S. Pat. No. 5,857,436 to Chen; U.S. Pat. No. 5,964,087 to Tort-Oropeza; and U.S. Pat. No. 7,121,236 to Scuderi.

However, passage of compressed air directly from the compressor to an expander prevents storage of energy as compressed air. Direct passage also limits useful modification and conditioning of the compressed air.

Those of skill in the art will recognize that a significant feature of the parallel cycle engine disclosed herein is the capability to store additional energy as compressed air. Additional compressed air may be acquired from a number of sources, such as regenerative braking, which converts vehicular kinetic energy into potential energy of compressed air using an engine's compressor function. Additional energy may also come from an external source such as wind. These advantageous features require at least the capability of retaining an excess supply of compressed air. References that describe compressed air storage as part of a split-cycle engine include U.S. Pat. No. 4,215,659 to Lowther; U.S. Pat. No. 4,300,486 to Lowther; U.S. Pat. No. 4,333,424 to McFee; U.S. Pat. No. 4,418,657 to Wishart; U.S. Pat. No. 4,696,158 to DeFrancisco; U.S. Pat. No. 5,311,739 to Clark; U.S. Pat. No. 6,568,168 to Zaleski; U.S. Pat. No. 6,886,326 to Holtzapple; and U.S. Pat. No. 7,140,182 to Warren.

Separation, in space and time, of compression and expansion events allows modification and conditioning of compressed air. Adiabatic compression, i.e., compression without gain or loss of heat, is associated with higher temperatures and pressures than isothermal processes with the same compression ratio. In attempts to decrease both temperature and pressure, while increasing the mass of oxygen within a given volume, some references appear to suggest decreasing compressed air temperature by removing heat. Previous attempts are seen in, for example, U.S. Pat. No. 4,215,659 to Lowther; U.S. Pat. No. 4,333,424 to McFee; U.S. Pat. No. 5,072,589 to Schmitz; U.S. Pat. No. 5,857,436 to Chen; U.S. Pat. No. 5,964,087 to Tort-Oropeza; U.S. Pat. No. 7,140,182 to Warren; and U.S. Pat. No. 5,311,739 to Clark.

Relocation or removal of the combustion process from an expansion cylinder offers numerous advantages. Power output is then a function of the rate at which compressed air may be supplied to the combustion chamber, not the mass of oxygen available at the end of the compression stroke. A separate combustion chamber also reduces constraints on fuel characteristics by allowing extended time for fuel combustion, such as continuous combustion, rather than the brief time allowed during conventional Otto and Diesel cycles. Continuous combustion also enhances the possibility of a complete burn of fuel with sufficient oxygen to minimize particulate and carbon monoxide emissions. In addition, a separate combustion chamber provides the freedom to arbitrarily adjust air/fuel mixtures. Although a separate combustion chamber may be constructed of heat-resistant materials, such as ceramics, the same materials have been difficult to incorporate into conventional Otto and Diesel engines. References that may address such features include U.S. Pat. No. 3,880,126 to Thurston; U.S. Pat. No. 4,696,158 to DeFrancisco; U.S. Pat. No. 4,864,814 to Albert; U.S. Pat. No. 5,311,739 to Clark; U.S. Pat. No. 5,964,087 Tort-Oropeza; and U.S. Pat. No. 6,886,326 to Holtzapple.

Continuous combustion also offers an opportunity to modify, enhance or condition the motive fluid in a split-cycle application, but this has proven difficult when combustion is limited to the brief time limits inherent in the design of conventional Otto and Diesel cycles.

As taught in this document, motive fluid temperature can be reduced by utilizing a portion of its internal energy to provide the water's latent heat of vaporization.

In one aspect of the parallel cycle internal combustion engine disclosed and claimed in this document, water injection is used and applied. Unlike temperature reduction with heat rejection through an intercooler, water injection lowers the temperature through a heat regeneration process that produces additional active motive fluid molecules in the form of steam. Reduction of temperature also reduces noxious emissions. Certain substances may be added to water to enhance performance and reduce the freezing point of the water, eliminating the need for additional antifreeze. Alcohol, for example, would enhance the fuel and hydrogen peroxide would enhance the oxygen. Some references, such as U.S. Pat. No. 4,731,990 to Munk; U.S. Pat. No. 5,718,194; U.S. Pat. No. 6,289,666 to Ginter; and U.S. Pat. No. 6,886,326 to Holtzapple, also appear to consider theoretical advantages for water injection.

Earlier references also generally appear to utilize conventional poppet valves in parallel cycle engines. In the disclosed engine, the motive fluid that enters an expander has the same chemical composition as the expanded fluid that exits the expander. This presents important opportunities for simplification of valve functions. A person skilled in the art will appreciate that rotary valves may have several advantages over conventional poppet valves. The advantages include volumetric efficiencies, elimination of reciprocating motion, and decreased mechanical and functional complexity. Rotating valves are discussed in U.S. Pat. No. 1,329,954 to Woodford and U.S. Pat. No. 1,411,384 to Schaffer.

Significant innovation in rotary valves has been disclosed in functions that specifically pertain to engines operating under conventional four-stroke Otto and Diesel cycles. These relate to capabilities that are not relevant to parallel cycle devices and include integration of ignition mechanisms, compression and combustion chambers and cooling systems in valves with fixed apertures that serve single cylinders. Innovation in multi-cylinder valves with variable apertures would be more pertinent to parallel cycle, Brayton engines. Thus, U.S. Pat. No. 5,474,036 to Hansen appears to suggest a variable-aperture damper mechanism for the intake port of an asymmetric, compound, dual-function, single-cylinder Otto-cycle engine; U.S. Pat. Nos. 4,392,460 to Williams and 5,579,734 to Muth appear to disclose asymmetric, compound, fixed-aperture, dual-function, four-cylinder (cloverleaf) valves for Otto-cycle engines.

Accordingly, the variable-aperture, symmetric, dual-function, multi-cylinder valve for a parallel cycle engine as disclosed and claimed in this document would be advantageous. The rotary disk valve disclosed in this application includes a variable-aperture, symmetric, dual-function valve that serves four parallel expansion cylinders disposed in a two-by-two cloverleaf arrangement.

As a person skilled in the art will appreciate, there are drawbacks to the use of conventional eccentric crank mechanisms that seek to convert linear motion of the piston to rotary motion of the crankshaft. Some problems with conventional cranks are (1) inefficient conversion of cylinder pressure into crankshaft torque; (2) large lateral forces on the piston; (3) engine vibration; and (4) the inability to form a tightly sealed cylinder base. Prior art has suggested solutions that include offset crankshafts, swash plates, and planetary gear arrangements. Other references allude to particular planetary gears to obtain strict rectilinear motion of the connecting rod, some of which suggest sealing the base of the cylinder and a double-sided piston function.

Base-sealed cylinders with linear throw connecting rods are discussed in U.S. Pat. No. 1,329,954 to Woodford. Planetary gears appear in U.S. Pat. No. 399,492 to Burke as early as 1889; U.S. Pat. No. 587,380 to Ziegler; U.S. Pat. No. 858,438 to Wright; U.S. Pat. No. 1,210,861 to Sitney; U.S. Pat. No. 1,553,009 to Stuke; U.S. Pat. No. 3,886,805 to Koderman; U.S. Pat. No. 4,970,995 to Parsons; U.S. Pat. No. 5,067,456 to Beachley; U.S. Pat. No. 5,158,046 to Rucker; U.S. Pat. No. 5,755,195 to Dawson; U.S. Pat. No. 6,024,067 to Takachi; U.S. Pat. No. 6,089,477 to Takachi; and U.S. Pat. No. 7,185,557 to Venettozzi.

Double-headed pistons are advantageous because of the possibilities of direct force transfer, dissipation of lateral cylinder forces, and the opportunity for compact, directly opposed-cylinder engine design. References that at least address that topic include U.S. Pat. No. 6,006,619 to Gindentuller; U.S. Pat. No. 6,024,067 to Takachi; U.S. Pat. No. 6,089,477 to Takachi; U.S. Pat. No. 5,727,513 to Fischer; U.S. Pat. No. 4,485,768 to Heniges; U.S. Pat. No. 4,026,252 to Wrin; U.S. Pat. No. 3,886,805 to Koderman; and U.S. Pat. No. 5,546,897 to Brackett.

However, the unique arrangement of planetary gears disclosed, illustrated, and claimed in this document produces strict linear motion of a crank pin. Strict linear motion of the crank pin has five primary advantages. First, lateral forces on the piston are virtually eliminated. Second, the base of the cylinder can be sealed, allowing double-sided piston action. Third, two pistons can be rigidly integrated as a single structure. Fourth, improved leverage increases torque capture. And, finally, engine vibration is significantly reduced.

A major advantage of this arrangement is the ability to simultaneously employ both sides of each of the two integrated pistons. Although U.S. Pat. No. 6,024,067 to Takachi discloses an engine piston that directly activates an opposed compressor piston, a main crankshaft for power output is not taught. That reference, therefore, does not suggest application of the concept to the parallel cycle internal combustion engine disclosed and claimed in this document. In addition, the invention disclosed by Takachi fails to seal the cylinder bases, therefore ignoring another advantage of a rectilinear connecting arm motion, namely providing a double-sided piston function. U.S. Pat. No. 3,886,805 to Koderman describes a four-cylinder engine using rigidly attached double-headed pistons and sealed cylinder bases. The two cylinder pairs, however, are orthogonal to one another, and a complex set of valves operates with each cylinder. The thermodynamic cycle, however, under which the engine might function, is not disclosed.

Although separation of expansion and compression functions is presumed in connection with parallel cycle engines, structural separation is not required if functional separation can be achieved-in a novel fashion. In the parallel cycle internal combustion engine disclosed and claimed in this document, linear motion of the connecting rods allow tight closure of the cylinder base, while allowing the upper portion of a single cylinder to function as the expander, and the lower portion to simultaneously function as the compressor. Prior art has not disclosed these advantages.

Thus, references in the art indicate that the present invention is unique and novel. The present invention discloses and claims a powerful, compact engine that incorporates new and novel structures, and cooperation of structural components that includes: (1) independently variable expansion and compression ratios; (2) multi-cylinder, variable aperture, symmetrical disk valves; (3) strict rectilinear connecting rod motion; (4) rigid, one-piece working members that consist of double-headed, double-sided pistons; (5) separate combustion chambers; (6) compressed air accumulator with regenerative braking capabilities; and (7) capability for motive fluid conditioning of water, peroxide, or alcohol injection.

Because of the limitations of a conventional four-cycle internal combustion engine, a need exists in the industry for a new, useful parallel cycle internal combustion engine capable of providing a compact, light, mechanically simple engine that yields improved performance while increasing fuel efficiencies and decreasing emissions.

SUMMARY OF THE DISCLOSURE

The present parallel cycle internal combustion engine achieves the foregoing objectives in several ways by combining new features, methods, and systems. The parallel cycle internal combustion engine disclosed, illustrated and claimed in this document includes separate, oppositely disposed, cylinder blocks. Each cylinder block defines an internal compressor plane and an opposite external expander plane. Cylinders are disposed within each cylinder block, and each cylinder is aligned axially with an associated cylinder within an oppositely disposed cylinder block. A compressor head is installed on an internal end of each cylinder block for closing internal ends of the cylinders. In addition, at least one fresh air inlet valve and at least one compressed air outlet valve are installed in each compressor head for each cylinder.

The parallel cycle engine also includes working members, each of which includes a connecting rod rigidly attached to two double-sided pistons. Each piston head of each double-headed working member is situated in a separate, axially aligned, cylinder. Each piston head of each double-headed working member includes an internal compressor face, an external expander face, and a connecting rod rigidly connecting each pair of piston heads. Each piston head thus separates its associated cylinder into a compressor (compression chamber) and an expander (expansion chamber). Each connecting rod is slidably disposed through a sealed connecting rod aperture in the compressor heads, and has a means for articulation with a crank arm connection.

Also included in the parallel cycle engine disclosed, illustrated and claimed in this document are planetary, linear throw crank assemblies. Each of the linear throw crank assemblies is adapted to operably connect a crankshaft to the central portion of the connecting rod of the double-headed working member.

Rotating, dual-function disk valves are provided to regulate flow of motive fluid through the expander. Each rotating, dual-function disk valve is nestled within one of paired disk valve cradles. One of the valve cradles is installed on each external end of each cylinder block. The floor of each disk valve cradle functions as the interface between the rotating disk valve and the expansion chambers. Specific apertures in the floor of each of valve cradles are situated over the corresponding expansion chambers to form fixed inlet and exhaust mating grates. The fixed mating grates and the rotating disk valve cooperate to ensure that each expansion chamber is in direct continuity with the high pressure inlet domain during the down (power) stroke, and with the low pressure exhaust domain during the up (exhaust) stroke. Each disk valve thus defines at least three central inlet apertures and at least three peripheral exhaust apertures. During operation, each of the rotating disk valve inlet apertures sequentially registers with the corresponding inlet mating grate aperture in the floor of the valve cradle, establishing a path for entry of motive fluid into the appropriate expansion cylinder. Similarly, each of the rotating disk valve exhaust apertures sequentially registers with the corresponding exhaust mating grate aperture of the valve cradle, establishing a path for exit of the post-expansion exhaust gas.

In addition, a pair of dampers is provided for regulating the flow of working gas through the inlet apertures. One of the pair of dampers is situated proximate to each of disk valve. A disk valve drive shaft is provided for rotating each disk valves.

Also included in the parallel cycle engine are high-pressure inlet manifolds. One of the high-pressure inlet manifolds is situated proximate to an external, annular inlet surface of each rotating disk valve which is situated proximate to an external end of each cylinder block, and substantially covers the central inlet apertures. A pair of exhaust manifolds also is included. One exhaust manifold is situated proximate to an external, annular exhaust surface of each rotating disk valve which is situated proximate to an external end of each cylinder block, and substantially covers the peripheral exhaust apertures.

Thus, the parallel cycle internal combustion engine operates with intake/compression and power/exhaust in parallel two-stroke rather than sequential four-stroke cycles. The parallel cycle internal combustion engine cylinder provides twice as many power strokes as a conventional four-stroke engine per crankshaft revolution.

The components of the parallel cycle internal combustion engine may operate autonomously. Thus, the compressor function may be temporarily suspended to achieve exclusive power strokes generated from stored compressed air. Power normally required for compression function is then available to do external work. Compression/expansion ratios are completely variable. Power is variable, eliminating the need for a large engine used only in temporary high demand situations.

The parallel cycle internal combustion engine achieves improved fuel efficiencies because combustion uses continuous rather than discrete fuel combustion with an oxygen rich environment, providing complete combustion of fuels having virtually any octane/cetane rating.

The new disk valve eliminates need for clearance volume of conventional engines, preventing commingling of gases and loss of fuel in the exhaust gas.

Allowing heat regeneration through water injection, an achievement made possible by the continuous combustion process, reduces heat loss. Excess heat is used to induce a phase transition of water to steam, reducing working gas temperature while retaining working gas pressure.

Mechanical efficiencies are enhanced by use of the rotatable disk valves and linear motion crank arms, thereby increasing the energy available.

The parallel cycle internal combustion engine reduces emissions because of increased fuel efficiencies; complete combustion to $CO_2$ reduces CO emissions; and decreased temperature of working gas reduces NOx emissions.

In addition, the parallel cycle internal combustion engine is compact and versatile. Virtually any fluid fuel can be utilized, irrespective of octane/cetane rating. The novel thermodynamic processes, coupled with the mechanical innovations, allow compact engine architecture. Since motive fluid is immediately available from the reservoir, the parallel cycle engine shares certain desirable properties with an electric motor: it does not need to idle, and it does not need a starter motor. A larger dynamic operating range makes the engine capable slow operating speeds, potentially eliminating the need for a transmission and clutch.

The parallel cycle internal combustion engine is less complex than conventional engines. This should translate into wide accessibility and improved reliability.

In summary, the parallel cycle internal combustion engine gets more useful energy out of fuel combustion, loses less energy to heat rejection, and captures more torque in an engine that is smaller and simpler than current alternatives. This improved efficiency, coupled with more efficient modes of operation, results in fewer total emissions. The improved efficiency and decreased emissions are associated with an engine that actually delivers improved power and performance. The implications of the parallel cycle internal combustion engine concept are extensive. The commercial and environmental potential of the parallel cycle internal combustion engine, though difficult to estimate, is certainly large.

It will become apparent to one skilled in the art that the claimed subject matter as a whole, including the structure of the apparatus, and the cooperation of the elements of the apparatus, combine to result in a number of unexpected advantages and utilities. The structure and co-operation of structure of the parallel cycle engine will become apparent to those skilled in the art when read in conjunction with the following description, drawing figures, and appended claims.

The foregoing has outlined broadly the more important features of the invention to better understand the detailed description that follows, and to better understand the contributions to the art. The parallel cycle engine is not limited in application to the details of construction, and to the arrangements of the components, provided in the following description or drawing figures, but is capable of other embodiments, and of being practiced and carried out in various ways. The phraseology and terminology employed in this disclosure are for purpose of description, and therefore should not be regarded as limiting. As those skilled in the art will appreciate, the conception on which this disclosure is based readily may be used as a basis for designing other structures, methods, and systems. The claims, therefore, include equivalent constructions. Further, the abstract associated with this disclosure is intended neither to define the parallel cycle engine, which is measured by the claims, nor intended to limit the scope of the claims.

BRIEF DESCRIPTION OF THE DRAWING

The novel features of the parallel cycle engine are best understood from the accompanying drawing, considered in connection with the accompanying description of the drawing, in which similar reference characters refer to similar parts, and in which:

FIG. 10A is a basic perspective view of the left and right cylinder blocks;

FIG. 10B is a sectional view of a left cylinder block of the parallel cycle internal combustion engine, taken on plane z as depicted in FIG. 10A;

FIG. 10C is an oblique, longitudinal sectional view of a cylinder block of the parallel cycle internal combustion engine, taken on plane x as depicted in FIG. 10B;

FIG. 10D is a laterally offset, longitudinal sectional view of a cylinder block of the parallel cycle internal combustion engine, taken on plane y as depicted in FIG. 10B; and FIG. 10E is a perspective diagrammatic illustration of a cylinder block of the parallel cycle internal combustion engine, showing the conceptual internal, compressor face plane and the conceptual external, expander face plane;

FIG. 11A is an elevation view of the manifold face of the disk valve;

FIG. 11B an elevation view of the expander face of the disk valve;

FIG. 11C a cross section view of the disk valve, taken at section line X of FIG. 11A; and FIG. 11D a side elevation view of the rotating disk valve seen in FIG. 11A;

FIG. 12A depicts a disk valve seating embodiment suited for use where expansion of the rotating disk valve during operation is small; and FIG. 12B depicts a disk valve seating embodiment adapted to compensate for larger expansion of the rotating disk valve during operation;

FIG. 13A is an elevation view of the manifold face of the disk valve;

FIG. 13B an elevation view of the expander face of the disk valve;

FIG. 13 C a cross-sectional view of the disk valve taken at line X of FIG. 13A; and FIG. 13D a side elevation view of the rotating disk valve seen in FIG. 13A;

FIG. 14A is a elevation view of the disk valve face of an isolation grate usable in association with the embodiment of the disk valve seen in FIGS. 11A-11D, where a separation of the inlet and exhaust domains is maintained through the disk valve; and FIG. 14B an elevation view of the disk valve face of an alternative isolation grate usable in association with the embodiment of the disk valve seen in FIGS. 13A-13B, where the inlet and exhaust domains present on the manifold face of the disk valve diverge into a common domain on the expander face of the rotating disk valve;

FIG. 21A depicts the initial portion of a typical compression stroke in a cylinder of an engine apparatus according to the present disclosure;

FIG. 21B depicts the final portion of a typical compression stroke;

FIG. 21C depicts the initial action of braking in a cylinder of an engine apparatus according to the present disclosure; and FIG. 21D depicts the final action of braking in a cylinder of an engine apparatus according to the present disclosure;

FIG. 22A shows the completion of the compression stroke when a piston is at "top-dead-center" relative to the compression chamber portion of the working cylinder;

FIG. 22B shows conditions prior to the completion of the compression stroke, but after the pressure in the compression chamber has increased adequately to overcome the pressure of the compressed air in the primary compliance chamber;

FIG. 22C shows the compressor during unloading; and

FIG. 22D shows intentional loading of the compressor to provide engine braking;

FIG. 23A depicts the intake valve in the open position during a normal intake stroke;

FIG. 23B depicts the intake valve in the closed position during a normal compression stroke;

FIG. 23C depicts the intake valve in a forced open position during a compressor unloading stroke (venting compression);

FIG. 23D depicts the intake valve in a restricted open position during a compressor loading stroke (restricted intake);

FIG. 24A depicts the outlet valve in the closed position during a normal intake stroke;

FIG. 24B depicts the outlet valve in the open position during a normal compression stroke; and FIG. 24C depicts the outlet valve in a forced closed position during a compressor loading stroke (breaking compression);

FIG. 25A is a schematic diagram of a piston at completion of the power stroke, relative to the expansion chamber, in a working cylinder of a cylinder block according to the present disclosure, and also at completion of the compression stroke relative to the compression chamber of the same working cylinder;

FIG. 25B is a schematic diagram of the working member, positioned 90 degrees to the "left" from its mate seen in FIG. 25A; and FIGS. 25C and 25D are mirror images of FIGS. 25A and 25B, consequent to the operation of the apparatus wherein each cylinder pair is 90 degrees out-of-phase with its neighbor;

FIG. 27A is a conventional all-wheel drive vehicle, FIG. 27B is a gas-electric hybrid all-wheel drive vehicle, and FIG. 27C shows one preferred embodiment of the parallel cycle engine according to the present disclosure.

Figure 1A:
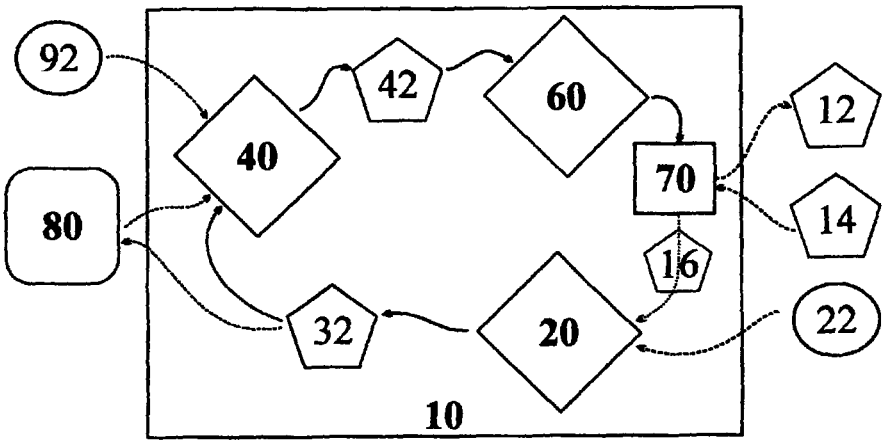
FIG. 1A of the drawing is a block schematic of selected components and interrelated functions of the parallel cycle internal combustion engine according to the present disclosure.

To the extent that the numerical designations in the drawing figures and text include lower case letters such as "a,b" such designations include multiple references, and the letter "n" in lower case such as "a-n" is intended to express a number of repetitions of the element designated by that numerical reference and subscripts. Thus, a label number without a subscript typically is a general designation, while the presence of a subscript designates a specific case.

DETAILED DESCRIPTION

Definitions

The term "exemplary" means serving as an example, instance, or illustration; any aspect described in this document as "exemplary" is not intended to mean preferred or advantageous aspects of the parallel cycle engine.

DESCRIPTION

As illustrated by the drawing figures, a parallel cycle internal combustion engine is provided that in its broadest context includes a pair of separate oppositely disposed cylinder blocks. Each cylinder block defines an internal compressor plane and an opposite external disk valve plane. Four cylinders are disposed within each cylinder block, and each cylinder is aligned axially with an associated cylinder within an oppositely disposed cylinder block. A compressor head is installed on an internal end of each cylinder block for closing internal ends of the cylinders. In addition, a fresh air inlet valve and a compressed air outlet valve are installed in the compressor head for each compression cylinder.

The thermally efficient parallel cycle engine also includes four double-headed pistons. Each double-headed piston includes a pair of piston heads. Each piston head of each double-headed piston is situated in a separate axially aligned cylinder. Each double-headed piston head includes an internal compressor face, an external disk valve face, and a connecting rod connecting each pair of piston heads. Each connecting rod is slidably disposed through connecting rod apertures in said compressor heads, and has a central aperture for crank arm articulation.

Also included in the parallel cycle engine disclosed, illustrated and claimed in this document are four crank arm assemblies. Each of the four crank arm assemblies is adapted to operably connect a crankshaft to a central crank arm connection. A pair of valve cradles is provided. One of the valve cradles is installed on an external end of each cylinder block. Each of the valve cradles defines at least four inlet mating grates. Each inlet mating grate is located adjacent to the corresponding expansion cylinder. Each of the valve cradles also defines at least four exhaust mating grates. Each exhaust mating grate is located adjacent to the corresponding expansion cylinder.

The parallel cycle engine also includes a pair of disk valves. One of each pair of disk valves is rotatably nestled within each of the pair of valve cradles. Each disk valve defines at least three central inlet apertures and at least three peripheral exhaust apertures. In addition, a pair of dampers is provided for regulating the flow of working gas through the inlet apertures. One of the pair of dampers is situated proximate to each of disk valve. A disk valve drive shaft is provided for rotating each disk valves.

Also included in the parallel cycle engine is a pair of high-pressure inlet manifolds. One of the high-pressure inlet manifolds is situated proximate to an external end of each cylinder block, and substantially covers the central inlet apertures, thus creating boundaries for the inlet domain. A pair of exhaust manifolds also is included. One exhaust manifold is situated proximate to an external end of each cylinder block, and substantially covers the peripheral exhaust apertures, thus creating boundaries for the exhaust domain.

In brief summary, the engine thus includes means for compressing ambient air, accumulating and storing the compressed air, means for creating a motive fluid through heat addition from combustion of fuel with the compressed air, and a means for expansion of the motive fluid to produce useful work. According to the method and apparatus, the compression, combustion and expansion are independently controllable, continuous processes. Further, the compression ratio and expansion ratio of the engine are continuously variable. The compressor may be driven by the expander, or by other additional intermittent power sources. The engine's combustor receives compressed air directly from the compressor, or from compressed air stored in one or more the auxiliary compressed air accumulator reservoirs.

Also, with the present engine, the compressed air may be utilized or treated prior to entry into the combustor such that: (1) when combined with a heat exchanger, auxiliary heat is generated; or (2) when combined with a heat sink, auxiliary refrigerated air is generated; or (3) a portion of the compressed air can be utilized as a source of auxiliary motive fluid that does not require further heat addition.

The motive fluid may also be treated prior to entry into the expander. For example, motive fluid temperature can be reduced by introduction of liquid water into the motive fluid, and utilizing a portion of the motive fluid heat to vaporize the water into steam. Water may be introduced as an isolated additive, or in combination with other beneficial substances, such as fuel or fuel enhancer, including hydrogen peroxide. Also, engine structural temperatures and external heat loss can be reduced by spraying liquid water onto the internal surfaces of the combustion chamber housing, utilizing a portion of the housing heat to vaporize the water into steam. Utilization of the produced steam, created within the motive fluid, tends to offset the loss of pressure associated with the temperature reduction. As an added benefit, decreased motive fluid temperature decreases certain emissions, such as $NO_x$.

The motive fluid furthermore may be treated following expansion, but prior to terminal exhaust, with processes including: (1) the use of a turbocharger that receives the motive fluid following expansion to boost intake pressure of the compressor; (2) the use of an auxiliary condenser to regenerate the temperature control water, as explained above, from steam present in exhaust gas. Further, it is possible to direct motive fluid, following primary expansion, to second expansion chambers for secondary expansion, thereby increasing thermal efficiency (i.e., Brayton/Atkinson expansion).

The preferred embodiment of the present apparatus features a fundamental functional unit that is comprised of eight dual-chamber/dual-function cylinders, four double-headed/double-sided piston working members, and two main crankshafts, where each cylinder integrates both expansion and compression functions by having a closed cylinder head and closed cylinder base that encloses a reciprocating piston. Thus, the piston divides the cylinder into expansion and compression chambers.

The expansion chamber is defined by the variable space between the cylinder walls, the piston and closed cylinder head, and thus has substantially zero clearance volume when piston is at top-dead-center, where the expander face of the piston is arbitrarily close (flush) with the cylinder head. In operation of the apparatus, the expansion chamber receives the motive fluid and performs motor functions of expansion (power) and exhaust. Means are disclosed hereinafter whereby entry of motive fluid into the expansion chamber (expander) can be controllably inhibited to create suction forces within the expansion chamber providing engine braking and engine cooling.

The compression chamber (compressor) according to the present disclosure is defined by the variable space between the cylinder wall, the piston and closed cylinder base, and thus has substantially zero clearance volume when piston is at bottom-dead-center, where the compressor face of the piston is arbitrarily close to the cylinder base. The compression chamber receives fresh air and pumps compressed air. During operation, the compression chamber performs compressor functions of intake and compression (pumping). Entry of fresh air into the compression chamber can be controllably inhibited to create suction forces within the compression chamber providing engine braking and engine cooling. Also, as further explained, exit of compressed air from the compression chamber may be controllably inhibited to increase pressure within the compression chamber for regenerative braking. Controllable regurgitation of fresh air from the compression chamber back into the inlet manifold can be controllably established to eliminate compressor function and the associated work of compression, of the compression chamber.

Further according to the apparatus and method, each dual-function cylinder functions concurrently and independently as a motor, compressor and engine brake, that is, each cylinder independently and controllably performs all four functions (intake, compression, expansion, and exhaust) during one revolution (of the crankshaft—functional two-stroke engine). The expansion chamber portion of the cylinder performs expansion (power), while the compression chamber portion of the cylinder simultaneously performs compression (pumping). Moreover, the expansion chamber portion of the cylinder performs exhaust while the compression chamber portion of the cylinder simultaneously performs intake. Inlet of motive fluid into the expansion chamber, as well as intake and discharge of the compression chamber, can be independently controlled to provide engine braking forces.

In one preferred embodiment, four of the identical, dual function cylinders are arranged in two cylinder blocks. The four cylinders of each cylinder block are arranged in a 2×2 "clover-leaf" pattern. In each cylinder block, the center axes of the four cylinders are substantially parallel, and intersect a perpendicular plane at the corners of a square whose sides are approximately equal to the maximum diameter of the cylinder. The core of the cylinder block may be composed of a light, porous ceramic material to improve rigidity, heat tolerance, and percolation of coolant. Additionally, the individual cylinder blocks assume an orientation such that the cylinder head end is involved with expansion functions and the cylinder base end is involved with compression functions, The first and second paired cylinder blocks preferably are arranged in an opposed fashion such that he expansion ends of the paired cylinder blocks face laterally (externally), and the compression ends of the paired cylinder blocks face medially (internally). Center axes of each of the four cylinders of one cylinder block are substantially coaxial with their mirror-image pairs in the corresponding, opposed second cylinder block.

The crank-case of the thermal engine is situated between the opposed paired cylinder blocks, such that each lateral face of the crank-case abuts the compressor (internal side) of the paired cylinder blocks. Four identical double-headed/double-sided piston working members function in the apparatus, whereby each piston head reciprocates within its corresponding cylinder, and each of the paired piston heads is located within the opposed cylinder blocks.

The net, instantaneous force exerted on the planet wrist pin by the working member, generated by the paired dual function cylinders, is represented by the instantaneous chamber pressures, where:

$$\text{Force}_{instantaneous\ net}=(P_{expansion}-P_{compression})+(P_{intake}-P_{exhaust})$$

Because each of the four thermodynamic events can be independently regulated, the net force on the working member can range from providing full work (maximum expansion only)-through balanced motoring—to full engine brake (maximum compression coupled with compressor intake and expander inlet inhibition). Relative to one another, each of four the double-headed/double-sided working members reciprocates 90 degrees out of phase with its adjacent member. Therefore at any given instant, four of the eight working chambers are performing the same thermodynamic events.

FIG. 1A offers a general overview of a process according to the present disclosure. External work or force 14 acts upon a crank mechanism 70, which in turn causes the compressor 20 to convert fresh air 22 into compressed air 32. The compressed air 32 combines with fuel 92 in the combustor 40 to produce motive fluid 42 which causes the expander 60 to act on the crank mechanism 70 to produce external work 12. The compressor 20 may also be driven by internal work 16 produced by the expander 60 acting through the crank mechanism 70. Compressed air 32 that is not immediately required by the combustor 40 is accumulated and stored in the compressed air reservoir 80.

The parallel cycle thermal engine process depicted thus illustrated is a variation of the Brayton Cycle. The compressor 20 and expander 60 are devices that inter-convert shaft and pressure work. (Conventional examples are reciprocating pistons and turbines.) The characteristics of the crank mechanisms 70 acting with the expander 60 and compressor 20 define many aspects of Brayton engines. Previous examples of Brayton engines required physically distinct crank mechanisms for the physically separate expander and compressor. An advantage of the disclosed engine 10, however, is the unification of both compressor and expander into a single structure. A further benefit is the ability of the disclosed engine to modulate the interaction between the compressor 20 and expander 60, such that the compressor 20 can convert and store intermittent sources of external work 14 as they become available. Examples of such intermittent sources 14 include vehicular kinetic energy during braking, wind and solar energy.

Figure 1B:
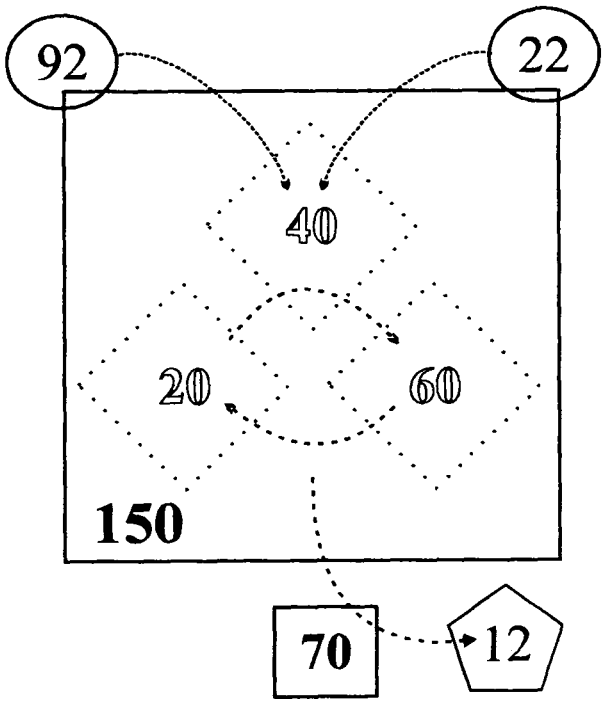
FIG. 1B is a block schematic of selected components and interrelated functions of a conventional Otto- or Diesel-type internal combustion engine known in the art.

Reference is made to FIG. 1B. Whereas in the presently disclosed parallel cycle apparatus 10, the compressor 20, combustor 40, and expander 60 are distinct and separate structures, in conventional Otto and Diesel cycle engines, they are contained within the same structure, namely, the working cylinder 150. In addition, there is no capability of storing external energy 14, so Otto and Diesel engines only deliver external work 12, as suggested in FIG. 1B.

Figure 2:
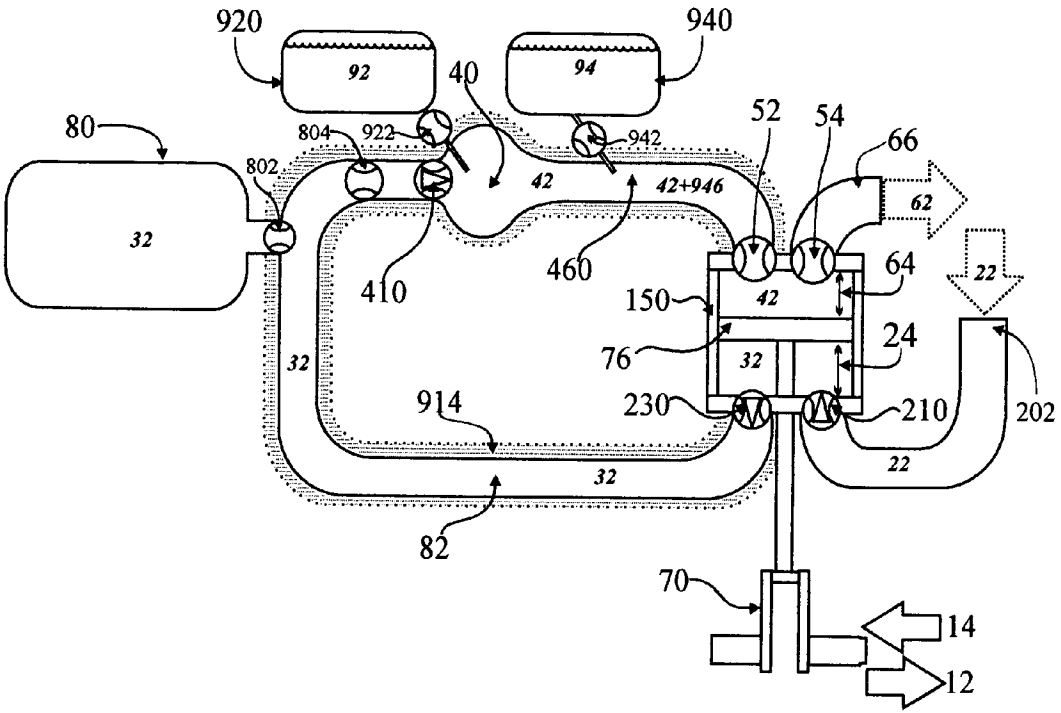
FIG. 2 is a diagrammatic representation of selected components and interrelated functions of the parallel cycle internal combustion engine according to the present disclosure.

Referring jointly to FIGS. 1A-B and 2, diagrammatic representations of selected components and interrelated functions of the parallel cycle internal combustion engine 10 are illustrated. As shown, fresh air 22 enters a fresh air intake 202. The fresh air 22 passes through a one way compressor inlet valve 210 into a compression chamber 24 of a working cylinder 150. In the working cylinder 150, the crank mechanism 70 acts on a piston head 76. The crank mechanism 70 acting on the piston head 76 converts shaft work 14 into compressed air 32. The compressed air 32 exits a compression chamber 24 through a one-way compressor outlet valve 230 into the main compressed air channel 82. As also illustrated in FIG. 2, the compressed air reservoir 80 branches from the compressed air channel 82 before its junction with the combustion chamber 40.

FIG. 2 also shows that compressed air 32 enters the combustion chamber 40 through a one-way, passive, pressure sensitive valve 410. In the combustion chamber the compressed air is combined with fuel 92. The combination of compressed air 32 with fuel 92, upon combustion, forms the motive fluid 42 as shown by cross-reference between FIGS. 1 and 2. An excessive temperature associated with the motive fluid 42 is lowered through the formation of steam 946 by injection of water 94 into an inlet manifold 460. The motive fluid 42, with any additional steam 946, then passes through an active expander inlet valve 52 to enter an expansion chamber 64 of working cylinder 150. In the working cylinder 150, the motive fluid acts on the piston head 76, causing the crank mechanism 70 to convert the pressure work of expansion into external shaft work 12. The expanded motive fluid passes through the active expander exhaust valve 54 into the exhaust manifold 66, and thereupon exits as exhaust gas 62.

As further illustrated in FIG. 2, a compressed air reservoir isolation valve 802 and a system isolation valve 804 are included. The compress air reservoir isolation valve 802, in combination with a system isolation valve 804, are provided to prevent escape of compressed air when the parallel cycle internal combustion engine 10 is not in use. Insulation 914 prevents heat and/or energy loss from the main compressed air channel 82. Fuel 92 is stored in a fuel reservoir 920. Fuel reservoir 920 is controlled by a fuel control valve 922. Water 96, or other additives, is stored in a water reservoir 940. Water reservoir 940 is controlled by a water control valve 942.

As a result of the interrelationship of the components shown in FIG. 2, integration of compression and expansion functions is achieved in part by closing both ends of the working cylinder 150. The working cylinder 150 is closed so that piston head 76 simultaneously divides the working cylinder 150 into the expansion chamber 64 and a compression chamber 24. By dividing the working cylinder 150 into an expansion chamber 64 and a compression chamber 24, the need for separate expansion and compression cylinders, a serious drawback of earlier Brayton engines, is eliminated. The division of the working cylinder 150 into an expansion chamber 64 and a compression chamber 24 also allows the expander 60 and the compressor 20 to share a common crank mechanism 70, the importance of which will be explained subsequently.

Figure 3:
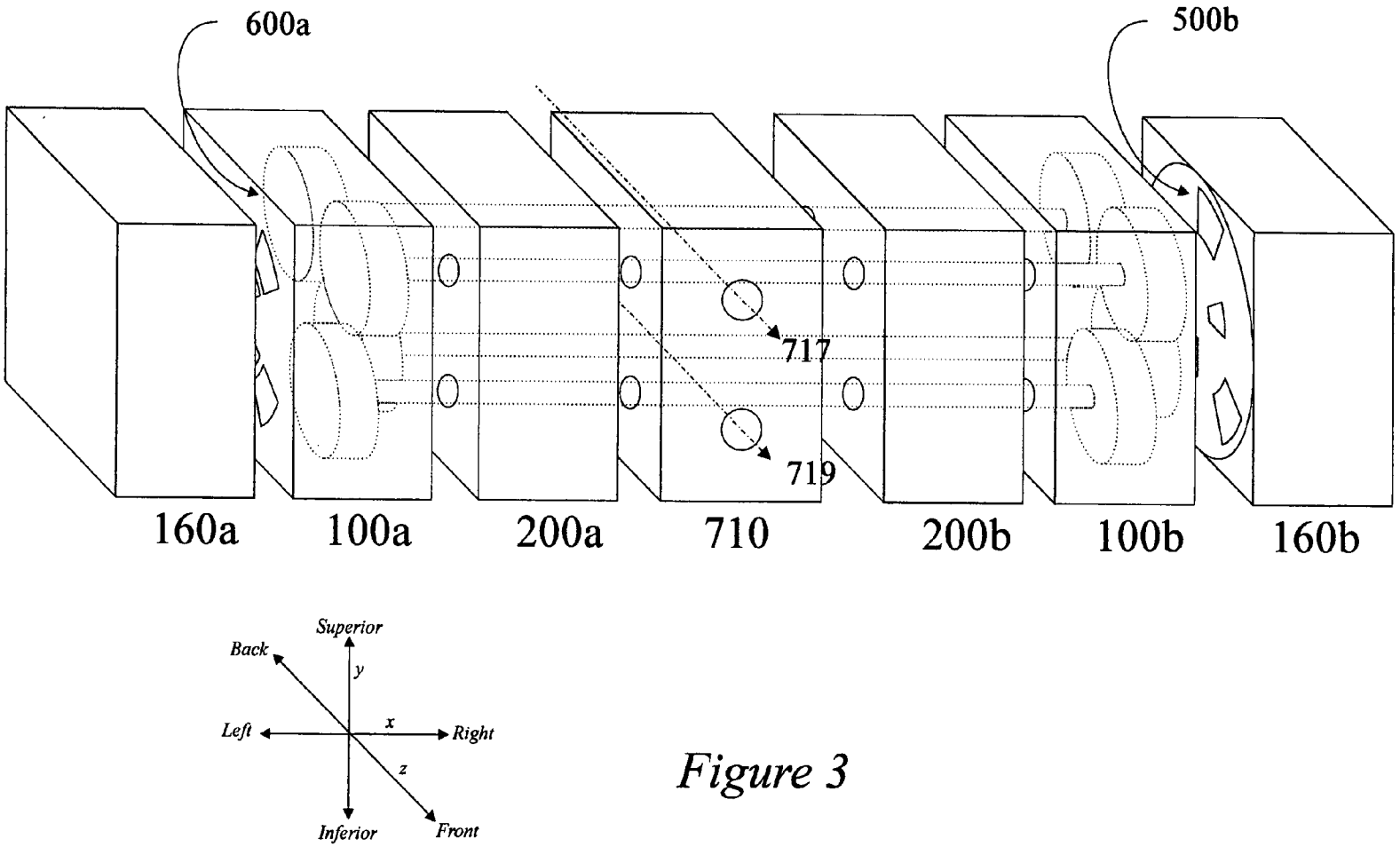
FIG. 3 is a perspective block illustration of selected components and interrelated functions of the parallel cycle internal combustion engine.

Referring now to FIG. 3, a lateral perspective block illustration provides general orientation of selected components and interrelated functions of the parallel cycle internal combustion engine 10. The centrally situated crankcase 710 defines the superior crankshaft axis of rotation 717 and the inferior crankshaft axis of rotation 719. The crankcase 710 is flanked by paired compressor heads 200*a,b*. The paired compressor heads 200*a,b* are flanked laterally by paired cylinder blocks 100*a,b*. The paired cylinder blocks 100*a,b* are in turn flanked laterally by paired cylinder heads 160*a,b*. In addition, FIG. 3 shows the location of a rotating disk valve 500*b*, as well as a cylinder isolation grate 600*a*, which will be more fully described subsequently.

Figure 4:
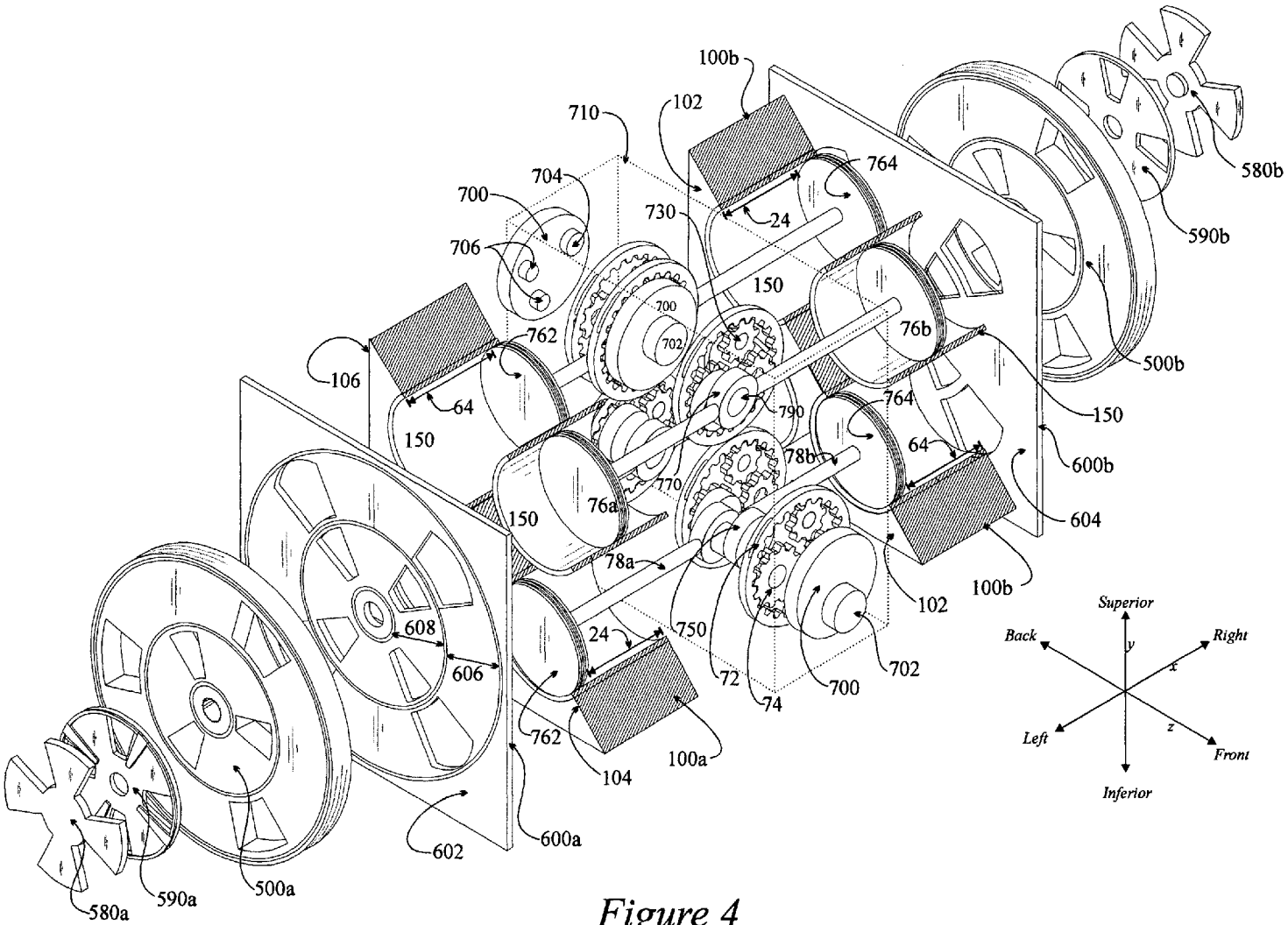
FIG. 4 is a perspective exploded view of selected components and interrelated functions of the parallel cycle internal combustion engine.

As illustrated by collective reference to FIGS. 1-4, and especially FIG. 4, the paired lateral cylinder blocks 100*a,b* are situated on opposite sides of the central crankcase 710. The paired rotating disk valves 500*a,b* mate with the paired cylinder isolation grates 600*a,b*. As shown, paired cylinder isolation grates 600*a,b* are attached to their associated cylinder blocks 100*a,b*. In addition, paired inlet control dampers 580*a,b* are provided. The paired inlet control dampers 580*a,b* cooperate with paired damper isolation grates 590*a,b* which in turn abut corresponding rotating disk valves 500*a,b*. Combustion chamber 40, compressed air reservoir 80, and certain other elements of the parallel cycle internal combustion engine 10 shown in FIG. 1A have been omitted for clarity from FIG. 4.

Combined reference is made to FIGS. 2 through 4. The paired cylinder blocks 100*a,b* each contain four identical working cylinders 150. The identical working cylinders 150 are arranged in a two-by-two cloverleaf fashion. Each working cylinder 150 contains a reciprocating piston head 76. Each reciprocating piston head 76 divides its corresponding working cylinder 105 into two dynamic components. The first component is the internally situated compression chamber 24 and the externally situated expansion chamber 64. As such, each paired cylinder block 100*a,b* has an internally oriented compressor face 102, as well as an externally oriented expander face 104. The paired cylinder blocks 100*a,b* are disposed in an opposing fashion such that the longitudinal axes of each of the four working cylinders 150 in one of the cylinder blocks 100*a* are coaxial with the axes of the corresponding working cylinders 150 of the opposite cylinder block 100*b*. More detailed descriptions of cylinder blocks 100*a,b* will be provided subsequently.

As indicated, FIG. 4 also illustrates the centrally located crankcase 710. Centrally located crankcase 710 contains four linear-throw crank mechanisms. Each linear-throw crank mechanism 70 (FIG. 5) includes paired fixed sun gears 72, paired main cranks 700, paired planet gears 74, paired planet cranks 750, and a single wrist pin 790. In addition, two trailer gears 730 are illustrated. The two trailer gears 730 cooperate with a corresponding planet gear 74 to provide smooth operation. For simplicity, the bearings associated with the two trailer gears 730 are not shown.

As also illustrated, the wrist pin 790 of each of the four linear-throw crank mechanisms articulates with a single working member. A single working member is a double-headed, double-sided piston 760. Referring also to FIGS. 25A-25D, each double-headed, double-sided piston working member 760 includes paired peripheral piston heads 76*a,b*, paired connecting rods, 78*a,b*, and a central wrist pin articulation 770. Each of the eight substantially identical piston heads 76 has a laterally oriented expander face 762 and a centrally oriented compressor face 764 whose operation and function will be described in greater detail subsequently.

The paired compressor heads 200 seen in FIG. 3 are not illustrated in FIG. 4 for purposes of clarity (but one head is seen in FIG. 19 and FIG. 20). However, paired compressor heads 200 are positioned between crankcase 710 and each of the corresponding cylinder blocks 100*a,b*. The compressor heads 200 close the internal base of the working cylinders 150 of the corresponding cylinder blocks 100*a,b*. Each compressor head 200 contains the valves and controls necessary to regulate compressor functions, and more detailed discussion of the compressor heads is provided subsequently. The paired cylinder isolation grates 600 represent the floor of the paired valve cradles (not shown).

In operation, the external, expander face 104 of the paired cylinder blocks 100*a,b* is closed by paired internal cylinder isolation grates 600*a,b*. The internal cylinder isolation grates 600*a,b* are formed with apertures and seals that define domains for the exhaust 606 and inlet 608 of each cylinder 150. More detailed description of the cylinder heads is provided subsequently.

As also illustrated in FIG. 4, the paired rotating disk valves 500*a,b* cooperate with their corresponding internal cylinder isolation grates 600*a,b* to control intake and exhaust functions of their respective expansion chambers 64. A single rotating disk valve 500 performs the intake and exhaust regulation functions for all expansion chambers 64 of the four working cylinders 150 housed in a cylinder block 100 (i.e., an eight-cylinder apparatus will have two rotating disk valves). Each rotating disk valve 500 is housed in a valve cradle (not shown). More detailed descriptions of the paired rotating disk valves 500*a,b* is provided subsequently.

FIG. 4 also illustrates paired inlet control dampers 580*a,b*. The paired inlet control dampers 580*a,b* cooperate with paired damper isolation grates 590*a,b* to regulate motive fluid 42 inflow into the respective expansion chambers 64 of the working cylinders 150.

Figure 5:
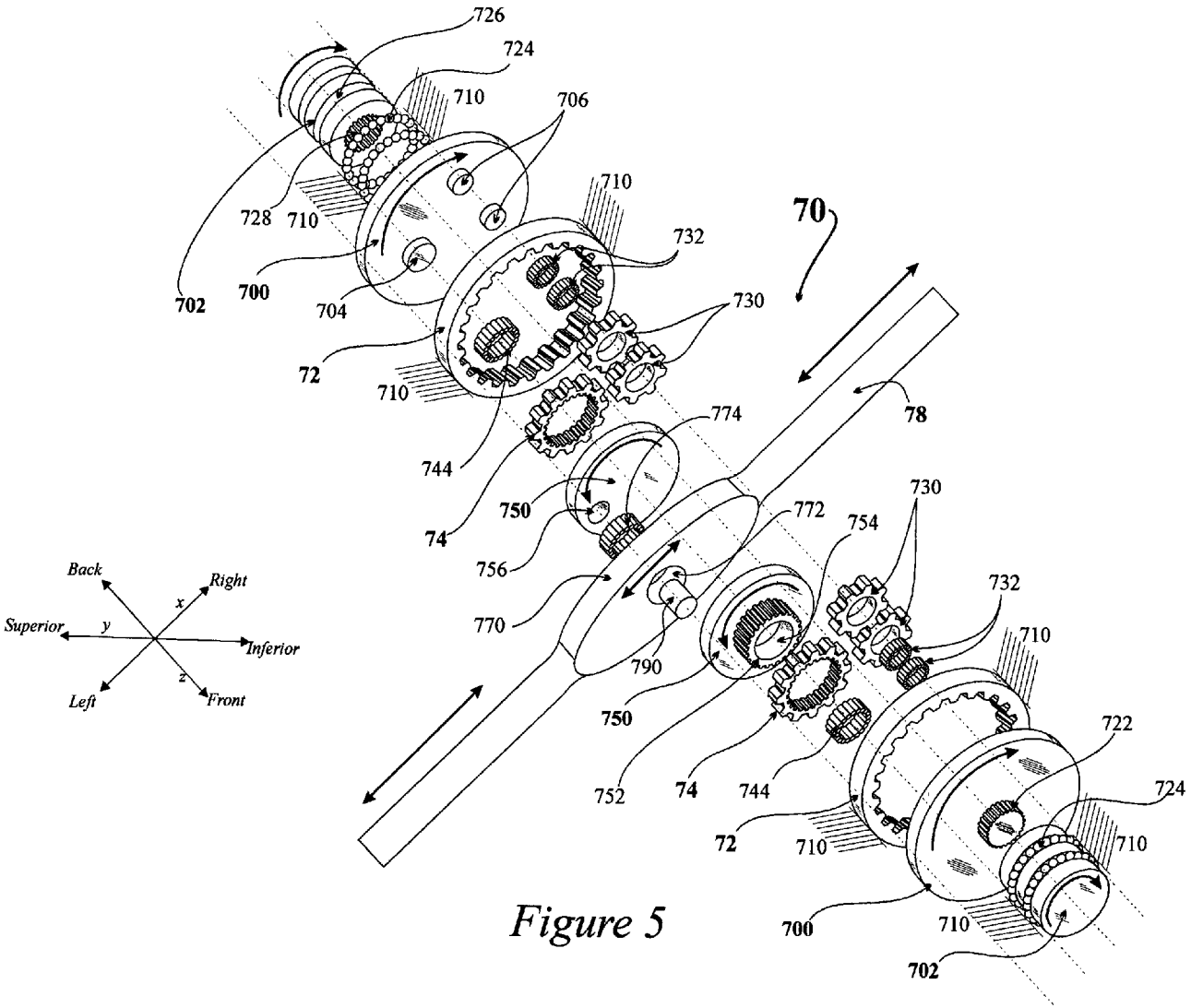
FIG. 5 is an exploded view of a portion of the disclosed parallel cycle internal combustion engine, showing the internal sun gear and linear throw crank mechanism.

Referring now to FIGS. 4 and 5 jointly, more detailed depiction of the operation of the crank mechanism 70 and the sun gear 72 is provided. In one aspect of the parallel cycle internal combustion engine 10, a linear throw crank mechanism in the form of crank mechanism 70 provides linear motion of the connecting rod 78 into rotation of the crankshaft 702 (as suggested by the directional arrows of FIG. 5).

Each of the paired sun gears 72 is rigidly fixed to the crankcase 710 (which is not shown in FIG. 5 for purposes of clarity). The paired planet gears 74 revolve within their respective sun gears 72. Each planet gear 74 also rotates on a planet gear axle 704. The planet gear axle 704 is positioned on its respective main crank 700. Each main crank 700 rotates, as indicated by the directional arrows on the cranks 700 in FIG. 5, and drives a paired crankshaft 702. The main crank 700 may be attached to the crankshaft 702 using any number of methods familiar to those skilled in the art. For example, in certain applications main crank 700 and crank shaft 702 may be included in a unitary structure. Alternatively, as illustrated by cross-reference with FIG. 4, the main crank 700 may have a splined connecting flange 722. Splined connecting flange 722 mates with a complimentary splined aperture 728 formed in the crankshaft 702. The crankshaft 702 rotates on bearings 724 within the crankcase 710. As shown, the crankshaft 702 rotates within the crankcase 710. As shown, by cross-reference to FIG. 4, bearings 724 set within bearing groove 726 mate with complimentary grooves of the crankcase 710.

Each of the paired main crankshafts 717, 719 (reference FIG. 3) utilizes two linear-throw crank mechanisms to convert the oscillating motion of the respective working member into rotational motion of the crankshaft 717 or 719, such that the wrist-pin 790 of the linear throw crank follows a straight path that is co-linear with the central axis of its corresponding opposed cylinder pair.

Preferred embodiments of each linear-throw crank include heavy-duty internal (preferred, as shown in the drawings) or, alternatively, lighter-duty external sun-planet mechanisms. (The conversion or reversion between internal and external sun-planet mechanisms is within the capability of one skilled in the art having recourse to the present disclosure.)

Figure 6A:
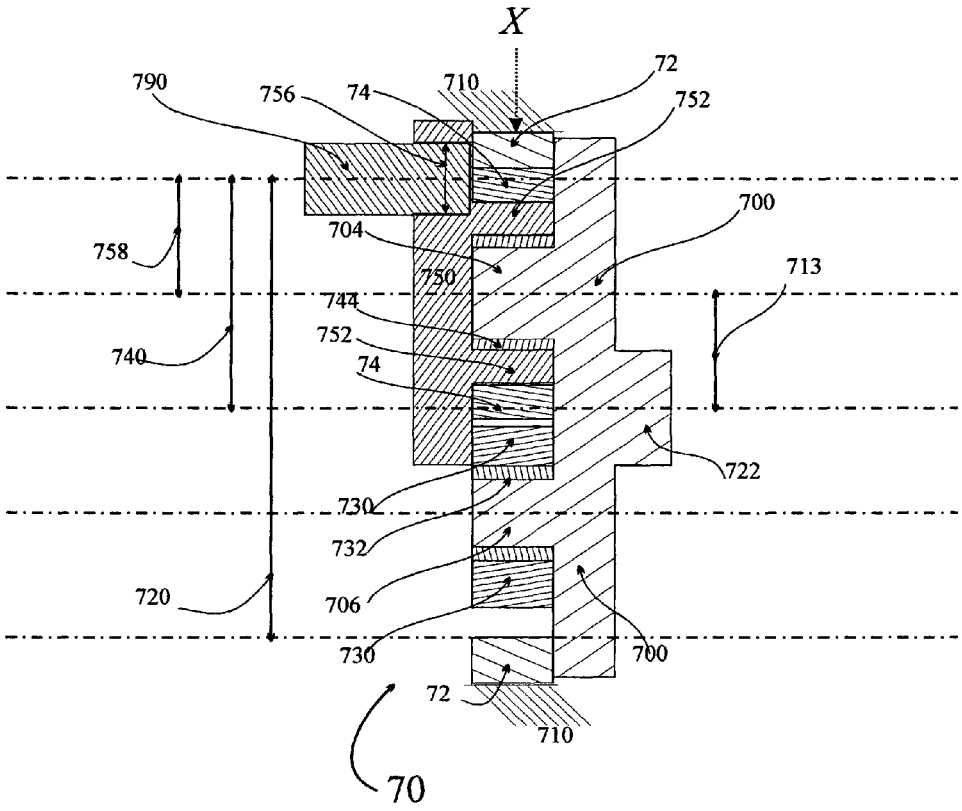
FIG. 6A is a radial section view of one of the paired crank mechanisms that impart rectilinear motion to connection rods of the parallel cycle internal combustion engine.

Thus, each the linear-throw crank mechanism 70 preferably includes paired, mirror-image, internal or external sun-planet gear sets where, in the heavy-duty internal variation, each of the paired, mirror-image, sun-planet gear sets contains an internally toothed, fixed sun gear 72. The fixed sun gear 72 preferably has a pitch circle diameter approximately equal to the axial displacement of a piston head 76. As indicated in FIG. 6A, each of the internal paired sun-planet gear sets provides a corresponding main crank arm of the corresponding main crankshaft 702. The main crank arm's functional length 713 preferably is approximately one-fourth the diameter of the pitch circle of the fixed sun gear 72. The functional length 713 of the main crank arm is the distance between the center axis of the main crankshaft 702 and the center axis of the associated planet gear 74. The main crank preferably has a central portion rigidly fixed to the main crank shaft 702, and a peripheral portion rotatably received within the center of the planet gear 74. Accordingly, each of the internal sun-planet gear sets contain paired externally toothed planet gear 74, in which the planet gear 74 engages the internal teeth of the fixed sun gear 72. The planet gear 74 has one-half the pitch diameter of the fixed sun gear 72. The planet gear 74 rotatably receives the peripheral portion of the main crank.

An alternative external configuration of the sun-planet gear mechanism is comparably configured, and functions similarly; each of the paired, mirror-image, sun-planet gear sets contains an externally toothed, fixed sun gear. Certain relational and dimensional adjustments are needed. For example, in external embodiments, the fixed sun gear has a pitch circle diameter equal to one fifth the piston displacement. And while each of the external the paired sun-planet gear sets receives a corresponding main crank arm of the corresponding main crankshaft, the main crank arm functional length is 1.25 times the diameter of the pitch circle of the fixed sun gear. Again, the functional length of the main crank arm is the distance between the center axis of the main crank shaft and the center axis of the planet gear.

Continuing reference is made to FIG. 5. Each of the sun-planet gear sets (whether internal or external) contains paired planet cranks 750. Each planet crank 750 has a central portion that is rigidly fixed to the planet gear 74. The planet crank arm functional length 758 (FIG. 6A) is equal to the functional length 713 (FIG. 6A) of the main crank arm. The functional length 758 of the planet crank 750 is defined as the distance between the center axis of the planet gear 74 and the center axis of the wrist pin 790. Each wrist-pin 790 receives one of the peripheral portions of each of the paired planet cranks 750. The wrist pin 790 is rotatably received by the central articulating, or wrist pin aperture 772 defined at the medial point of the rigid connecting rod 78 of the double-headed/double-sided piston working member 760.

As a result, the sun-planet arrangement imparts linear motion along the center axis of the wrist pin 790, which in turn imparts strict linear motion to the working member 760. As a result, all forces acting on a working member 760 are substantially parallel to the axes of the corresponding cylinders 150. The resulting minimization of the lateral loads between the sides of each piston head 76 and the cylinder walls reduces friction, engine wear, heat, and power loss. It also allows a reduction in the length of the piston skirt, and increased flexibility in materials for piston design. Moreover, the elimination of conventional connecting rods eliminates one of the major sources of engine vibration. Finally, elimination of lateral forces coupled with the rigid, double-headed double-sided piston 760, allow for reduction in the mass of the oscillating working member, which further reduces vibration.

The sun-planet gear sets employ obvious means for lubrication and load bearing known in the art. The sun-planet gear sets may employ any tooth arrangements (spur or helical) known in the art.

Still referring to FIG. 5, paired planet cranks 750 are illustrated. The paired planet cranks 750 rotate the planet gear 74. Each planet crank 750 is driven by a single connecting rod 78. A wrist pin 790 connects each planet crank 750 to connecting rod 78. However, a person of skill in the art will appreciate that there are a number of methods available for attaching planet crank 750 to the corresponding planet gear 74, as well as for articulating the planet gear 750 with the connecting rod 78. For example, as illustrated by cross-reference to FIG. 4, the planet crank 750 may be attached to the planet gear 74 by the splined connecting flange 752. The splined connecting flange 752 has a central aperture 754 to receive the planet gear axle 704 of the main crank 700. A single wrist pin 790 rotatably traverses the connecting rod 78 through a wrist pin aperture 772. Each end of the single wrist pin 790 rigidly inserts into a corresponding planet crank 750 through the wrist pin socket 756.

As a person skilled in the art will appreciate, a variety of alternative methods are available to allow free rotation and balancing of the above-described components. Thus, for example, in FIG. 4 roller bearings 774 allow free rotation of wrist pin 790 within the connecting rod 78. Likewise, roller bearings 744 allow free rotation of the planet gear 74 on the planet gear axle 704 of the main crank 700. Again, dual trailer gears 730 reduce binding of the main crank 700 against the sun gear 72. The trailer gear 730 rotate on individual axles 706 attached to the main crank 700, and may ride on roller bearings 732. Any suitable means of lubrication may also be applied.

Figure 6B:
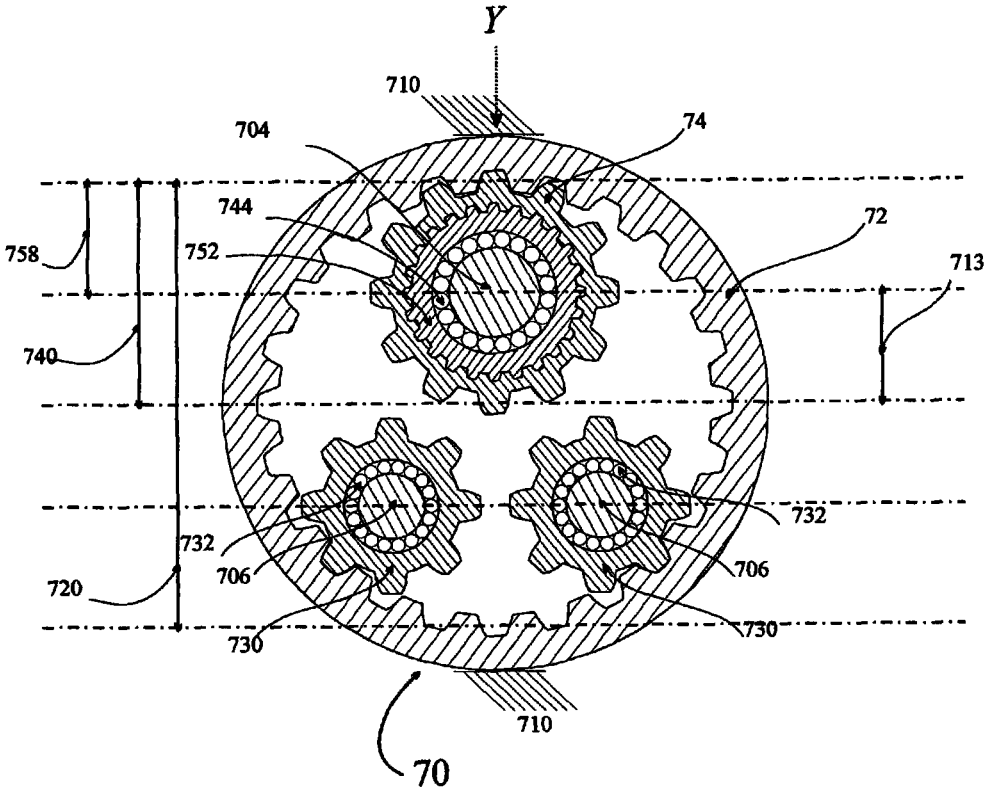
FIG. 6B is an axial section view of one of the paired crank mechanisms.

Referring jointly to FIGS. 6A and 6B, one side of the a crank mechanism 70 is further illustrated. Each of the substantially identical paired sides of a crank mechanism 70 imparts substantially strict rectilinear motion to a connecting rod 78 (omitted from FIGS. 6A and 6B for clarity). FIG. 6A illustrates the main crank 700. In FIG. 6A, main crank 700 and a planet gear axle 704 are sectioned substantially along the line denoted as "Y" in FIG. 6B. FIG. 6B illustrates the crank mechanism 70 sectioned substantially along the line denoted as "X" in FIG. 6A. Thus, as illustrated, main crank 700 includes a planet gear axle 704 and paired trailer gear axles 706 and a splined flange 722 for, in combination, attachment to the crankshaft 702 (not shown in FIG. 6A or 6B for clarity; see FIG. 5). The axis of rotation of the main crank 700 is substantially in the center of splined flange 722. The main crank arm length 713 is the distance from the center axes of the splined flange 722 and the center axes of the planet gear axle 704. Also, the main crank arm length 713 is substantially equal to one-quarter the pitched diameter 720 of the sun gear 72.

As also illustrated by cross-reference between FIGS. 6A-6B, planet gear 74 has a pitched diameter 740 substantially equal to one-half of the pitched diameter 720 of the sun gear 72. The planet gear 74 engages the sun gear 72 such that rotation of the planet gear 74 on the main crank axle 704 causes the planet gear 74 to revolve within the sun gear 72, thereby cranking the main crank 700 during operation.

A person skilled in the art will appreciate that there a variety of methods for connecting planet gear 74 and planet crank 750, not limited to a one-piece monolithic construction. Thus, as illustrated by cross-reference between FIGS. 6A-6B, planet crank 750 is attached to cylindrical splined flange 752 which includes inserts into a splined recess of planet gear 74. The cylindrical splined flange 752 of the planet crank 750 includes an internal recess that receives the planet gear axle 704 of the main crank 700, including its associated bearings 744. As shown, wrist pin 790 is fixedly insertable into a socket 756 of the planet crank 750. The center axis of the wrist pin socket 756 intersects the pitch diameter of the sun gear 72. As also illustrated by cross-reference between FIGS. 6A-6B, the functional crank arm length 758 of the planet crank 750 is equal substantially to the functional crank arm length 713 of the main crank 700. Because of the structure of the foregoing components, and the cooperation of the foregoing components, the central axis of the wrist pin 790 follows a substantially strict, straight, rectilinear path that follows or traces the pitch diameter 720 of sun gear 72 as connecting rod 78 oscillates during operation.

The disclosed parallel cycle engine 10 optionally but preferably employs a novel method of dissipating binding forces that may tend to bind the sun-planet linear throw mechanism. First, each main crank 700 utilizes balancing trailer gears 730 to distribute off-axis torque. Secondly, each crank mechanism 70 contains paired, opposed, mirror image sun/planet gear trains to support the single wrist pin 790 that articulates with each connecting rod 78 of the working member (cross-reference to FIG. 5).

Because the linear motion crank mechanism 70 allows strict, rectilinear motion of the connecting rod 78, the base of the working cylinder 150 can be closed allowing the cylinder to perform simultaneous expansion and compression functions. The piston head 76, therefore, has a surface 762 that defines the expansion chamber 64, and an opposite surface 764 that defines the compression chamber 24. In the disclosed parallel cycle engine 10, the compression chamber 24 is oriented toward the linear motion crank mechanism 70 and consequently, the connecting rod 78 attaches to the compression chamber face 764 of the piston head 76.

Because of the opposed nature of the paired cylinder blocks 100*a,b*, in conjunction with the strict linear motion afforded by the linear motion crank mechanism 70 between the opposed cylinder pairs 150*a,b*, a single, rigid, integrated working member 760 can be comprised of the paired piston heads 76 and their respective paired connecting rods 78. The resultant double-headed, double-sided piston working member 760 simultaneously serves all expansion and compression activity for two opposed working cylinder pairs 150. The resultant working member 760 articulates with and drives a single linear motion crank mechanism 70 by articulation with a single wrist pin 790.

The above arrangement has three important advantages. First, it significantly simplifies and condenses the mechanism. Second, the strict linear motion eliminates a major source of engine vibration. And third, the net force acting on the piston is strictly coaxial with the cylinder, removing all lateral forces that drive the piston against the cylinder wall. This substantially reduces wear, and allow the elimination of the piston skirt. It also allows reduction in the mass of the oscillating working member, thereby reducing both weight and vibration.

Figure 7:
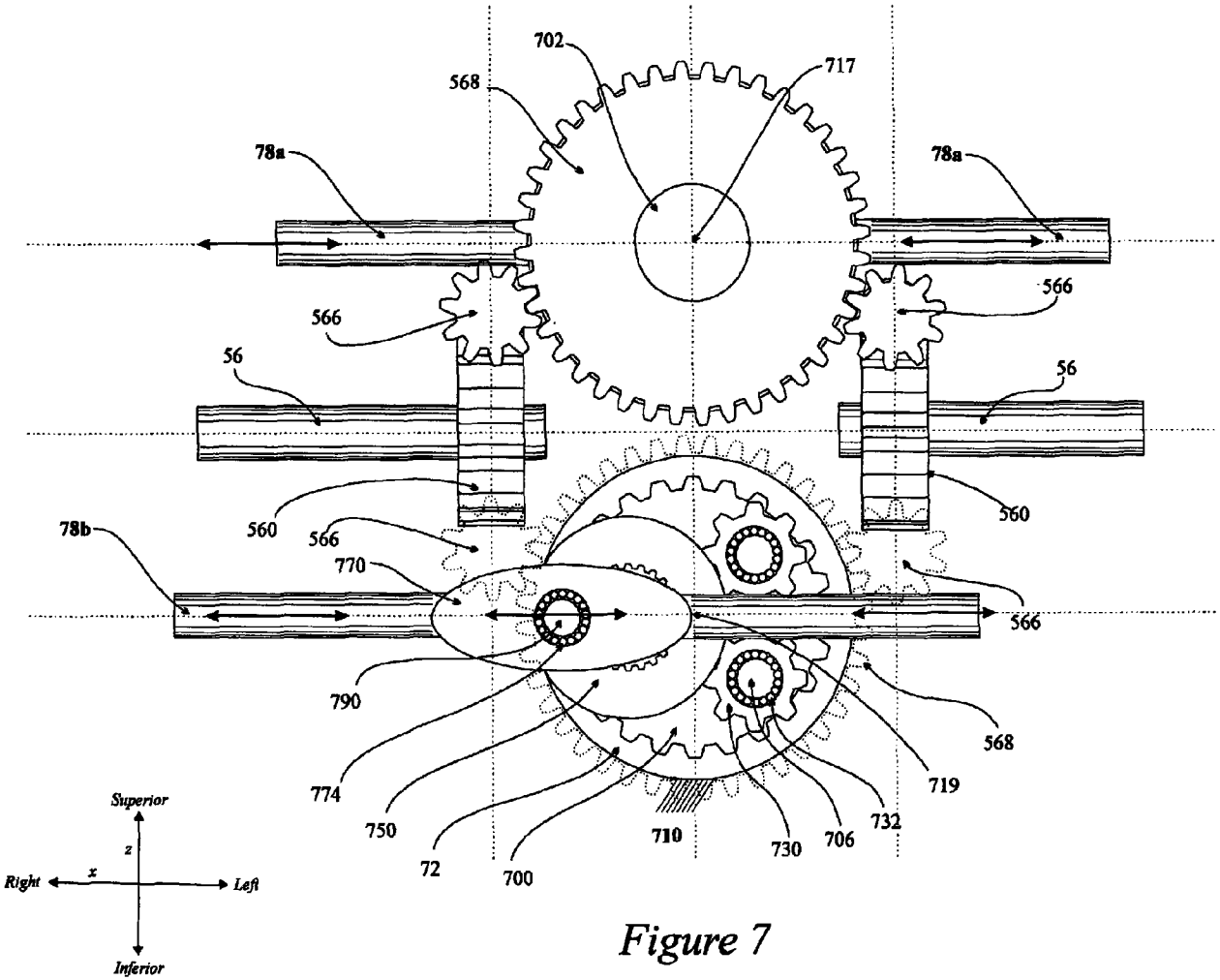
FIG. 7 is a partially cut-away view of a portion of the rear section of a crank case of the parallel cycle internal combustion engine.

As previously indicated, FIG. 7 is a partial-cut away view of a rear section of a crankcase 710 of the parallel cycle internal combustion engine 10. Omitted from the FIG. 7 are, among other elements, the inferior drive gear, the inferior crankshaft, and substantially half of the inferior paired sun planets, in order to more clearly describe the relationship of other structures associated with the crankcase. By cross referencing FIG. 3, it is seen that the axis of rotation 717 for the upper crankshaft is the intersection of the centerline of the upper crankshaft 702 and the upper connecting rod 78*a*. The axis of rotation 719 for the lower crankshaft is the intersection of the centerline of the lower sun gear 72 and the centerline of the lower connecting rod 78*b*. As illustrated, therefore, superior crankshaft 702 is rigidly attached to the crankshaft worm gear drive gear 568.

Again, directional arrows indicate the substantially strict rectilinear motion of the connecting rods 78, which rotate both superior 78*a* and inferior 78*b* connecting rods, which rotate the planet crank 750 through the attached wrist pin 790 and through wrist pin articulation 770. Rotation of the planet crank 750 causes rotation of the planet gear 74 (not shown in FIG. 7 for purposes of clarity), which causes the planet gear 74 to orbit sun gear 72. The sun gear 72 is substantially rigidly fixed to the crankcase 710 (again, not shown for purposes of clarity). The orbiting of the planet gear 74 causes rotation of the main crank 700. Rotation of the main crank 700 causes rotation of the crankshaft 702. The paired trailer gears 730 stabilize motion of the main crank 700 by tacitly rotating about their respective axles 706 that are attached to the main crank 700.

The superior and inferior crankshafts 702 (inferior crankshaft not shown in FIG. 7 for sake of clarity) each rotate a primary disk valve drive gear 568. The primary disk valve drive gear rotates the secondary disk valve drive gears 566. The secondary disk valve gears 566 rotate paired worm gears 562 (FIGS. 8 and 9), which drives the paired tertiary disk drive gears 560. The tertiary disk drive gears 560 are rigidly attached to the paired rotating disk valve drive shafts 56. The foregoing structure and cooperation of structure results in at least a three-to-one (3:1) reduction in revolutions per minute of the rotating disk valve 500*a,b*, as perhaps best illustrated in FIG. 4, relative to the superior and inferior crankshafts 702. The initial orientation of planet gears 74 relative to corresponding sun gears 72 will determine the rotational direction of the crankshafts 702. Accordingly, depending on the application during operation, the paired superior and inferior crankshafts 702 may be designed to rotate in the same or opposite directions. In addition, although a single rotating disk valve drive mechanism could serve both rotating disk valves 500*a,b*, FIG. 7 illustrates only one example that includes individual drive mechanisms. Likewise, although single worm gears could be used to rotate, in general, disk valve drive shafts, paired, opposed worm gears are used to promote smoother operation.

Figure 8:
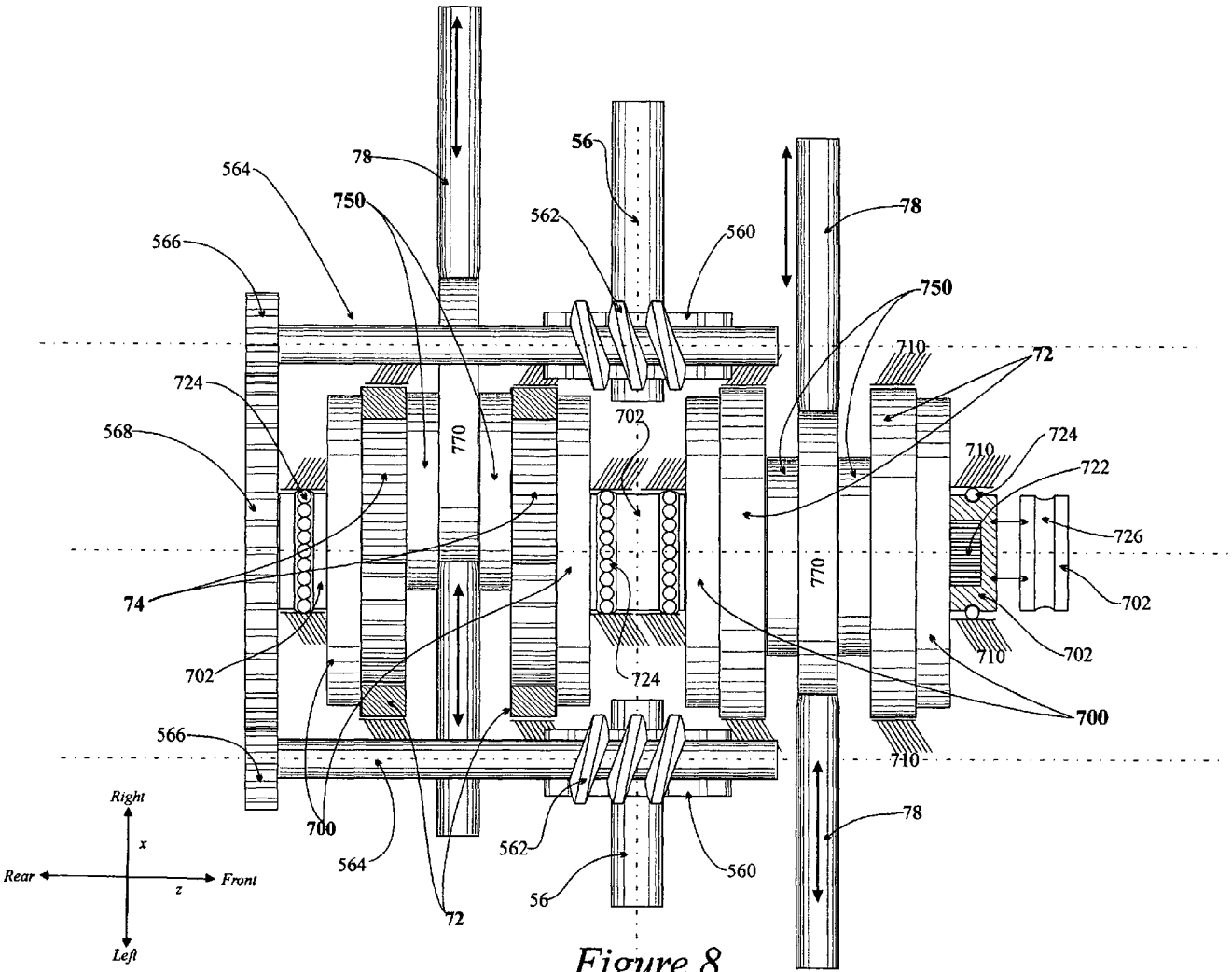
FIG. 8 is a partially cut-away top elevation view of selected components of a crank case of the parallel cycle internal combustion engine.

As illustrated in FIGS. 5, 7, 8, and 25A-D, connecting rods 78 of the double headed-piston 760 transmit rectilinear motion of their respective paired planet cranks 750 via the wrist pin articulation 770, causing rotation of the respective paired planet gears 74 that are engaged within the respective sun gears 72 and rigidly fixed to crankcase 710. In FIG. 8, the superior portion of one (left-hand) set of sun gears 72 has been cut away to illustrated the internal engagement of the respective paired planet gear 74. As shown, rotation of each planet gear 74 causes it to revolve within the engaged sun gear 72, which in turn causes each of the respective main cranks 700 to rotate their respective crankshafts 702. While a person skilled in the art will appreciate that there are a variety of methods and means for coupling crank mechanisms and crankshafts, FIG. 8 illustrates the use of a splined shaft 722. Splined shaft 722 is attached to the main crank 700, which in turn is connectable to the front crankshaft 702. To reduce friction between and among rotatable components, FIG. 8 illustrates roller bearings 724 riding in a circumferential groove 726 that is journaled into crankshafts 702. Crankshafts 702 are thus coupled to the main crank 700.

The crankshafts 702 at one end of the crankcase 710 drives the primary disk valve drive gear 568. The primary disk valve drive gear 568 in turn drives paired secondary disk valve gears 566, which rotate the respective paired worm gear drive shafts 564. The rotation of the respective paired worm gear drive shafts 564 in turn rotates the corresponding paired worm gears 562. Rotation of the respective paired worm gears 562 in turn drives the corresponding paired tertiary disk valve drive gears 560, as illustrated in FIG. 7, which in turn rotates corresponding paired rotating disk valve drive shafts 56. As a result of the foregoing structure and cooperation of structure, the disk valves 500*a,b* rotate at substantially one-third the speed of the crankshaft 702. Any number of suitable lubrication and anchoring means may be employed to ensure smooth operation of the worm drive 562, 564.

Figure 9:
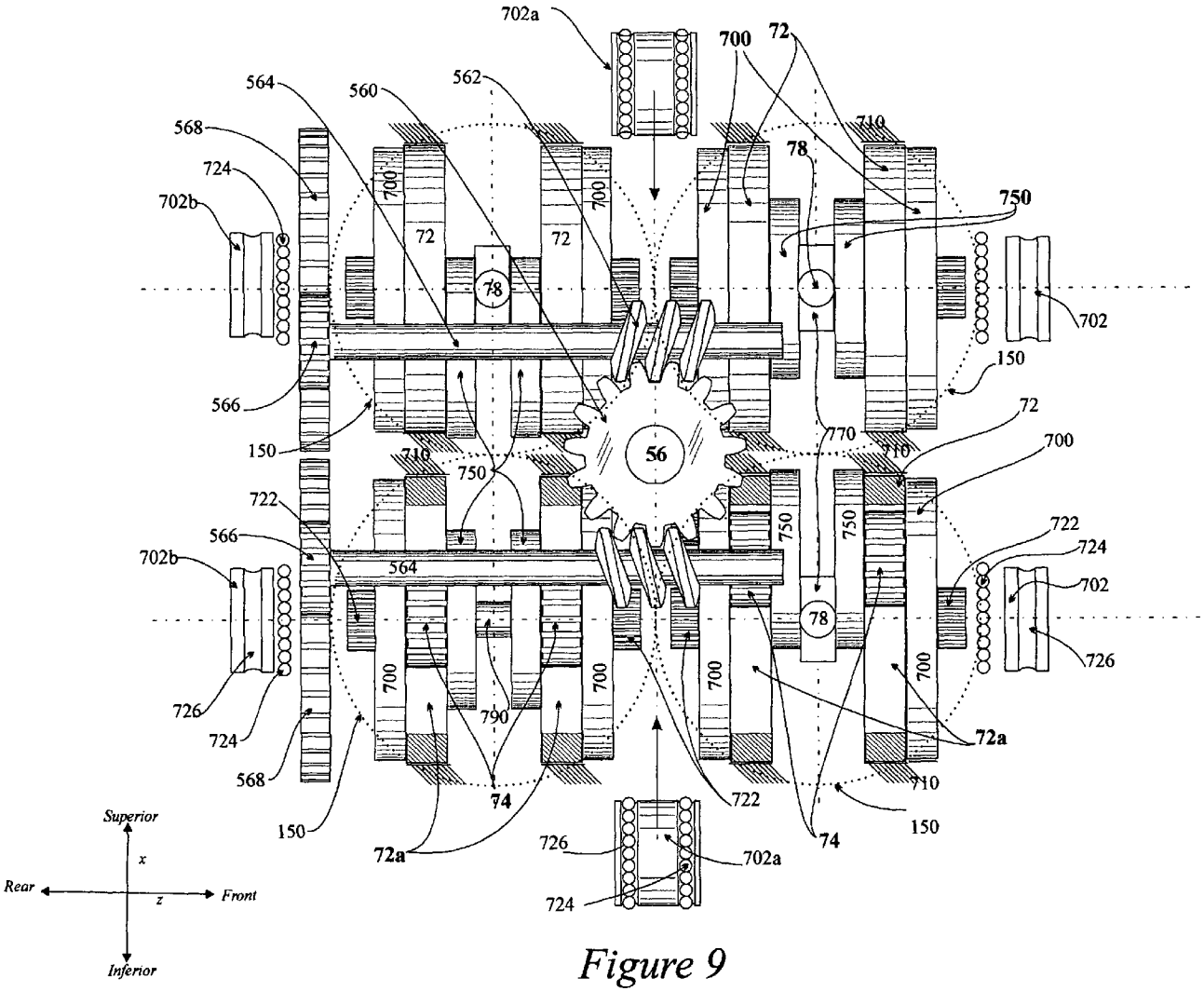
FIG. 9 is a partially cut-away, and partially exploded, side view of the contents of a crank case of the parallel cycle internal combustion engine.

In FIG. 9, crankcase 710 has been omitted for clarity. Linear throw crank mechanism 70 refers to components seen in FIG. 5. As illustrated in FIG. 9, four working cylinders 150 are shown by dashed lines. Two superior (front and rear) linear throw crank mechanisms 70 and two inferior (front and rear) linear throw crank mechanisms 70 are further illustrated in relation to the respective working cylinders 150. As also illustrated, each of four linear throw crank mechanism 70 include paired main cranks 700, paired sun gears 72 (each containing paired planet gear 74 and their associated or corresponding paired planet cranks 750) connected with a single wrist pin 790. Wrist pin 790 articulates with its corresponding connecting rod 78 and wrist pin articulation 770. A splined flange 722 is attached to each of the four paired main cranks 700 that engage a flanged aperture within each crankshaft 702. Each crankshaft is supported by bearings 724. As can be seen in FIG. 9, for each of the linear throw crank mechanisms 70, one of the paired main cranks 700 has its splined flange 722 directed externally, while the other faces internally. The two superior linear crank mechanisms are linked by a single internal crankshaft 702*a* that receives the splined flanges 722 of adjacent linear throw crank mechanism 70. Likewise the two inferior linear crank mechanisms are linked in a similar fashion by a second internal crankshaft 702*a*. Therefore, there are six crankshafts 702, two internal 702*a* that connect adjacent superior and inferior main cranks 700, and four other shafts 702 and 702*b* that attach to the four external facing cranks 700.

As further illustrated in FIG. 9, two of the external crankshafts 702*b* are rigidly attached to and drive paired primary disk valve drive gears 568, both superior and inferior. Each primary drive gear 568 drives paired secondary gears 566 that rotate a worm gear drive shaft 564. Each drive shaft 564 rotates its respective worm gear 562 which in turn rotates the tertiary disk valve drive gear 560. The tertiary disk valve drive gear 560 in turn rotates the disk valve drive shaft 56. In one aspect of the parallel cycle internal combustion engine 10, two primary drive gears 568, four secondary gears 566, four worm gears 562, and two tertiary disk valve drive gears 560 are deployed. The foregoing structure and cooperation and of structure is disclosed and used to provide direct activation of the rotating disk valves 500*a,b* at a disk valve speed equal substantially to one-third of the rotary speed of crankshaft 702. The disk valve drive shaft 56 drives the rotary disk valves 500*a,b* (FIG. 4) at the appropriate rotational speed.

Figure 10A:
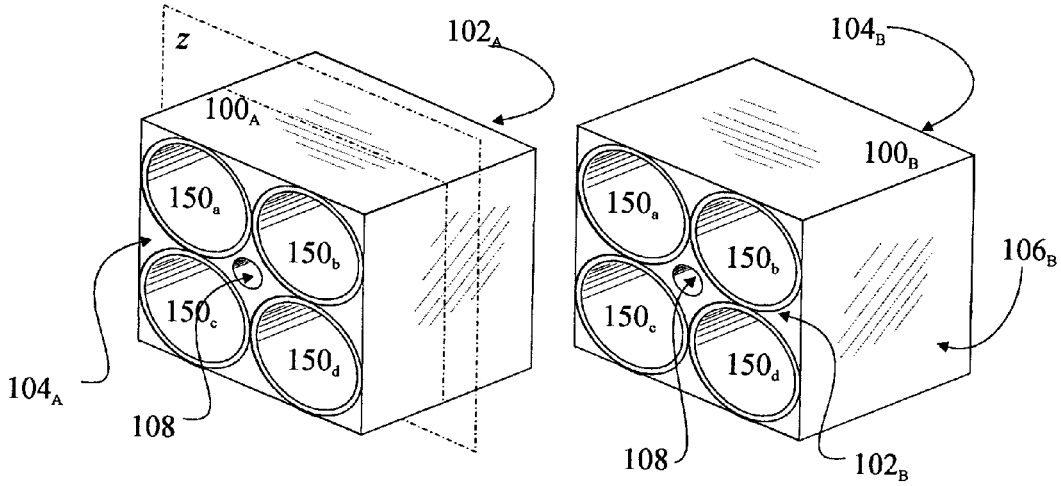
FIGS. 10A-10E provide relative positional information for the paired right and left cylinder blocks of an engine apparatus according to the present disclosure, more specifically.
Figure 10B:
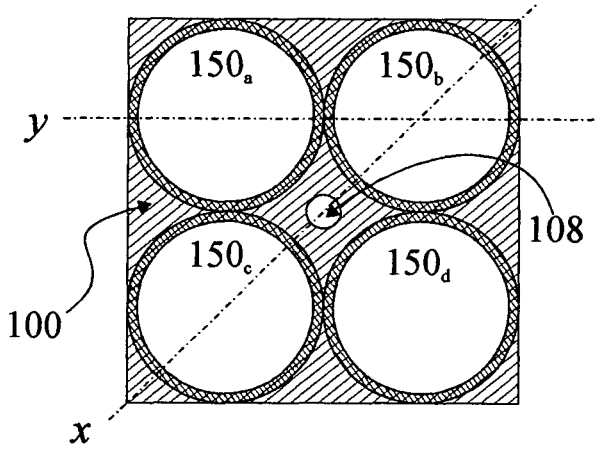
Figure 10C:
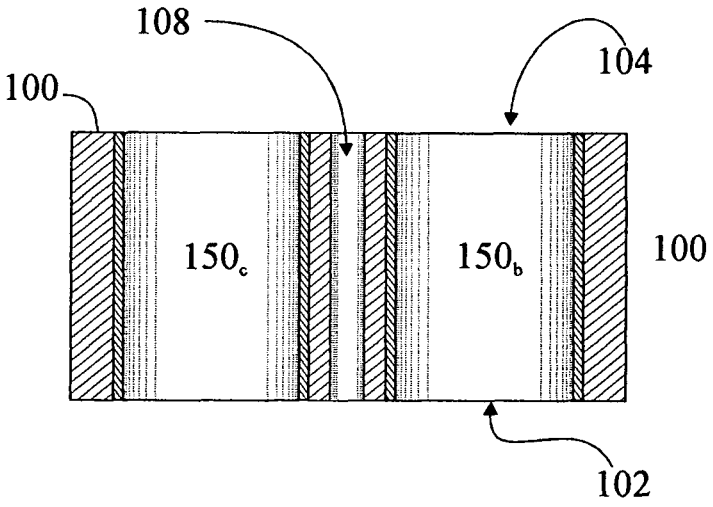
Figure 10D:
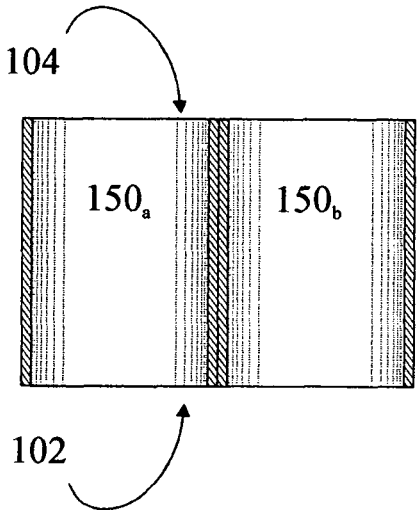
Figure 10E:
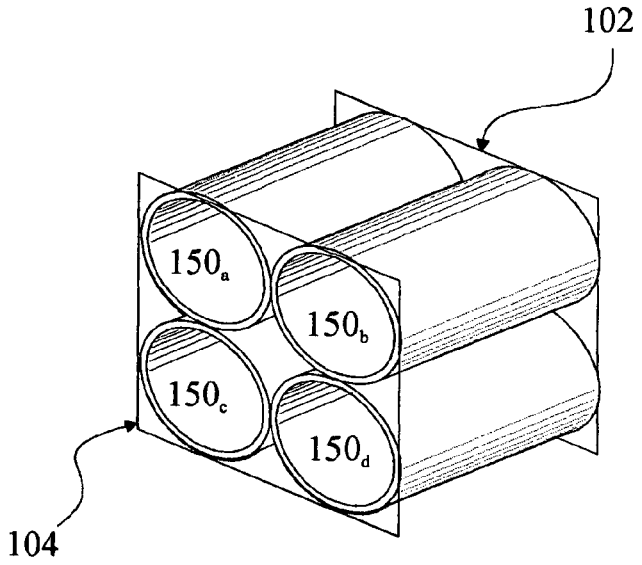

Brief reference is made to FIGS. 10A-E, which further illustrate the configuration of the identical paired, left and right cylinder blocks $\mathbf{100}_A$ and $\mathbf{100}_B$. FIG. 10A is a perspective of the left and right cylinder blocks, $\mathbf{100}_A$ and $\mathbf{100}_B$, respectively. Each cylinder block contains four identical working cylinders $\mathbf{150}_A$, $\mathbf{150}_B$, $\mathbf{150}_C$, $\mathbf{150}_D$ arranged in a 2×2 "cloverleaf" pattern. A central aperture 108 allows transit through a cylinder block of the rotating disk valve drive shaft 56 (not shown in FIGS. 10A-E). Each one of the identical paired left and right cylinder blocks $\mathbf{100}_A$, $\mathbf{100}_B$, presents an associated internal, compressor face $\mathbf{102}_A$ and $\mathbf{102}_B$, as well as an associated external, expander face $\mathbf{104}_A$ and $\mathbf{104}_B$. The preferred, (but not limiting) 2×2 arrangement of the four working cylinders $\mathbf{150}_A$, $\mathbf{150}_B$, $\mathbf{150}_C$, $\mathbf{150}_D$ is best seen in FIG. 10B, which is a section in plane z shown in FIG. 10A. FIG. 10C, meanwhile, depicts an oblique section through plane x of FIG. 10B, showing two working cylinders $\mathbf{150}_B$ and $\mathbf{150}_C$, and the aperture 108 for the rotating disk valve drive shaft. FIG. 10D depicts a transverse section, through plane y of FIG. 10B, which demonstrates two adjacent working cylinders $\mathbf{150}_A$, $\mathbf{150}_V$. FIG. 10E depicts all four working cylinders contained within each of the paired cylinder blocks (omitted), illustrating the internal compressor face plane 102 and external expander face plane 104 defined at each end of a block $\mathbf{100}_A$ or $\mathbf{100}_B$.

Reviewing FIGS. 4 and 10A-E together, the four working members of the disclosed parallel cycle engine cooperate in providing smooth, continuous flow of power. This is defined by the relationship of the four double-headed, double-sided piston working members with respect to the thermodynamic cycle for the eight cylinders 150. The thermodynamic cycle of each working cylinder 150*a*, 150*b*, 150*c*, 150*d* (in each of the two cylinder blocks) is 90° out-of-phase with the adjacent cylinder in the shared block, which is integrated with the motion of each rotating valve 500*a*, 500*b*. Each of the working cylinders 150 is closed at both ends, creating an inner area of intake and compression, and an outer area of power and exhaust. The cylinder head and base are placed such that there is substantially zero clearance volume when the piston reaches either top- or bottom-dead center. The valves are located external to the head and floor and do not prevent a zero clearance volume. Because the compression 24 and expansion 64 chambers are piggy-back within the same working cylinder 150, it is most convenient to speak of a compound expansion/compression stroke and a compound intake/exhaust stroke when talking about the simultaneous events within one working cylinder 150.

Figure 11A:
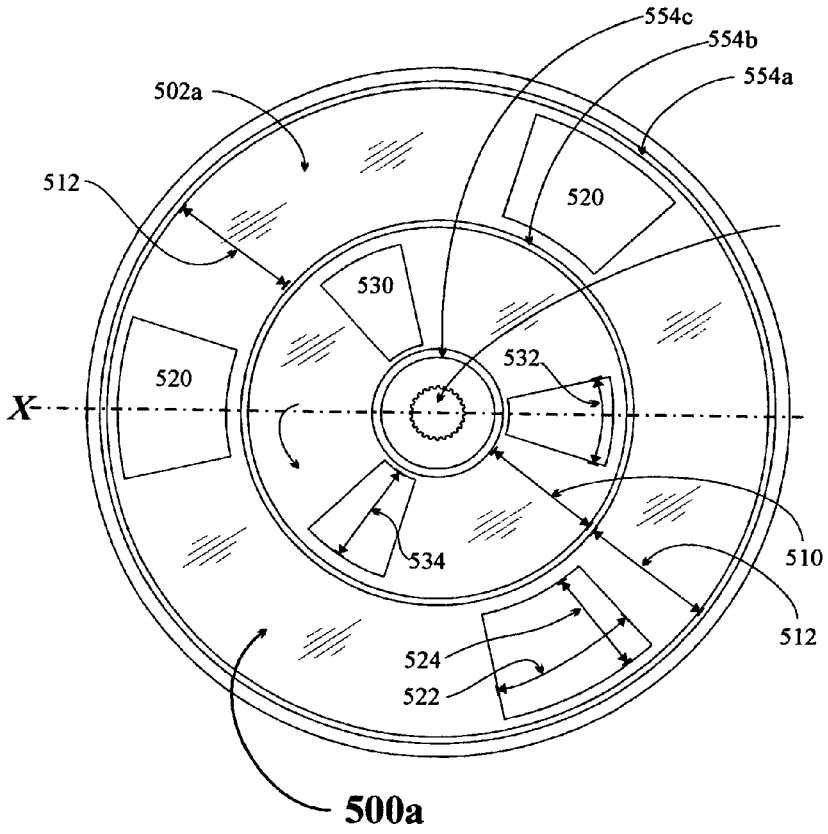
FIGS. 11A-11D depict an illustrative example of a preferred embodiment of a rotating disk valve according to the present disclosure; more specifically.
Figure 11B:
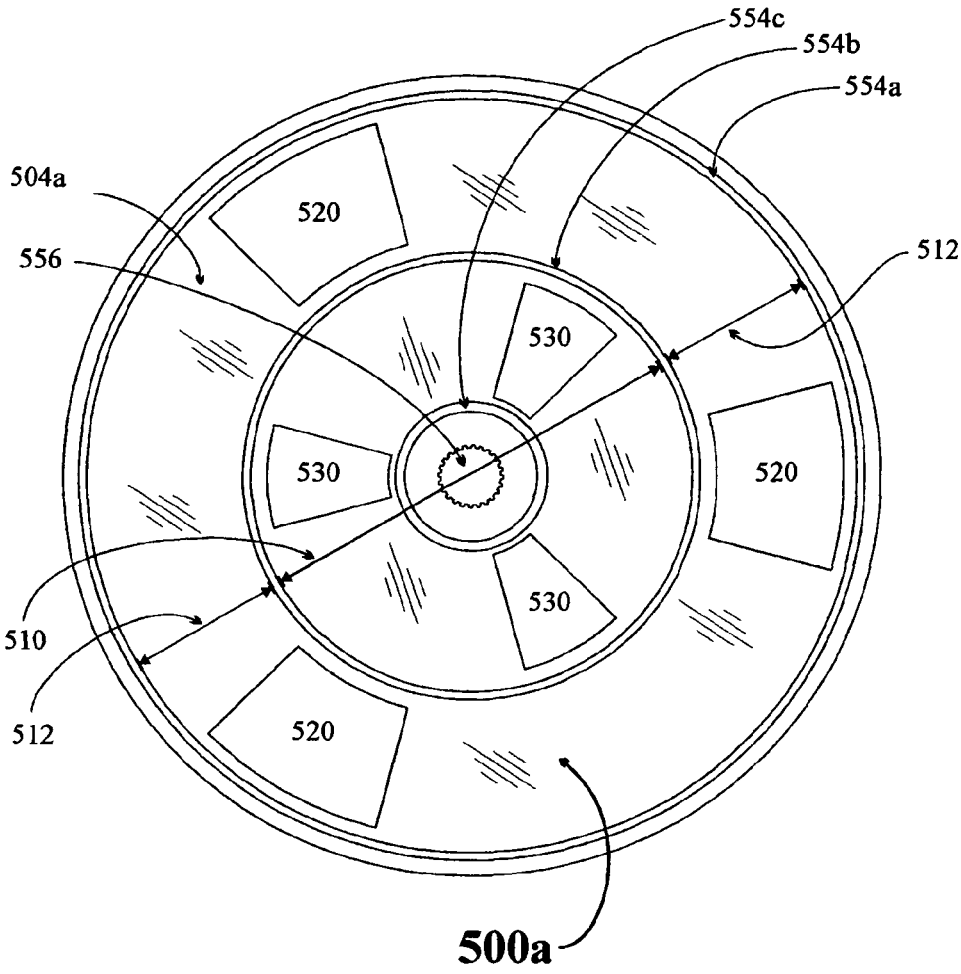
Figure 11C:
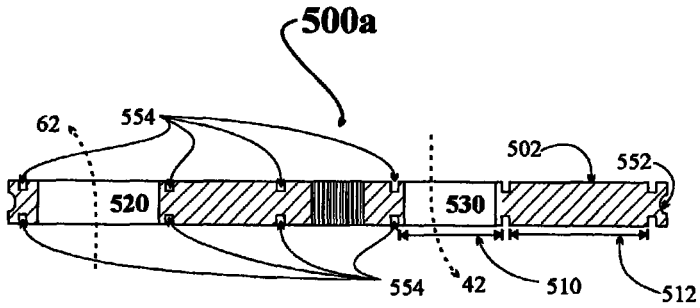
Figure 11D:
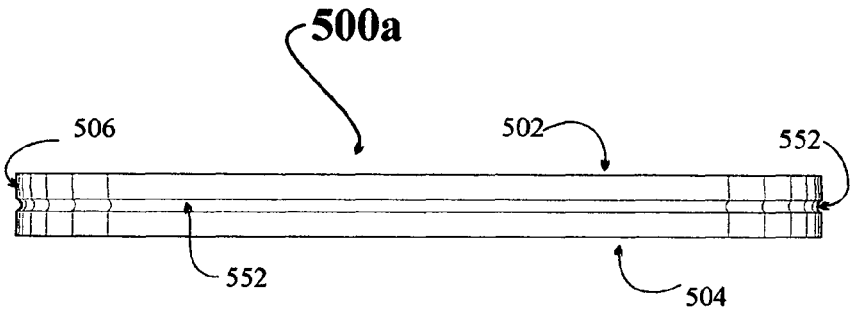

Reference now is invited to FIGS. 11A-D, which depict an example of one preferred configuration of the rotating disk valve 500*a*. Additional detail is offered by FIG. 11A, providing an elevation of the manifold face 502*a*, with FIG. 11B being an elevation of the expander face 504*a*. FIG. 11C shows a cross section of the disk valve 500*a* taken at line X on FIG. 11A. FIG. 11D is a side view of the rotating disk valve. Each of the paired rotating disk valves 500 presents a lateral, external manifold face 502*a* and an internal expander face 504*a*. Each of these faces, on each disk valve, is divided into a central annular inlet domain 510 and a peripheral annular exhaust domain 512. At least three arcuate inlet apertures 530 are symmetrically defined through the valve disk in the inlet domain 510. Three arcuate exhaust apertures 520 similarly are symmetrically defined in the outlet domain 512. Each of the three inlet apertures 530 has a radial length 534 and an angular width 532 (FIG. 11A). Each of the three exhaust apertures 520 likewise has a corresponding radial length 524 and an angular width 522. The inlet and exhaust domains 510, 512 are bounded by concentric sealing ring grooves 554*a,b*, and *c*. Central 554*c*, medial 554*b*, and peripheral 554*a* sealing grooves are defined in each manifold face 502*a* and expander face 504*a* of each disk valve 500*a*. The exhaust domain 512 likewise is bounded by the peripheral and medial sealing grooves 554*a,b*, while the inlet domain 510 is bounded by the medial and central sealing grooves 554*b,c*, as best seen in FIGS. 11B, 11C.

A feature of the disclosed engine is the advantageously multi-functionality of the rotating disk valve 500. Referring also to FIG. 2, each disk valve 500*a* regulates the passage of motive fluid 42 from the inlet manifold 460, through the expansion chamber portion 64 of a working cylinder 150, and into the exhaust manifold 66. This regulation is realized by the synchronized, sequential creation of a channel that alternatively connects an expansion chamber 64 with either an inlet domain 462 or an exhaust domain 620.

Figure 12A:
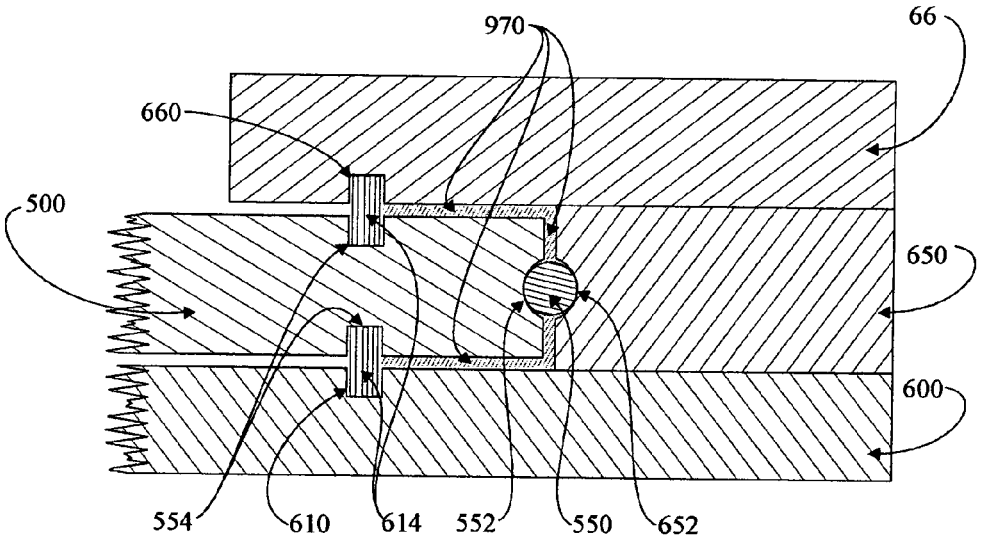
FIGS. 12A and 12B are enlarged, cross sectional views of portions two alternative embodiments of means for seating and sealing the rotating disk valve according to the present disclosure, more specifically.
Figure 12B:
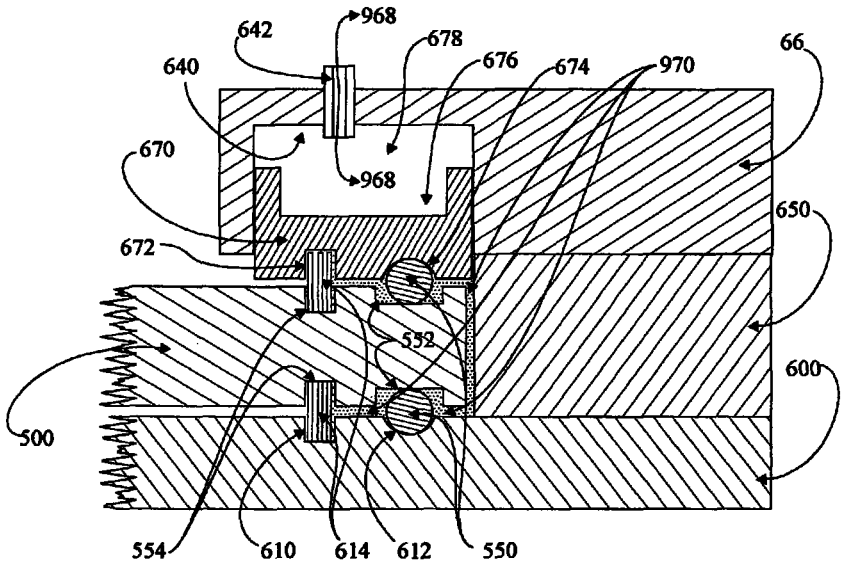

Each disk 500 is seated and sealed in relation to its associated cylinder block. FIGS. 12A and 12B provide detailed cross-sectional views of two possible alternative means for seating and sealing the rotating disk valve 500. In FIG. 12A, for example, expansion of the rotating disk valve during operation is small. The disk valve 500 is held in alignment, and at a spaced distance within a predefined tolerance, from the cylinder isolation grate 600 (seen in FIG. 4). The spaced alignment is provided by a circumferential array of support bearings 550 situated between curved support bearing grooves 552 journaled in the lateral rim of the rotating disk valve 500, and by opposed, curved support bearing grooves 652 in the internal wall of the rotating disk valve cradle 650. It is noted that concentric sealing rings 614 confine a lubricant 970 to the periphery of the disk valve 500. These concentric sealing rings 614 are retained within grooves in the rotating disk valve 554, the exhaust manifold 660, and the cylinder isolation grate 610. As shown in the drawing figure, a portion of the exhaust manifold 66 is opposed to the peripheral portion of the disk valve 500.

FIG. 12B shows a possible alternative exemplary configuration for compensating for substantial expansion of the rotating disk valve during operation. In this example, the support bearings 550 are located on each face of the rotating disk valve 500. Rather than occupying a defined space between the exhaust manifold 66 and cylinder isolation grate 600, the disk valve 500 rides on a disk valve seating plate 670. The disk valve seating plate 670 is housed within a recess 640 of the exhaust manifold 66 which, together with a complementary recess of the disk valve seating plate 676, forms a tight fitting compliance chamber 678 that is pressurized at a preset level by hydraulic fluid 968 through a control channel 642. Any changes in the thickness of the disk valve 500 will urge the disk valve seating plate 676 into the compliance chamber 678, thereby maintaining constant seating pressure on the disk valve against the cylinder isolation grate 600. Additionally, any lateral (radial) expansion of the disk valve 500 is accommodated by the flat floor of the disk valve's support bearing grooves 552.

FIGS. 12A and 12B both illustrate the use of helical, concentric sealing rings 614. Such rings 614 are depicted by way of illustration only; a number of suitable alternative sealing methods, such as "O" rings, are well-known in the art. Although no specific sealing method is specified hereby for the compliance chamber 678, a number of suitable alternatives are also known to those skilled in the art.

Figure 13A:
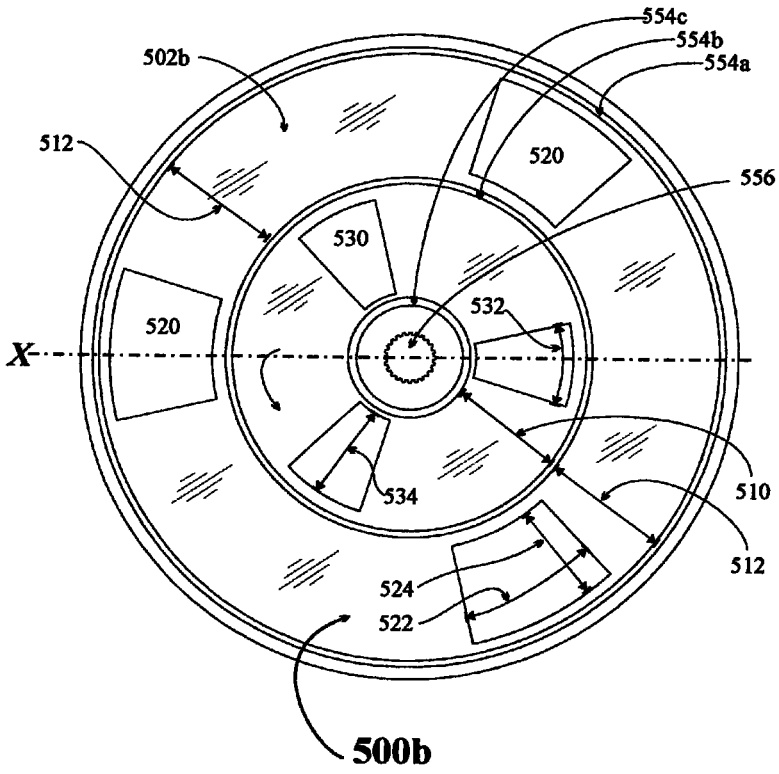
FIGS. 13A-13D depict a desirable alternative embodiment of the rotating disk valve according to the present disclosure, more specifically.

A possible alternative version of the disk valve 500*b* is shown in FIGS. 13A-D. FIGS. 13A-D are mostly analogous to FIGS. 11A-D, except that the disk valve apertures 520, 530 form beveled passages rather than the perpendicular channels illustrated in FIGS. 11A-D. FIG. 13A is an elevation of the manifold face 502*b*, FIG. 13B an elevation of the expander face 504*b*, FIG. 13C a cross section taken at line X of FIG. 13A, and FIG. 13D a side view of the rotating disk valve.

Figure 13B:
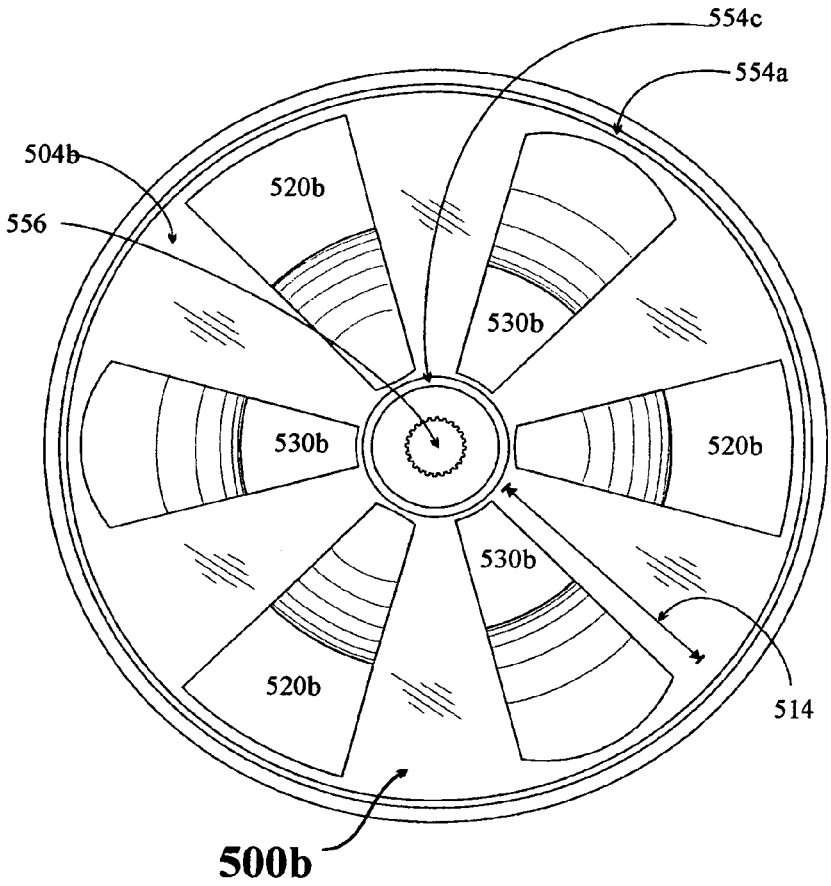
Figure 13C:
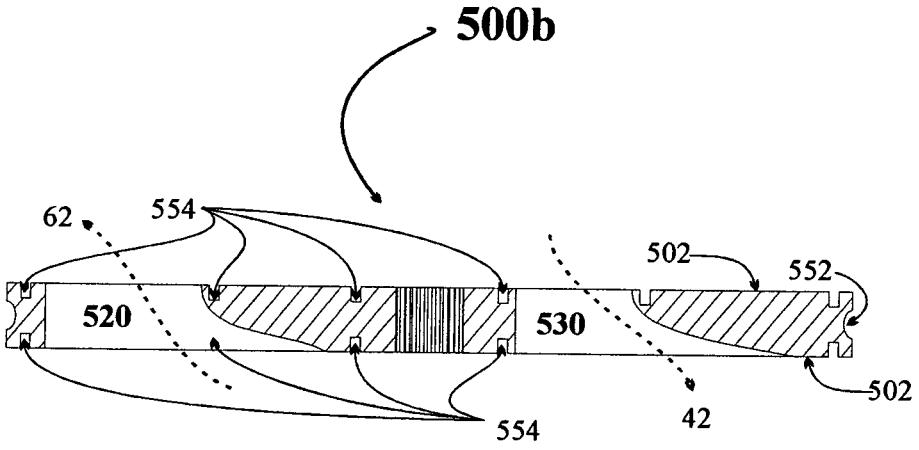
Figure 13D:
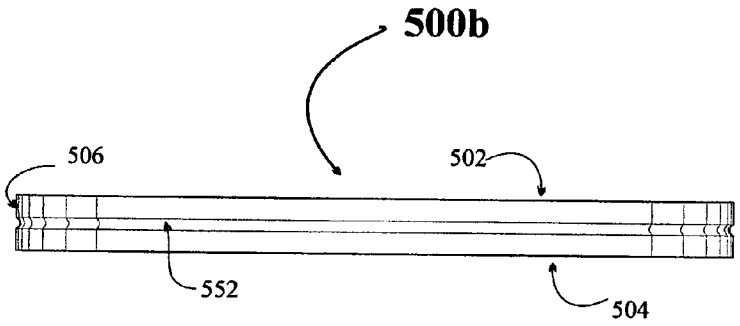

The exhaust and inlet apertures 520, 530 are restricted to their respective exhaust and inlet domains 512, 510 on the disk valve manifold face 502*a* only. Rather than forming perpendicular channels to corresponding exhaust and inlet domains of the expander face 504*b*, however, as best seen in FIG. 13C, the exhaust 520 and inlet 530 apertures form a beveled channel that expands to an aperture which leads to a common domain 514 on the expander face 504*b* (FIG. 13B). Although beveled apertures may complicate disk valve manufacture, this configuration offers at least two advantages: (1) it simplifies the structure of the internal cylinder isolation grates 600*a* and 600*b* (as more fully described below), and (2) it improves the distribution and flow of working gasses through the valve.

Figure 14A:
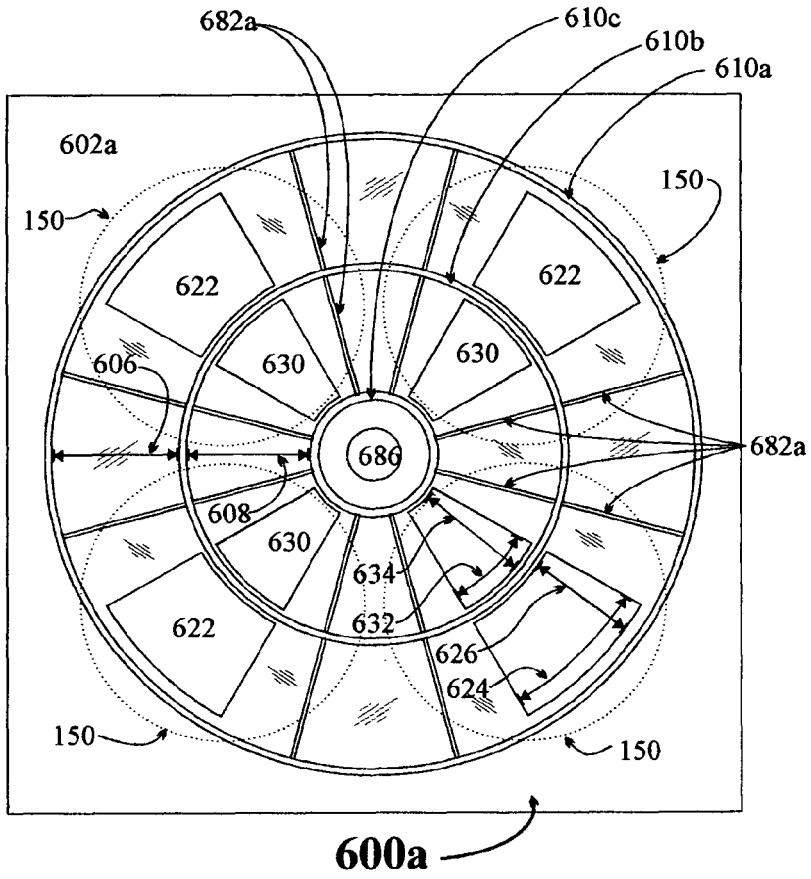
FIGS. 14A and 14B depict two alternative examples of possible embodiments of the internal cylinder isolation grate of an engine apparatus according to the present disclosure, more specifically.
Figure 14B:
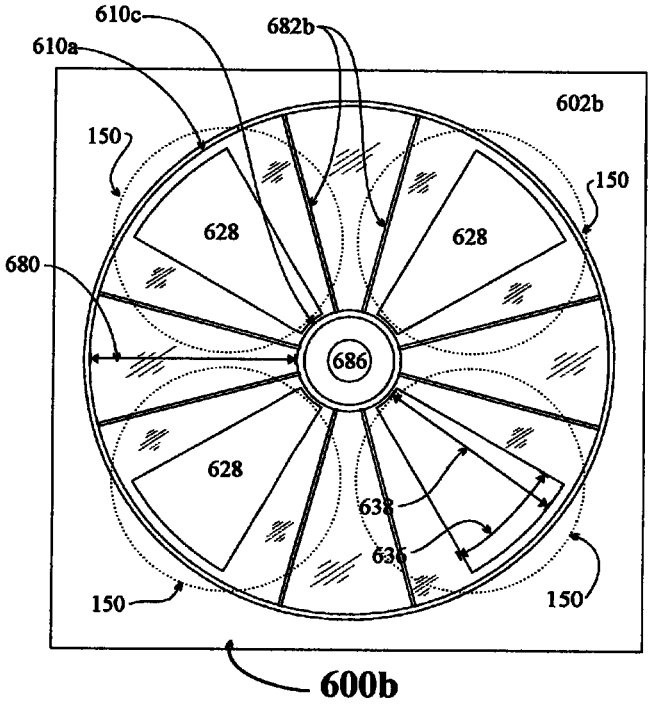

FIGS. 14A and 14B depict alternative possible embodiments of an internal cylinder isolation grate 600 (initially seen in FIG. 4) usable in the apparatus. FIG. 14A is an elevation of the disk valve face 602 of an isolation grate 600*a*, associated generally with the disk valve 500*a* shown in FIGS. 11A-D. (The separation of the inlet domain 510 from the exhaust domain 512 is maintained through the disk valve 500*a*, seen in FIGS. 13A-13D). FIG. 14B provides an elevation of the disk valve face 602 of an alternative isolation grate 600*b* associated with the alternative disk valve 500*b* seen in FIGS. 13A-D. Referring again to FIGS. 13A-D, the respective inlet 510 and exhaust 512 domains on the manifold face 502 of the disk valve 500*b* diverge to a common domain 680 (FIG. 14B) on the valve disk's expander face 504.

As depicted in FIG. 14A, at least four peripheral exhaust apertures 622 and at least four central inlet apertures 630 are symmetrically aligned, in isolation grate 600*a*, along radii spaced 90° apart, so that they are centered over their respective expansion chambers of the working cylinders 150 (shown by phantom lines in FIG. 14A). Noted by way of comparison, and with combined reference to FIGS. 11A-D, there are three inlet apertures 530 and three exhaust apertures 520 in a staggered arrangement on the disk valve 500*a* that correspond to the isolation grate 600*a* seen in FIG. 14A. The apertures 622, 630 present in FIG. 14A's isolation grate 600*a* have the same angular widths 624, 632 and radial lengths 626, 634 as their corresponding apertures of the rotating disk valve 500*a*. Likewise, the concentric sealing grooves 610*a*, 610*b*, and 610*c* correspond to, and cooperate with, the concentric sealing grooves 554*a,b*, and *c* of the disk valve 500*a* seen in FIGS. 11A-D to retain and seat the concentric sealing rings 614 (not shown in FIG. 14A). Exhaust and inlet domains 606, 608, thus are defined on isolation grate 600*a*.

During operation, the disclosed parallel cycle engine establishes and maintains three distinct environments for the motive fluid: i) a constant high-temperature, high-pressure domain for inlet gasses, ii) a constant lower-temperature, lower-temperature domain for exhaust gasses, and iii) a cyclic, dynamic domain where intake gasses expand to become exhaust gasses. The utility of the disclosed parallel cycle engine is, in large part, predicated on the maintenance of physical and functional boundaries between these three domains as the motive fluid passes from the inlet manifold 460, through the expansion chambers 64, into the exhaust manifold 66.

Physical isolation of inlet and exhaust gasses is assured by the structural separation of the distinct inlet 460 and exhaust 66 manifolds. Physical isolation of the motive fluid during expansion is assured by the structural separation of the distinct working cylinders 150. Functional isolation of inlet and exhaust gasses at the interface between manifolds and cylinders is achieved by the dynamic boundaries established by the rotating disk valve 500 cooperating with the fixed cylinder isolation grate 600. The rotating disk valve 500 allows transitions from the constant, central, annular inlet 460 manifold to the cyclically variable, radially disposed expansion chambers 64, and back again to the constant, peripheral, annular exhaust manifold 66.

During operation, appropriate boundaries and connections are inherent in the configuration of apertures within the rotating disk valve 500 and associated cylinder isolation grate 600 when properly coordinated with piston 76 movement. The boundaries restrict high-pressure working gas (inlet) from escaping into low-pressure (exhaust) environments. It should be noted that the design of the disclosed parallel cycle engine limits adverse effects of commingling of working gases when compared to a conventional four-stroke engine. In the disclosed parallel cycle engine, the only important difference between intake and exhaust gas is pressure. This is contrasted with conventional four-stroke engines where the working gas, in addition to different pressures, also assumes very important and distinct compositional characteristics: fresh air charge, an air-fuel mixture, and products of combustion. Further, the disclosed parallel cycle engine operates with zero clearance cylinder volume. This is contrasted with conventional engines that have a specific, non-zero clearance volume that is unavoidably associated with significant commingling of working gas components.

General and collective reference may be made to FIG. 11A through FIG. 14B. The interface between the rotating disk valve 500 and the cylinder isolation grate 600 is designed to maintain flat surfaces at tight tolerance, thus limiting the escape of high-pressure gasses. It is anticipated that certain applications will require supplemental sealing systems. Should supplemental sealing become necessary, two general seal configurations are disclosed to prevent the commingling of: i) inlet and exhaust gasses, and ii) between-cylinder expansion products. The first is achieved by three concentric, circular boundaries established at the manifold-rotating disk valve interface, and the second, by four linear, radial boundaries established at the rotating disk valve-isolation grate interface.

It is recognized that several sealing methods exist for establishing said boundaries. In one embodiment, illustrated in FIG. 12A, the opposed concentric sealing grooves of the rotating disk valve 554 and cylinder isolation grate 610 cooperate to house a circular helical spring device 614. Pressure gradients generated during operation urge the helical spring 614 against the walls of the concentric sealing grooves (554 and 610) to provide the functional seal while presenting minimal surface area for friction and wear. In addition, the helical nature of the spring 614 maintains contact with both disk valve and isolation grate concentric sealing grooves (554 and 610), despite variations in the tolerance space that might develop during operation.

A deformable wiper blade (not depicted) is inserted within the radial grooves 682 of the cylinder isolation grate 600. Again this will maintain a "between-cylinder" seal, while minimizing surface area for friction and wear. The deformable nature provides contact despite variations in the tolerance space that might develop during operation.

For illustrative purposes, two alternative rotating disk valve aperture configurations are depicted to highlight possible variations of the sealing system (500*a* and 500*b*). The first disk valve variation 500*a* maintains the concentric, circular manifold boundaries through the rotating disk valve and onto the cylinder isolation grate. The second variation 500*b* transforms the concentric, circular manifold boundaries of the rotating disk valve's manifold face 504*b* into alternating, radial cylinder boundaries of the rotating disk valve's expander face 504*b*. The second variation, therefore, requires no circular boundaries on the cylinder isolation grate.

FIG. 11A and FIG. 13A depict the manifold faces 502*a,b* in the two illustrative variations of the rotating disk valve 500*a, b*. It is evident that the manifold faces 502*a,b* are identical. An inner annular region is defined between the inner 554*c* and middle 554*b* concentric sealing grooves: the inlet domain 510. It contains the rotating disk valve's inlet apertures 530. A peripheral annular region is defined between the middle 554*b* and outer 554*a* concentric sealing grooves: the exhaust domain 512. It contains the rotating disk valve's exhaust apertures 520.

FIG. 11B and FIG. 13B depict the expander faces 504*a* and 504*b* of the two illustrative variations of the disk valve 500*a* and 500*b*. It is evident that the expander face 504*a* depicted in FIG. 11B is the mirror image of the manifold face 502*a* illustrated in FIG. 11A. Each exhaust 520 and inlet 530 aperture form perpendicular tunnels through the rotating disk valve 500*a* as illustrated in FIG. 11C. Concentric internal intake 510 and peripheral exhaust 512 are retained through the rotating disk valve 500*a*.

The second illustrative rotating disk valve variation 500*b*, as seen in FIGS. 13B and 13C, allows the apertures to expand to a larger area on the expander face of the rotating disk valve 500*b* by tunneling through the valve in a trumpet shape. The trumpet shape provides gas flow characteristics that may be important in specific applications. In this example, the concentric inlet 510 and outlet 512 domains of the manifold face 502 are transformed into alternating radial inlet 530*b* and exhaust 520*b* apertures on the expander face 504*b*. Therefore, there is no need for concentric sealing grooves 554.

The expander faces 502*a* and 502*b* of the two illustrative example variations of the rotating disk valve 500*a,b* depicted in FIG. 11B and FIG. 13B, mate with their respective cylinder isolation grates 600*a* and 600*b* as depicted in FIGS. 14A and 14B. In the first example 600*a*, concentric annular inlet 510 and exhaust 512 domains were maintained through the rotating disk valve 500*a*. As can be seen in FIG. 14A concentric, annular inlet 608 and exhaust 606 domains are maintained by the three concentric sealing groves 610 found in the cylinder isolation grate 600*a*. In the second valve example 500*b*, because concentric annular inlet 510 and outlet 512 domains were transformed into alternating intake 530*b* and outlet 520*b* radial apertures, the middle sealing groove 610*b* is not necessary in this cylinder isolation grate 600*b* as is depicted in FIG. 14B. The internal 610*c* and peripheral 610*a* sealing grooves are required to contain working gasses within the engine.

In both examples 600*a* and 600*b*, however, the cylinder isolation grate must maintain boundaries between the cylinders. In the illustrative examples depicted in FIGS. 14A and 14B, boundaries are established radially by disposed grooves 682 located between the working cylinders 150. Two such grooves 682, spaced wider than the aperture widths (522, 532, 636, 624 and 632) of the rotating disk valve 500*a,b* and cylinder isolation grate 600*a,b*, prevents between-cylinder tunneling of gasses as the rotating disk valve aperture passes from one cylinder to another. Again, these are unnecessary if particularly tight tolerances and very flat surfaces are provided between the rotating disk valve 500 and the cylinder isolation grate 600.

Figure 15A:
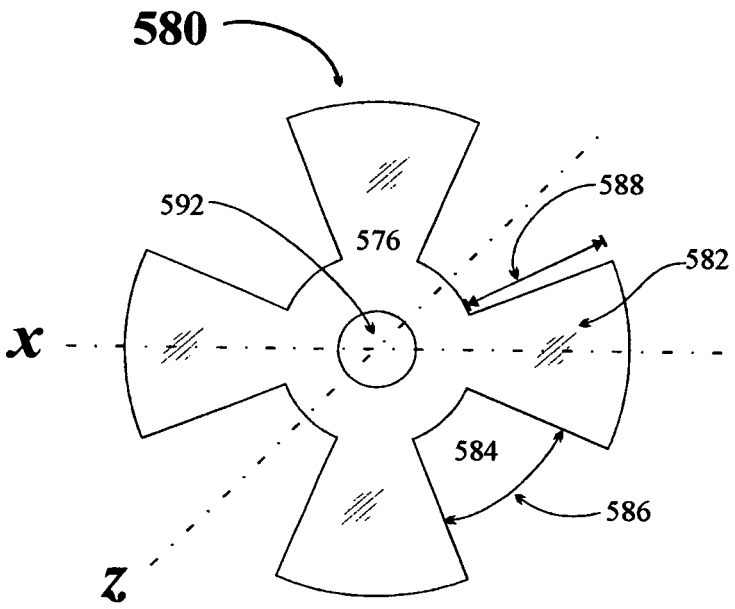
FIG. 15A is an elevation view of the expander face of an inlet control damper component usable in an engine apparatus according to the present disclosure.
Figure 15B:
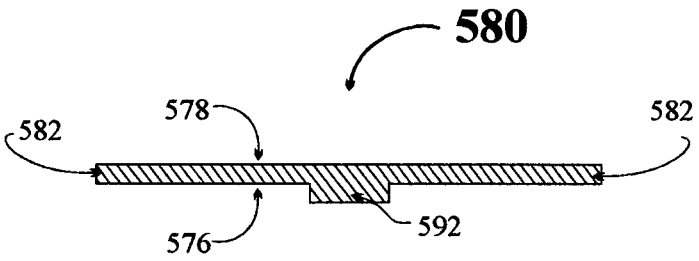
FIG. 15 B is a cross-sectional view of the inlet control damper, taken at section line "x" of FIG. 15A.
FIG. 15C is a cross-sectional view of the inlet control damper, taken at section line "z" of FIG. 15A.
FIG. 15D is an elevation view of the expander face of an inlet isolation grate component usable in an engine apparatus according to the present disclosure.
FIG. 15E is a cross-sectional view of the isolation grate, taken at section line "x" of FIG. 15D.
FIG. 15F depicts the inlet control damper seen in FIG. 15B, as mounted on the isolation grate seen in FIG. 15E.
Figure 15C:
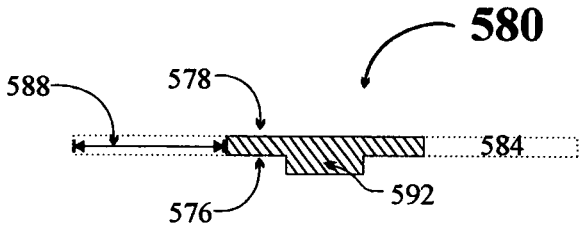
Figure 15D:
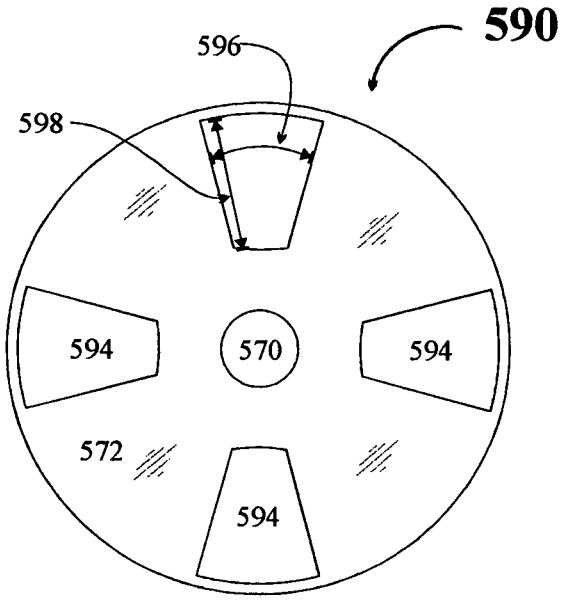
Figure 15E:
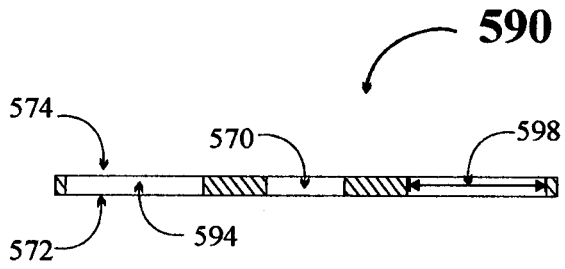
Figure 15F:
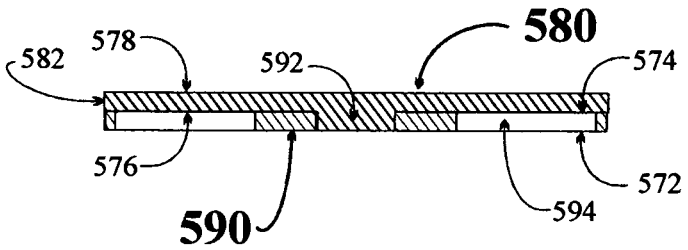

Attention is turned to FIGS. 15A-15F, which depict the inlet control damper 580 and the inlet isolation grate 590 originally seen in FIG. 4. FIG. 15A is an elevation of the inlet control damper 580, viewing the expander face 576 thereof. FIG. 15B is a section of the damper 580 through section plane x in FIG. 15A, and FIG. 15C is a section through plane z. FIG. 15D is an elevation of the inlet isolation grate 590 viewing the expander face 572. FIG. 15E is a section of the grate 590 through plane x of FIG. 15D. Finally, FIG. 15F is a sectional view of the damper 580 mounted on the grate 590 through the imaginary plane x.

Rotation of the inlet control damper 580 about the axle 592 causes the damper flanges 582 alternately to occlude or expose the apertures 594 of the inlet isolation grate 590. The apertures 594 in the inlet isolation grate 590 have angular widths, labeled 596, and radial lengths 598, that are substantially equal to the inlet apertures 530 of the rotating disk valve 500 and the inlet apertures 630 of the cylinder isolation grate 600. Progressive occlusion of the apertures 594 of the isolation grate 590 by the flanges 582 of the damper 580 tends to decrease the time during which motive fluid may enter the expansion chamber, as suggested with additional reference to FIG. 17 and FIG. 18.

In the example illustrated in FIGS. 15D-F, the inlet isolation grate 590 appears as a distinct element. Alternative configurations are within the scope of the apparatus. Certain applications, for example, may dictate that the inlet isolation grate be incorporated into the floor of the inlet manifold. Further, there may be applications where the damper 580 is juxtaposed to the expander surface 572 of the grate 590, rather than the manifold face 574 as depicted in FIG. 15F.

It is noted that although the engine could function without the inlet isolation grate, complete isolation between the combustion chamber and expanders during idle periods would be less complete. Isolation, of course, is preferred.

Figure 16:
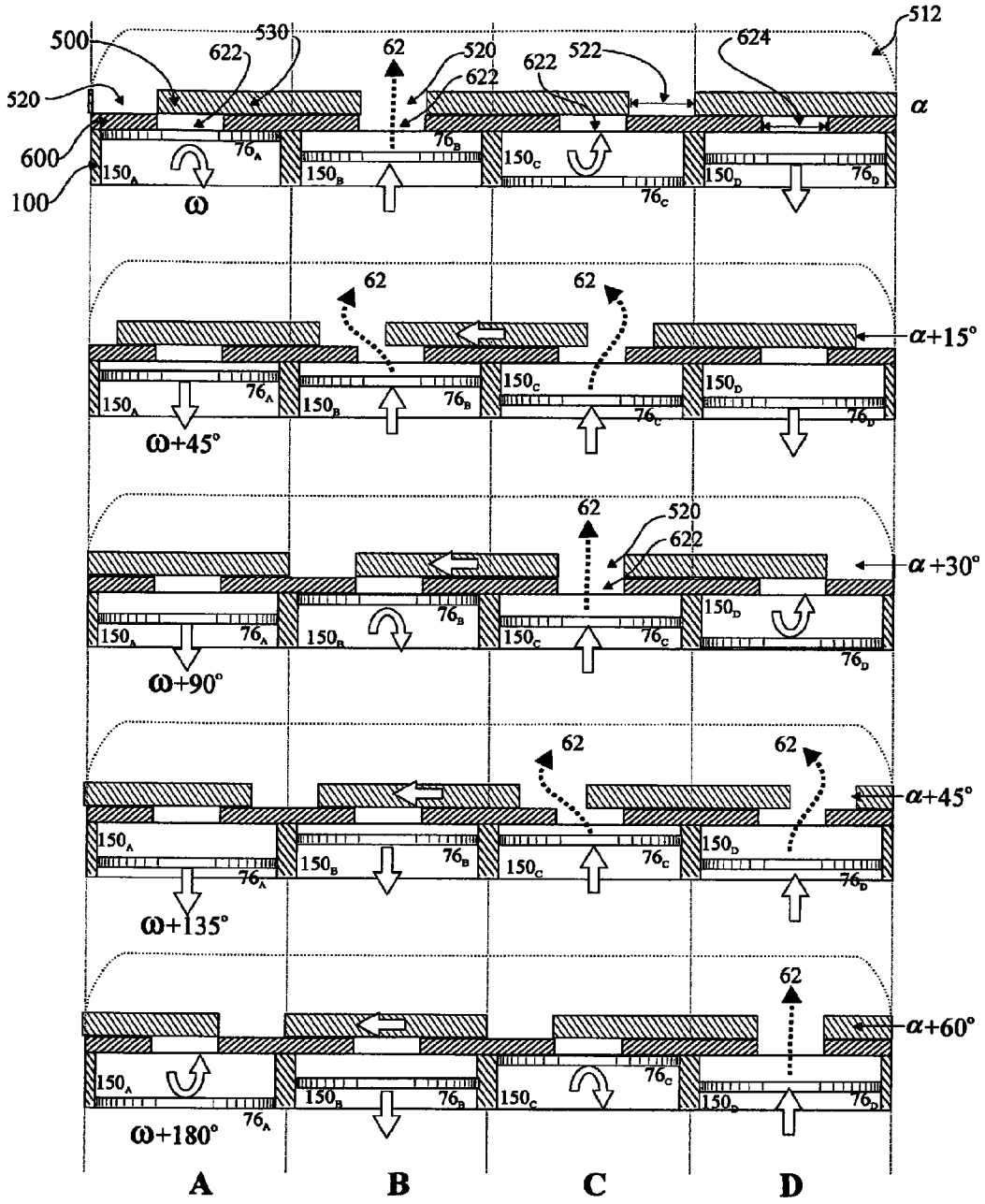
FIG. 16 is a sequence of 360-degree, panoramic, graphical representations of a circular cross-section taken through a mid portion of the exhaust domain of an engine apparatus according to the present disclosure; the representations are to be viewed beginning at the top of the Figures, and progressing downward as the main crank shaft of the apparatus rotates through 180 degrees in 45-degree increments (ω)

FIG. 16 provides a sequence of 360-degree panoramic representations of a cylindrical cross section taken concentrically through an intermediate portion of the exhaust domain 512 (e.g., FIG. 13A) as the main crank shaft rotates through 180° in 45° increments (ω). Reference to FIG. 16 teaches the coordination of the rotating disk valve 500 and piston head movement $\mathbf{76}_{A\text{-}D}$. The respective cylinder domains are designated A-D in labels at the bottom of the figure.

In the panoramic view, the four exhaust apertures 622 of the cylinder grate 600 are depicted linearly, rather than radially. The angular aperture width, labeled as 624 in FIG. 16, of the cylinder isolation grate 600 is 30° in this illustrative example. The three exhaust apertures 520 of the rotating disk valve 500 also appear in a linear orientation. The angular aperture width 522 of the rotating disk valve 500 is also 30°.

The sequence is initiated in the top illustration at a crankshaft angle of w and a rotating disk valve angle of α. The disk valve 500 rotates at one-third the rotation rate of the crank shaft (i.e., shaft 702) in this illustrative example. In the subsequent illustrations (proceeding down the page in FIG. 16), the crank shaft angle, ω, advances in 45° increments and the disk valve angle, α, advances in 15-degree increments. The piston head $\mathbf{76}_A$ in cylinder 150 "A" undergoes a full expansion (power) stroke while the piston head $\mathbf{76}_C$ in cylinder "C" undergoes an exhaust stroke. The piston head $\mathbf{76}_B$ in cylinder "B" undergoes the last half of the exhaust, then first half of the power, while the piston head $\mathbf{76}_D$ in cylinder "D" completes the last half of power then the first half of exhaust. In FIG. 16, the extent of axial piston head excursion has been significantly abbreviated for facility of illustration. The apertures 630 for inlet of motive fluid are not shown in this cylindrical plane (see FIG. 17).

Focusing attention on cylinder "C", in the topmost panel of FIG. 16, the piston head $\mathbf{76}_C$ is at bottom dead center poised to initiate the exhaust stroke. The exhaust aperture 520 of the rotating disk valve 500 has not quite come into registration with the exhaust aperture 622 of the cylinder isolation grate 600. In the next panel, the disk valve has rotated α+15°, establishing continuity between the exhaust domain 512 and the expansion chamber portion of cylinder C (150C) allowing egress of exhaust gas 62. The crankshaft advances ω+45° and the piston head $76_C$ has passed through about 25% of the exhaust stroke.

In the third panel, the disk valve 500 rotates another 15° (α+30°), bringing the exhaust apertures 520, 622 of the disk valve 500 and isolation grate 600 into registration. The crankshaft advances ω+90° and the piston head $76_C$ has passed through approximately 50% of the exhaust stroke.

In the next panel, and with continued reference to cylinder $150_C$, disk valve rotates another 15° (α+45°), bringing the trailing edge of exhaust aperture 520 of the disk valve 500 to the mid portion of the exhaust aperture 622 of the isolation grate 600. The crankshaft continues to advances ω+135° and the piston head $76_C$ has passed through about 75% of the exhaust stroke.

In the fifth, bottom panel, the disk valve rotates another 15° (α+60°), ending the registration of the exhaust apertures 520, 622 of the disk valve and isolation grate relative to cylinder "C". The crankshaft advances to ω+180° and the piston head $76_C$ has passed through top dead center, completing the power stroke. As evident from the figure, similar events are taking place in the other three cylinders 150, but each cylinder is 90° out of phase with the adjacent cylinder.

Figure 17:
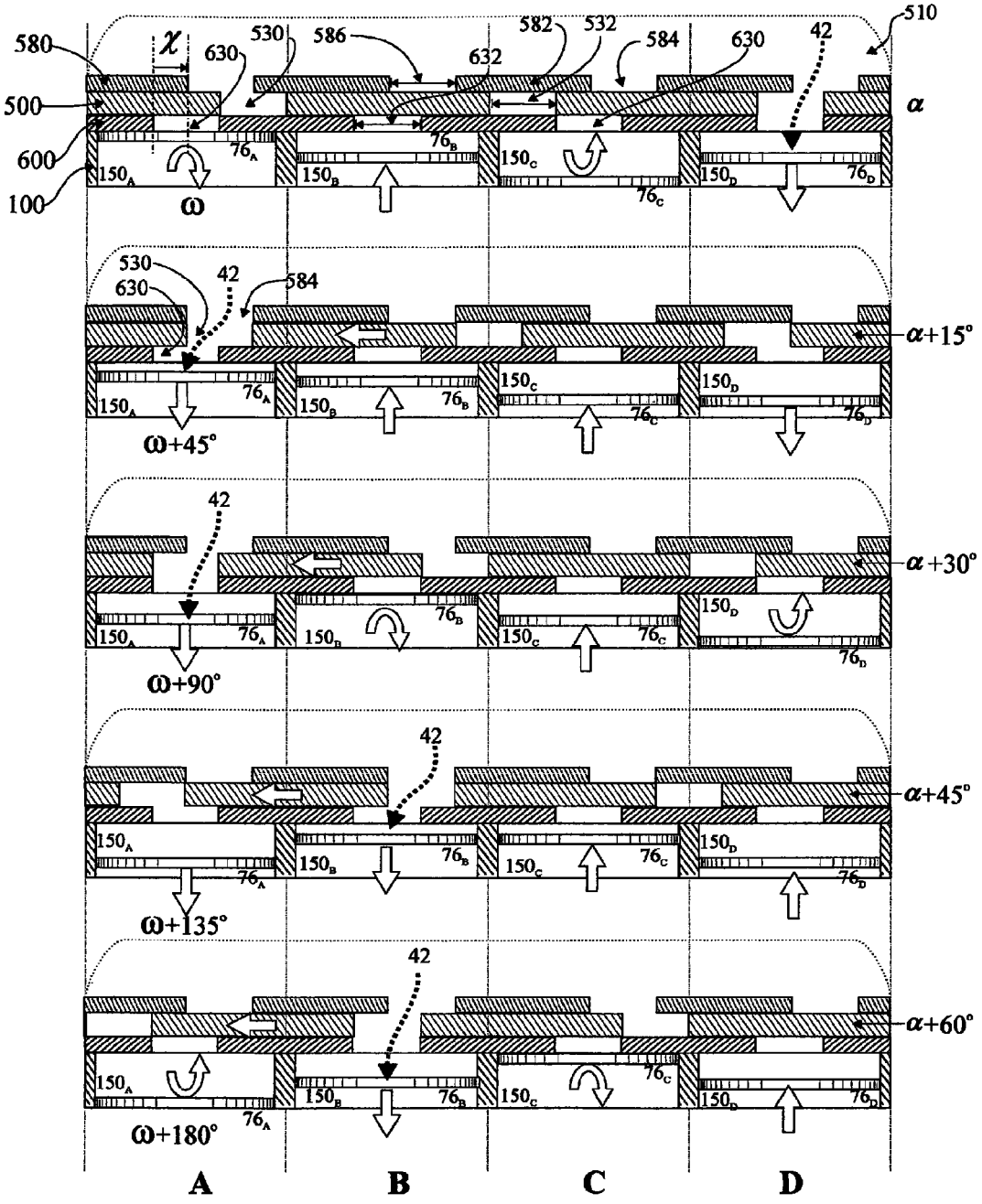
FIG. 17 depicts a sequence of 360-degree, panoramic, graphical representations of a circular cross-section taken through the mid portion of the inlet domain of an engine apparatus according to the present disclosure; the representations are to be viewed beginning at the top of the figure, and progressing downward as the main crank shaft of the apparatus rotates through 180 degrees in 45-degree increments (ω)

FIG. 17, a graphical expression similar to FIG. 16, depicts a sequence of 360-degree panoramic representations of a cylindrical section through a mid portion of the inlet domain 510 (per FIGS. 11A-B) as the main crank shaft 702 rotates through 180° in 45° increments (ω). Thus FIG. 17 likewise demonstrates the coordination of the rotating disk valve 500 and piston head movement $76_{A\text{-}D}$. FIG. 17 also illustrates the cooperation of the rotating disk valve 500 with the internal cylinder isolation grate 600 and the inlet control damper 580.

In FIG. 17, the four inlet apertures 630 of the cylinder grate 600 are in a linear, rather than radial, orientation. The angular inlet aperture width 632 of the cylinder isolation grate 600 is 30° in this illustrative example. In this panoramic view, the three inlet apertures 530 in the rotating disk valve 500 also appear in a linear orientation. The angular inlet aperture width 532 of the rotating disk valve 500 also is 30°. Likewise, the four inlet apertures 584 of the inlet control damper 580 appear in a linear orientation with an angular aperture width 586 of 30°, and a flange 582 angular width of 60°.

The sequence is initiated in the top panel of FIG. 17 at a crankshaft angle of ω and a rotating disk valve angle of α. The disk valve 500 rotates at one-third the rate of the crank shaft (i.e. 702) in this illustrative example. In the subsequent illustrations, proceeding downward, the crank shaft advances, ω, in 45° increments and the disk valve, α, advances in 15° increments. The piston head $76_A$ in cylinder 150 "A" undergoes a full expansion (power) stroke while the piston head $76_C$ in cylinder "C" undergoes an exhaust stroke. The piston head $76_B$ in cylinder "B" undergoes the last half of the exhaust, then first half of the power, while the piston head $76_D$ in cylinder "D" completes the last half of power then the first half of exhaust. The axial extent of piston head excursion has been significantly reduced in FIG. 17 to facilitate graphical display. The apertures 520 for exhaust are not seen in this cylindrical plane of FIG. 17, but are seen in FIG. 16.

The inlet control damper 580 has been advanced 15° to demonstrate its effect on intake. During maximum power, the apertures 584 of the control damper 580 are in registration with the inlet apertures 630 of the internal cylinder isolation grate 600. To stop the engine, the flanges 582 of the control damper 580 are positioned directly over the inlet apertures 630 of the internal cylinder isolation grate 600. Modulation of the control damper 580 position allows control of expansion functions. Notably, as the control damper closes, termination of the ingress of motive fluid 42 occurs sooner, rather initiating ingress later.

Focusing attention on cylinder "A", in the top panel, the piston head $76_A$ is at top dead center poised to initiate the expansion stroke. The inlet aperture 530 of the rotating disk valve 500 has not come into register with the inlet aperture 630 of the cylinder isolation grate 600. In the next panel, the disk valve 500 has rotated α+15°, establishing continuity between the inlet domain 510 and the expansion chamber portion of cylinder A (150A), allowing passage of the motive fluid 42. The crankshaft advances ω+45° and the piston head $76_A$ has passed through about 25% of the power stroke.

In the third panel, the disk valve rotates another 15° (α+30°), to register the inlet aperture 530 of the disk valve 500 with the inlet aperture 630 in the isolation grate 600. The crankshaft advances ω+90° and the piston head $76_A$ has passed through approximately 50% of its power stroke.

In the next, fourth panel, the disk valve 500 rotates another 15° (α+45°), bringing the inlet apertures aperture 530 of the disk valve to the edge of the closing flange 582 of the control damper 580, thus terminating entry of motive fluid into the cylinder 150A. The crankshaft advances ω+135° and the piston head $76_A$ has passed through about 75% of the power stroke as the expansion stroke continues.

In the fifth, bottom panel, the disk valve rotates another 15° (α+60°), ending the registration of the apertures inlet aperture 530 of the disk valve and that aperture 630 of the isolation grate 600. Although prior to this instant there was some degree of overlap between the respective inlet apertures of the disk valve and isolation grate, the control damper 580 had already prevented further ingress of motive fluid into the cylinder 150A. The crankshaft advances to ω+180° and the piston head $76_A$ has passed through bottom dead center, completing the power stroke. Again, similar events are taking place in the other three cylinders 150, but each is 90° out of phase with the adjacent cylinder.

Figure 18:
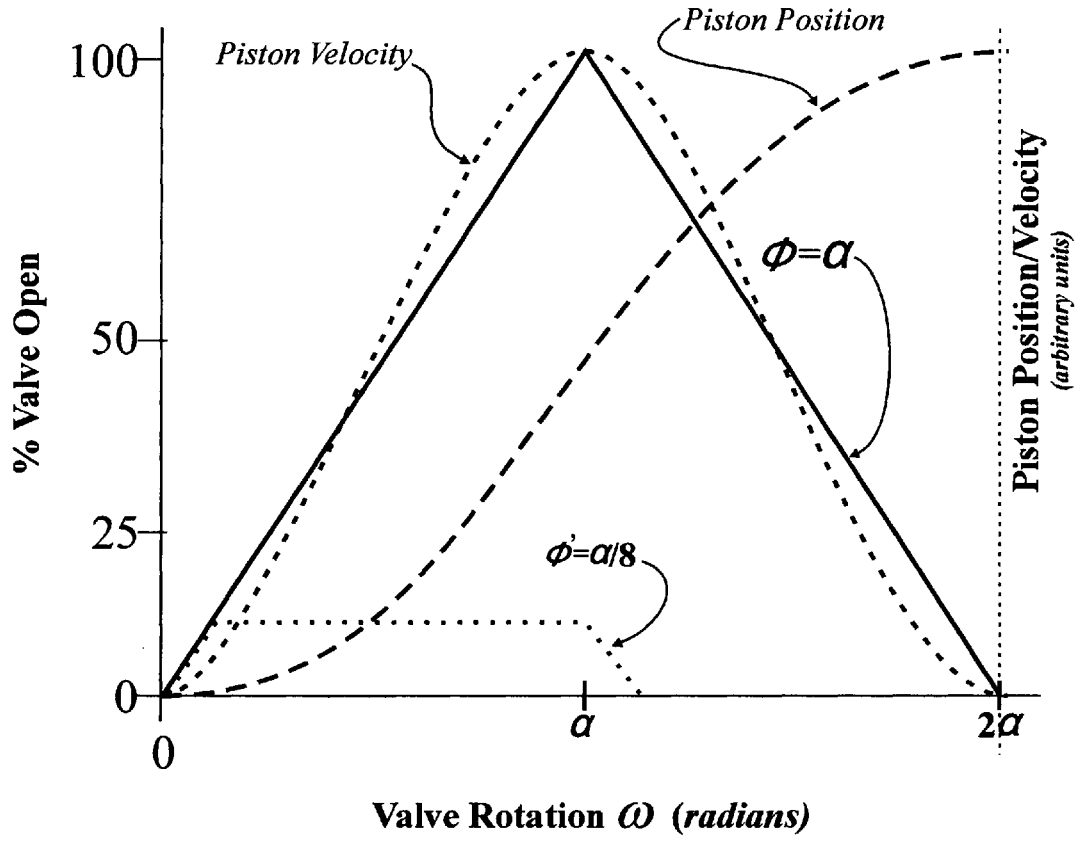
FIG. 18 is a graph of the area of the disk valve aperture as a function of valve rotation (ω)

A representation of the non-occluded, open area of the disk valve aperture as a function of valve rotation (ω) is presented in FIG. 18. The piston position and velocity (shown by dashed lines) are displayed to assist in the visualization of timing. As an illustrative example, let the angular width 522 of the rotating disk valve exhaust aperture 520 be represented by constant α. The angular width 624 of the cylinder isolation grate exhaust aperture 622 is a constant ϕ. Let the case be that the angular widths 522 624 of the valve and grate exhaust apertures are equal α=ϕ. Then let ω=0 when the piston head is at bottom dead center, and the exhaust aperture 520 of the rotating disk valve 500 and the exhaust aperture 622 of the cylinder isolation grate 600 are positioned to begin to align (i.e., open). As the disk valve rotates from ω=0 to ω=α, the disk valve exhaust aperture 520 comes into complete registration (eclipses) with the isolation grate exhaust aperture 622, providing the maximal functional opening for egress of the exhaust gasses from the working cylinder, through the disk valve aperture, and into the exhaust manifold. It should be noted that the maximal functional opening occurs when piston velocity is maximal. As the disk valve rotates from ω=α to ω=2α, the disk valve exhaust aperture 520 ceases its registration with the isolation grate exhaust aperture 622, completing valve closure when the piston is at top-dead center. It follows that the rotational velocity of the disk valve 500 must be such that 2α radians of disk valve rotation corresponds to 180° (it radians) of crank shaft rotation. In the illustrative example, the angular width α of the disk valve apertures is 30°. Since the disk valve must rotate 30°×2 for every 180° of crankshaft rotation, the angular velocity of the disk valve must be ⅓ of the rotational speed of the crank shaft.

The same principles apply to the inlet apertures 530, 630 of the rotating disk valve 500 and cylinder isolation grates 600, except that, in order to regulate inlet flow, the functional grate aperture width ϕ' is varied by the control damper 580 cooperating with the damper isolation grate 590. The dotted line in FIG. 18 indicates how the reduction in ϕ' reduces the functional cross sectional inlet area of the valve.

As a person skilled in the art will appreciate, conventional four-stroke engines typically employ multiple reciprocating poppet valves per cylinder. Reciprocating poppet valves occupy significant space, require complex timing and actuating mechanisms, and produce unwanted vibration and noise. Prior art has suggested several alternatives to such conventional valves, including rotating valves. Prior art recognizes that rotating valves are smoother, simpler, and more efficient than their reciprocating poppet counterparts. A number of tubes, cones, drums, disks and spheres have been disclosed during the past century, but none have successfully replaced poppet valves in conventional four-stroke engines. Although the concept is appealing, difficulties with sealing (isolation), control, wear and balance have prevented their general implementation in conventional engines. Some of these difficulties, peculiar to four-stroke applications, are obviated when applied to Brayton cycle engines.

Because the basic thermodynamic events of conventional engines occur rapidly within the same chamber, effective cylinder isolation becomes more challenging. In conventional engines valves must not only isolate different pressures, the different chemical composition of chamber contents must also remain distinct (fresh air, air fuel mixture, and combustion products). Finally, conventional engines require the development of significant cyclic temperature variations within the cylinder. Because of the complexity of conventional thermodynamic cycles, each cylinder must have its own separate valve mechanism in order to achieve "between cylinders" isolation.

Coordination of valve action with ignition requires complex timing mechanisms. Prior attempts to add some level of variable control to valve action is accompanied by significant additional complexity. Finally, conventional spring-loaded poppet valves have limitations on their speed of operation, and can "float" in a semi-open/closed position at high rpm. This problem is addressed in certain high performance applications (racing cars) by adding further complex devices to accelerate valve motion.

Such problems are significantly reduced or eliminated in the parallel cycle engine 10 because the only thermodynamically important difference in the expansion chamber contents is pressure. There is no possibility of commingling intake and exhaust gasses. In addition, since the expansion chamber only performs two symmetric strokes (expansion and exhaust), the opportunity for significant reduction in valve complexity exists.

Consequently, the parallel cycle internal combustion engine 10 and its unique, simple, smooth, direct drive, multi-function, rotating disk valves 60 replace traditional reciprocating valve mechanisms such as the drive, cam, rocker arm, valves, and electric ignition system. This simplicity can then be multiplied because a single, common rotating valve can serve intake and exhaust functions of multiple cylinders. A direct drive, smoothly rotating, balanced valve eliminates or at least substantially reduces engine vibration caused by traditional reciprocating poppet valve mechanisms. Finally, engine speed will be limited only by working gas flow because a rotating valve cannot "float."

Figure 19A:
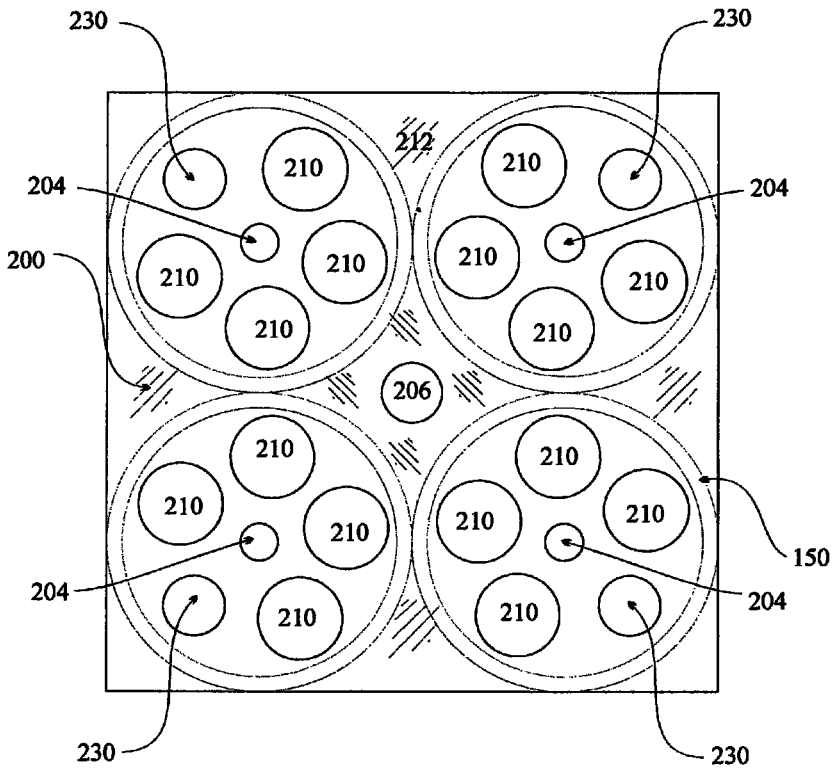
FIG. 19A is an elevation view of the internal, crankcase face of a compressor head usable in an engine apparatus according to the present disclosure.
Figure 19B:
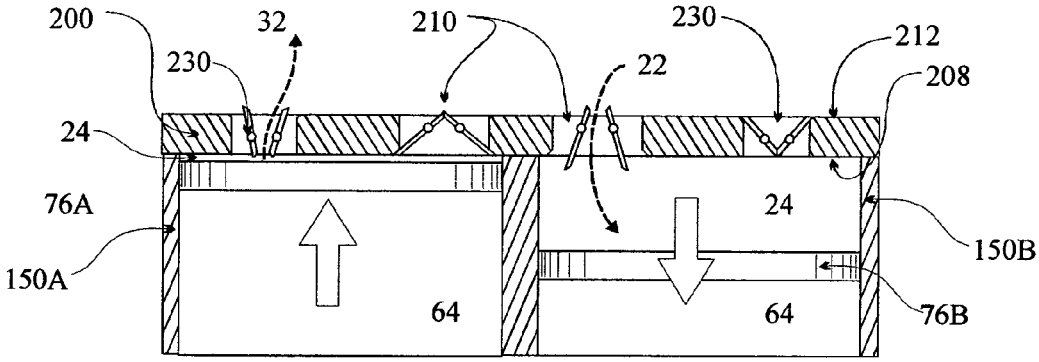
FIG. 19B is sectional view, through a stylized plane, depicting the relationship of the compressor head seen in FIG. 19A to the working cylinders.

FIGS. 19A and 19B depict the compressor head 200, which also forms the cylinder base. FIG. 19A is an elevation of the internal, crankcase face 212 of the compressor head, while FIG. 19B is section through a stylized plane depicting the relationship of the compressor head 200 to the working cylinders 150.

FIG. 19A shows that the compressor head abuts and closes the internal, crank-case end of the four working cylinders 150, the locations of which is indicated in phantom. The connecting rod of the pistons 76 contained in each of the four working cylinders 150 slidably passes through the compressor head 200 (cylinder base) through one of the four tight-fitting connecting rod apertures 204. Likewise, the drive shaft for the rotating disk valve passes through a single drive shaft aperture 206 in the compressor head 200.

The regions of the compressor head 200 contained within the cylindrical axial extensions of the working cylinders 150 contains apertures associated with inlets 210 for fresh air 22, and outlets 230 for compressed air 32 valves. Those skilled in the art acknowledge the existence of a variety of valve configurations for compressors. Consideration is given to the performance characteristics of the valves and the demands of the compressor when defining which configurations to use.

Because fluid flow is fundamentally defined by pressure gradients that are established between the compression chamber and the intake (fresh air) and outlet (compressed air) domains, the valves can be simple pressure activated one-way valves (i.e., check valves), rather than the more complex mechanically timed/activated valves commonly found in contemporary four-stroke engines. Respecting the valves, the volume flow of air must be considered: the volume of fresh intake air passing through the intake valves is significantly larger than the volume of compressed air passing through the outlet valves.

FIG. 19A thus depicts the internal, crank-case face 212 of the compressor head 200. Each cylinder subtends four apertures for pressure activated, one-way intake valves 210 and one pressure activated, one-way outlet valve 230. This arrangement is provided as an illustrative example of one preferred embodiment. Another illustrative example is offered hereinafter. Of course, the present disclosure does not exclude other obvious variations in type, number, size and shape of the intake valves 210 and outlet valves 230.

Referring to FIG. 19B, the one-way pressure-sensitive intake valves 210 and outlet valves 230 are depicted as low-profile butterfly pivot valves. In working cylinder 150A, the piston head 76A is completing compression and compressed air 32 is passing out through the outlet valve 230. The intake valve 210 of cylinder 150A is closed. The piston head 76B in working cylinder 150B is on the intake stroke, drawing fresh air 22 into the compression chamber 24 portion of the working cylinder 150B through the open intake valve 210. The outlet valve 230 of cylinder 150B is closed.

The clearance volume depicted in working cylinder 150A as vanishing to substantially zero is a key element. It should also be noted that the expansion chamber 64 portion of the working cylinders 150 is found opposite the compression chamber 24 in each of the working cylinders 150. When the piston head 76 has completed expansion relative to expansion chamber 64 of a working cylinder 150, it has simultaneously completed compression relative to the compression chamber 24. This causes some ambiguity with certain common terms because when the same piston head 76 is at "bottom-dead-center" relative to expansion (power), it is also at "top-dead-center" relative to compression. It is also remembered that the compressor "head" 200 also functions as the cylinder "base."

As noted earlier, conventional four-stroke engines perform a thermodynamic cycle in a common arena separated only by time. Superficially, this appeared to represent the most economical use of space. Because conventional engines must rapidly create, eliminate, and recreate distinct thermodynamic environments within the common area, additional devices are required to facilitate these transitions. These devices include valves, manifolds, cams, and cooling, timing and ignition systems. One of the most critical and useful of the innovations disclosed in the disclosed parallel cycle engine 10, is the dual function cylinder. Integration of expansion 64 and compression 24 into each working cylinder 150 is a major advantage because it eliminates a major disadvantage of Brayton cycle engines: a physically separate compressor. Integrated dual function working cylinders, as compared to conventional engines, is an even more economical use of space, because, given identical bore and stroke, dual function cylinders double the power stroke frequency. Given the same crankshaft rpm, sixteen conventional engine working cylinders would be required to match the power output of the eight working cylinders 150 of the disclosed parallel cycle engine 10. The simplification of the valve requirements, allow the disclosed engine 10 to coalesce into an even smaller engine. The mechanical and operational innovations associated with the parallel cycle internal combustion engine 10 allow engine designs that are more compact and less complex than conventional approaches that perform thermodynamic events sequentially in a common chamber.

In order to utilize both compartments of the working cylinder 150, the cylinder base should be closed, with tight seals around the apertures 204 (FIG. 19A) through which pass the piston connecting rods 78. To accommodate a tight seal, strict rectilinear motion of the connecting rod 78 is required. The disclosed parallel cycle engine 10 accomplishes this with a novel linear throw crank mechanism 70 employing a planet—sun orbital gear train. Both externally and internally toothed sun gears can be employed for this purpose. In either instance, a planet gear with substantially one half the pitch diameter of the sun gear is required to produce strict linear motion of the wrist pin that articulates with the connecting rod 78. In addition, the main crank 700 and the planet crank 750 should have substantially identical functional lengths 758, 713 (FIGS. 5 and 6A). The crank arms of the internally toothed variant must be equal to one half the pitch diameter of the sun gear. In the externally toothed variant, a reversal gear is necessary and the crank arms must be substantially equal to 1.25 times the pitch diameter of the sun gear.

Although simple, passive, one-way flap valves would provide the simplest functional needs of the compressor 20, realization of the full potential of the disclosed parallel cycle engine 10 requires greater compressor control. The ability to vary compressor load is essential for "sprint" mode operation and full regenerative breaking. In order to provide full regenerative breaking, the operator must be able to rapidly modulate compressor load such that vehicular response is, at least, equal to conventional friction brakes. This could be accomplished be varying either the rate of compression (engine rpm), or the degree of compression. Although rate control can be accomplished with a continuously variable transmission, certain applications would find advantage with varying the degree of compression.

As shown in FIGS. 20B-22 and FIG. 24, a compliance chamber 328 with controllable volume, located between the compressor outlet valve 230 and the primary compressed air collecting duct 822, would provide continuously variable impedance to egress of compressed air, and, as a result, continuously variable engine braking. Because of zero clearance volume in the compression chamber, there is no theoretic limit to the pressure that can be attained within the compliance chamber 328. It is also important to recognize that the cyclic nature of compression strokes provide "anti-lock" characteristics to the braking function.

Figure 24A:
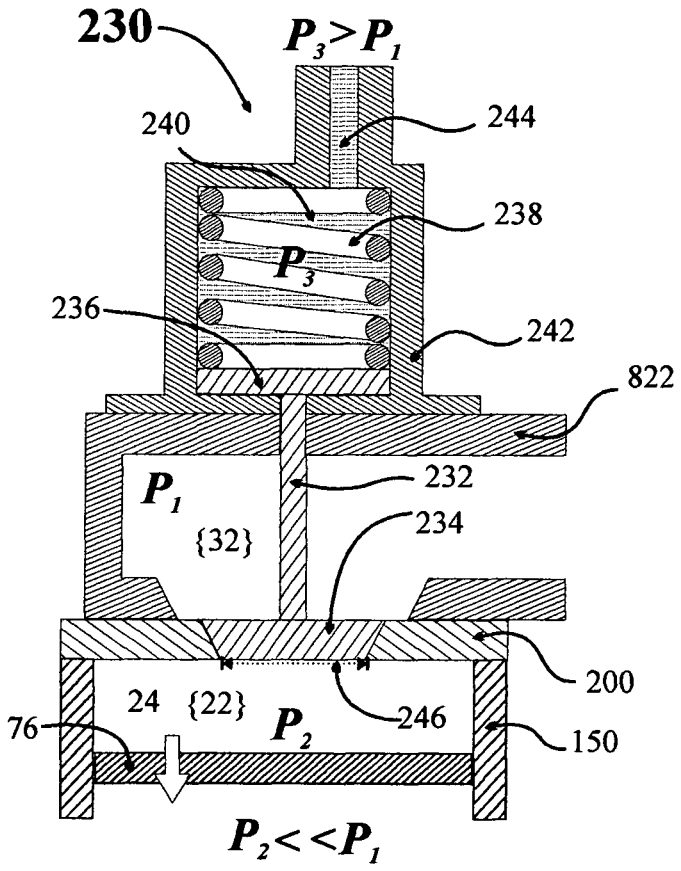
FIGS. 24A-24C are cross-sectional diagrammatic representations of a possible desirable alternative embodiment of the compressor outlet valve of an engine apparatus according to the present disclosure, more specifically.
Figure 24B:
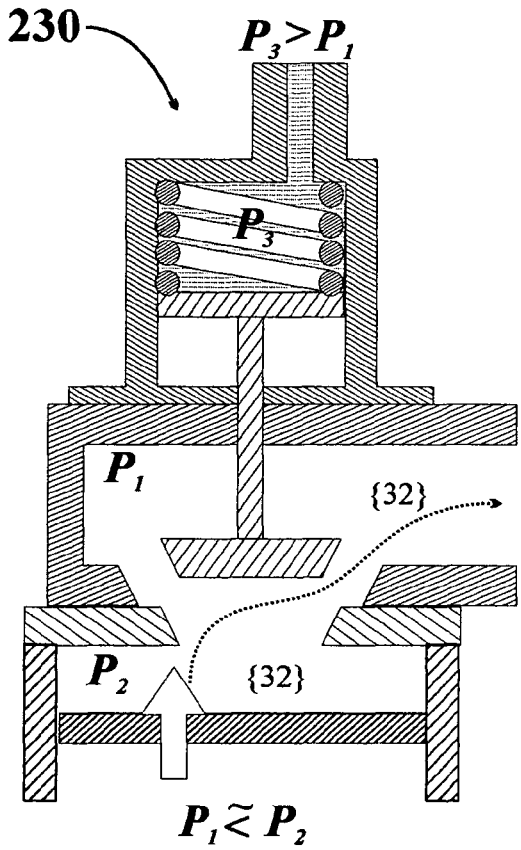
Figure 24C:
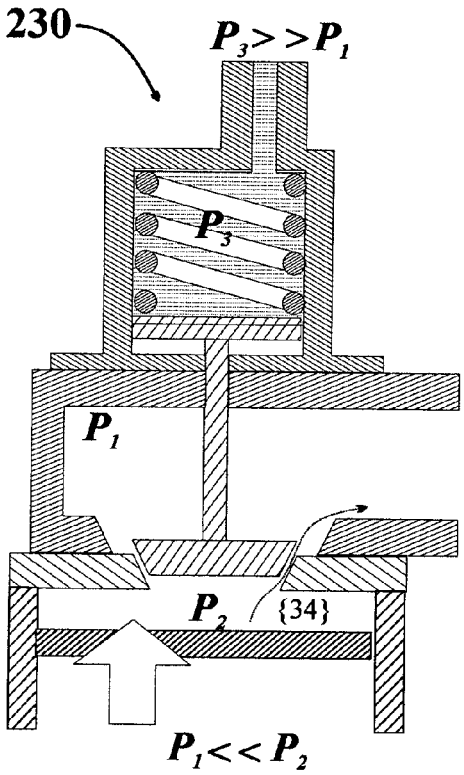

There are multiple methods of increasing the impedance of the compressor outlet valve 230. FIG. 24C shows how a variable compliance chamber can act with a passive poppet valve.

The second function of the compressor regulator 300 is to disengage the compressor 20 during "sprint' mode. This can be accomplished by increasing the dwell of the compressor intake valve 210 to allow intake air to regurgitate back to the intake manifold 26 during compression as shown in FIG. 23C. A second alternative is to disengage the compliance chamber and allow fresh air to regurgitate through the compressor outlet valve 230, bypassing the primary compressed air collecting duct 822 as shown in FIG. 20 and FIG. 22. The allowance of regurgitation of intake air back into the intake manifold 26 through either intake 210 valve or outlet 230 valve is passive and requires no compression work. Although the piston 76 is still oscillating, there is no compression—the compressor if functionally disengaged. None of the power generated by expansion is required for compression—thereby allowing maximum power for the "sprint' mode.

Finally, intake of fresh air can be restricted. This can be accomplished at the intake valve 210 level as shown in FIG. 23D. A throttling damper can also be placed in the intake manifold 26. In either case, restricting fresh air entry during the compressor's 20 intake stroke transforms intake from a passive to an energy consuming stroke. This places a load on the engine and causes deceleration. Although this is not regenerative braking, it will be associated with cooling. One can contemplate braking modes that combine both regenerative braking and cooling functions.

Figure 20A:
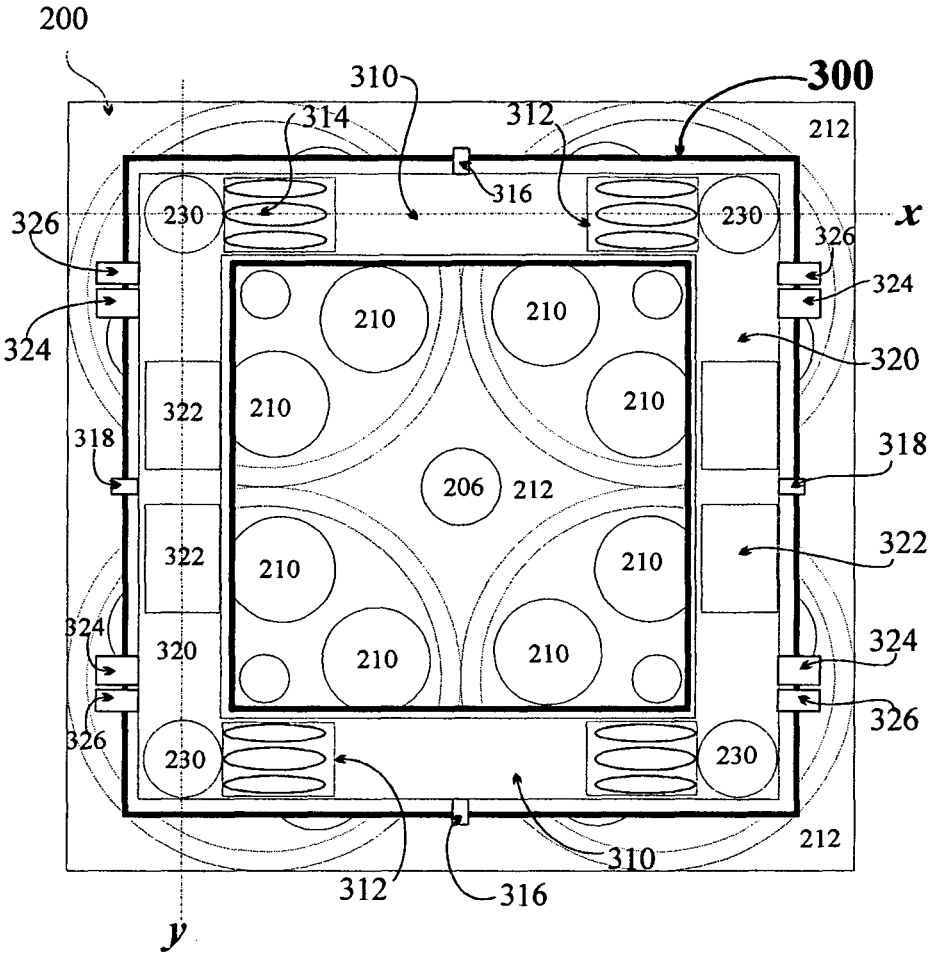
FIG. 20A is an internal elevation view of the compressor regulator of the engine apparatus according to the present disclosure, superimposed on the internal crank-case face of the compressor head seen in FIG. 11A.
Figure 20B:
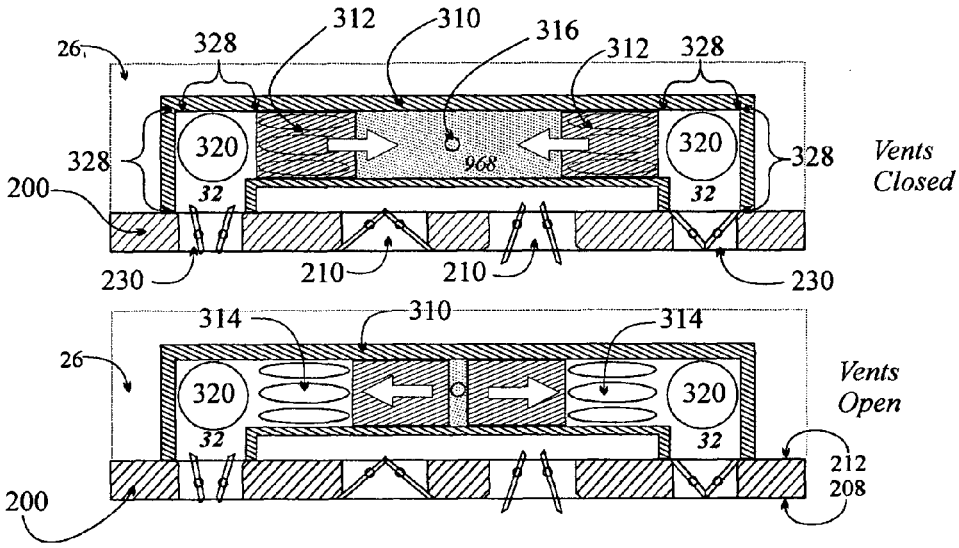
FIG. 20B is a cross-sectional view of the venting (unloading) portion of the compressor regulator, taken through section line "x" of FIG. 20A during standard compressor operation and during venting.
Figure 20C:
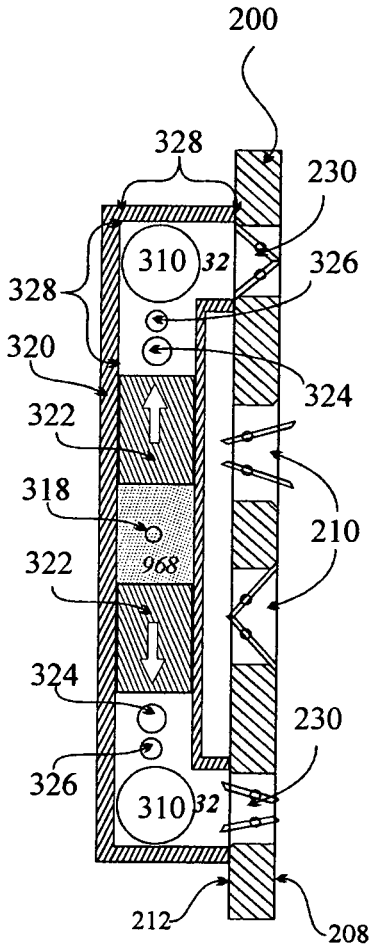
FIG. 20C is a cross-sectional view of the braking (loading) portion of the compressor regulator, taken through section line "y" in FIG. 20A.

The form and function of the compressor regulator 300 are shown in FIGS. 20A-20C. FIG. 20A is an internal elevation of the compressor regulator 300, superimposed on the internal crank-case face 212 (FIG. 19B) of the compressor head 200. FIG. 20B depicts a cross-section of the venting (unloading) portion 310 of the compressor regulator 300 taken through the imaginary plane "x" in FIG. 20A, at two different conditions (during standard compressor operation (vents closed) and during venting). FIG. 20C depicts a cross-section of the braking (loading) portion 320 of the compressor regulator 300 taken through plane "y" in FIG. 20A.

Referring to FIG. 20A, the compressor regulator apparatus 300 (heavy outline), is a rectangular frame that attaches to the internal crank-case face 212 of the compressor head 200 (light outline). The compressor regulator 300 receives each of the four compressor outlet valves 230 at each of the four corners of the regulator 300. The compressor regulator is composed of two horizontal vent tubes 310 (top and bottom), and two vertical braking tubes 320 (right and left).

Each of the two horizontal vent tubes 310 contains two peripheral sets of venting apertures 314 and two venting pistons 312. The position of the venting pistons 312 relative to the venting apertures 314 is controlled by introduction or removal of hydraulic fluid through the venting actuation aperture 316.

Each of the two vertical braking tubes 320 contains two peripheral pair of compressed air egress ports: one for standard compressed air 324 and one for hyper-compressed air formed during braking 326. Each braking tube 320 also contains paired braking pistons 322, the position of which is controlled by introduction or removal of hydraulic fluid 968 through the braking actuation aperture 318.

In FIG. 20B, the position of the vent tube 310 relative to the compressor head 200 is depicted in cross section. The circular bore of the brake tubes 320 are depicted at the ends of the vent tubes 310. The compressed air 32 from the outlet valve 230 enters the primary compressed air compliance chamber 328. The upper view depicts normal operation when the vent apertures 314 are covered by the vent pistons 312. As hydraulic fluid 968 is withdrawn through the vent actuation aperture 316, the vent pistons 312 migrate medially, exposing the vent apertures 314 as seen in the lower view of FIG. 20B. The primary compressed air compliance chamber 328 is then in continuity with the fresh air intake manifold 26. This allows venting of the compliance chamber 238 thereby unloading compression function. Although the piston 76 is still oscillating, no compression work is being performed, and the compression ratio is unity.

Referring to FIG. 20C, the paired braking pistons 322 are withdrawn to a central position, uncovering the paired standard 324 and high pressure 326 compressed air ports. The circular bore of the vent tubes 310 are depicted at the ends of the brake tubes 320. These two ports are within the primary compressed air compliance chamber 328. One-way, pressure sensitive check valves present in the standard 324 and high pressure 326 ports insure unidirectional flow of the compressed air 32 into appropriate channels.

During braking, an increase in hydraulic fluid 936 drives the braking pistons 322 peripherally (white arrows FIG. 20C) decreasing the volume of the primary compressed air compliance chamber 328, one wall of which is defined by the peripheral face of the braking piston 322. The peripheral motion of the paired braking pistons 322 also occludes the two paired compressed air exit ports 324, 326. This prevents egress of compressed air, causing the pressure of the compressed air within the primary compressed air compliance chamber 328 to increase. This places an increasing load upon the compressor, increasing the compression ratio with each piston stroke.

When the increasing pressure in the primary compressed air compliance chamber 328 exceeds the braking pressure of the hydraulic fluid 968, the brake pistons 322 are driven back centrally, and the exit ports are exposed. First the high pressure port 324 allows egress of hyper-compressed air into a high pressure reservoir. If braking pressure is maintained on the hydraulic fluid, the braking pistons 322 will again occlude the high pressure port 324, and the process continues until braking pressure is reduced.

The above represents but one illustrative example of one preferred embodiment of the compressor control mechanism. A specific, secondary high pressure compressed air reservoir (e.g. component 80 in FIG. 1A) may not be warranted in all applications. The braking action functions in precisely the same manner if there were only the standard compressed air outlet port 326.

FIGS. 21A-21D depict how modulation of the compressor regulator 300 can be utilized in engine braking. Many component numerical labels are omitted for clarity, and are found in FIGS. 20A-C. $P_1$ is the pressure in the compression chamber portion 24 of the working cylinder 150. $P_2$ is the pressure in the primary compressed air compliance chamber 328. $P_3$ is the pressure in the compressed air outlet port 324. $P_4$ is the pressure in the excess pressure compressed air outlet port 326, and $P_5$ is the pressure in the hydraulic brake actuator 318.

Figure 21A:
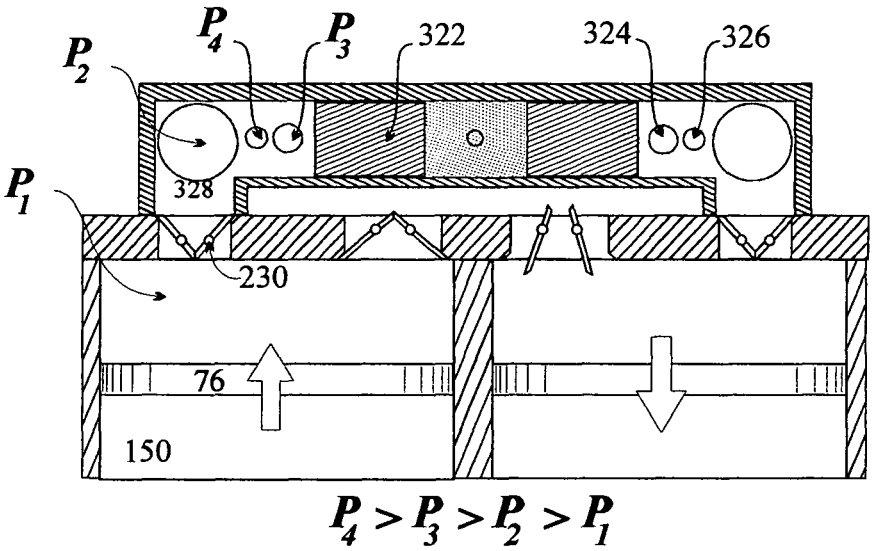
FIGS. 21A-D are cross-sectional views of the compressor regulator; depicting how modulation of the compressor regulator may be utilized in engine braking, more specifically.

The initial portion of a typical compression stroke in cylinder 150 is shown in FIG. 21A. The compression chamber pressure $P_1$ has yet to exceed the compliance chamber pressure $P_2$. The compliance pressure $P_2$ is less than either the main compressed air outlet port $P_3$, or the excess pressure compressed air outlet port $P_4$. Therefore, none of the pressure sensitive valves (compressor outlet 230, compressed air outlet port 324, or the high pressure compressed air outlet port 326) are open. Pressure is increasing in the compression chamber $P_1$, but no air is moving.

Figure 21B:
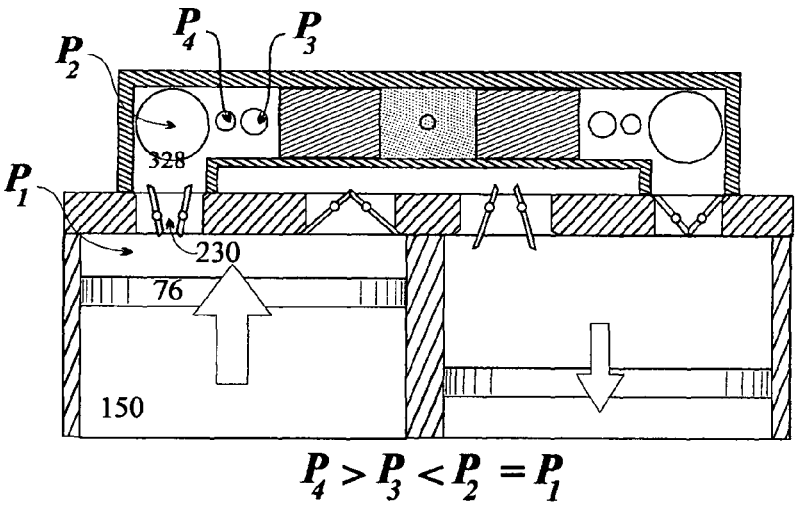

FIG. 21B depicts the final portion of a typical compression stroke. The compression chamber pressure $P_1$ has increased to equal the pressure in the compliance chamber $P_2$, opening the compressor outlet valve 230. As compression increases $P_1$ and $P_2$ increase above the level of the main compressed air outlet port $P_3$, causing compressed air to flow through the compressed air outlet port 326. Because the compressed air escapes, $P_1$ and $P_2$ do not increase enough to open the high pressure compressed air outlet port 324.

Figure 21C:
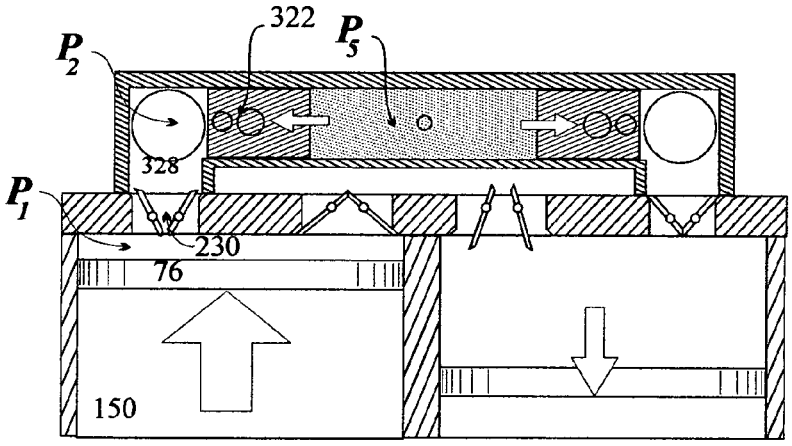

FIG. 21C shows the initial action of braking. An increase in the hydraulic pressure $P_5$ of the brake actuator 318, exceeds the compliance chamber pressure $P_2$, forcing the brake pistons 322 to cover and occlude the compressed air port 324 and the high pressure compressed air port 326. High pressure continues to build in the system, as indicated by the large demonstrative arrow, but no compressed air is expelled. The resulting "extra" force tends to retard the engine.

Figure 21D:
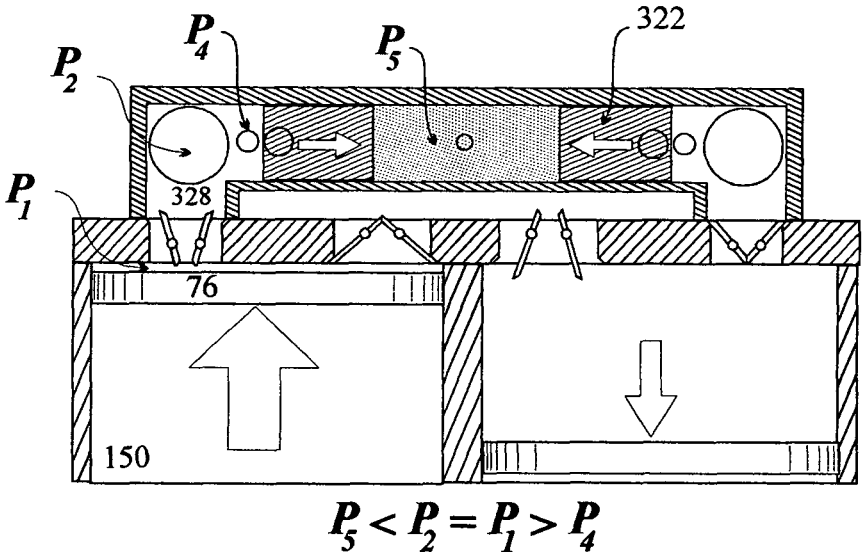

FIG. 21D depicts the final action of braking. The increasing compliance chamber pressure $P_2$ eventually exceeds the brake actuator pressure $P_5$ forcing the brake piston 322 medially, exposing the high pressure compressed air outlet port 326. When the compliance chamber pressure $P_2$ exceeds the high pressure outlet pressure $P_5$, high pressure compressed air will escape through the high pressure outlet port 326. This will decrease $P_2$ below $P_5$ and the piston 322 will again cover the high pressure port 326, again allowing high pressure to build and retard the engine—until the brake is released the $P_5$ falls. The level of braking forces on the engine is proportional the hydraulic pressure in the brake actuator $P_5$. This allows modulation of braking from light to heavy, and could be used as an exclusive means of vehicular braking.

Alternative means and modes for pressure regulation in the system are within the contemplation of the present disclosure. FIGS. 22A-22D illustrates an alternative alternate compressor regulator 300 configuration. In this alternative embodiment exploits generally the same principles as those disclosed in relation to the embodiment of FIG. 21. In this alternate configuration, however, the braking 320 and venting 310 tubes are combined into a common regulator tube 300. Further, a descender 248 is added to the compressor outlet valve 230 to effect positive, active closure of the valve at the completion of the compression stroke.

Figure 22A:
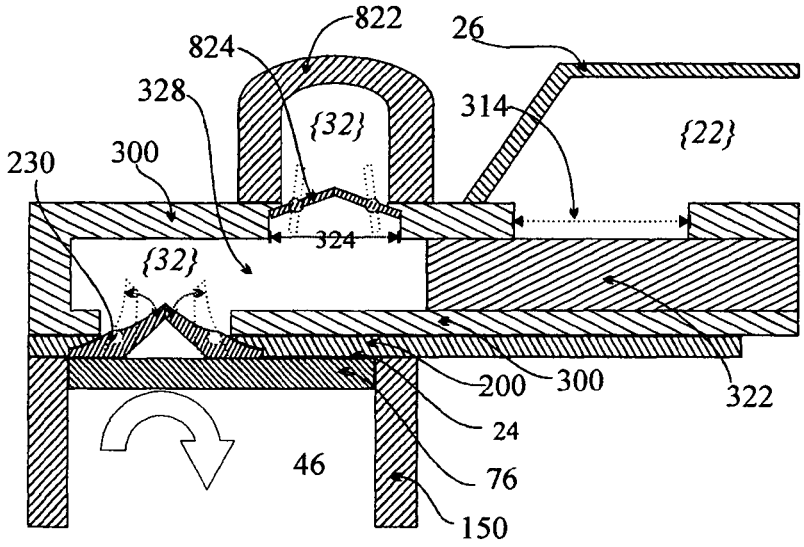
FIGS. 22A-22D are cross-sectional views of a possible alternative embodiment of a compressor regulator according to the present disclosure, more specifically.

FIG. 22A depicts the completion of the compression stroke, that is, when the piston head 76 is at "top-dead-center" relative to the compression chamber 24 portion of the working cylinder 150. (The compression chamber is effectively "absent" from FIG. 22A because of zero clearance volume at top-dead-center). Just prior to top-dead-center, the piston head 76 engages the descender 248 of the outlet valve 230, causing rapid, active valve closure. The braking piston 322 covers the vent aperture 314 (thus isolating fresh air 22), but concurrently leaves exposed the compressed air outlet port 324. The primary compliance chamber 328 and the primary compressed air collecting duct 822 contain compressed air 32.

Figure 22B:
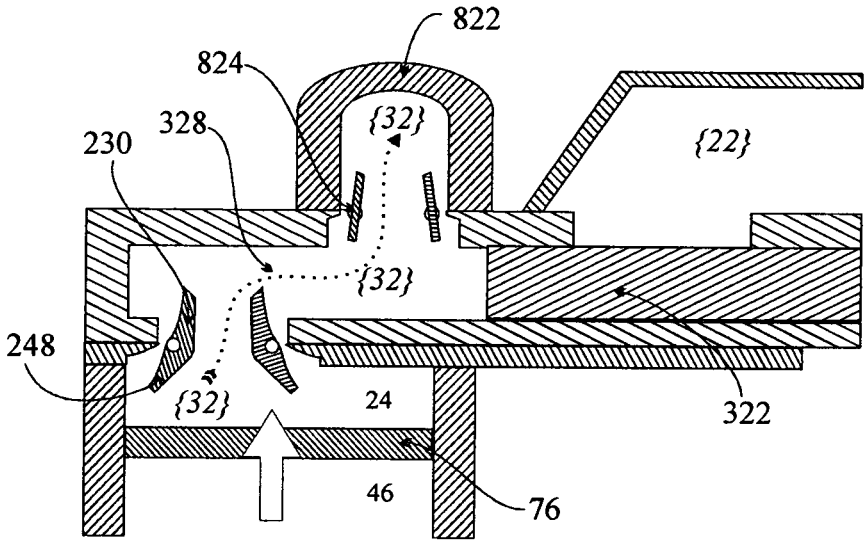

Similar to FIG. 21B, FIG. 22B illustrates conditions prior to the completion of the compression stroke. Immediately prior to completion of compression, but after the pressure in the compression chamber 24 has increased sufficiently to overcome the pressure of the compressed air 32 in the primary compliance chamber 328, thereby opening the compressor outlet valve 230 as well as the primary check valve 824 to the primary compressed air collecting duct 822. The opening of the outlet valve 230 allows passage of the compressed air 32 from the compression chamber 24, through the compliance chamber 328, and into the collecting duct 822.

Figure 22C:
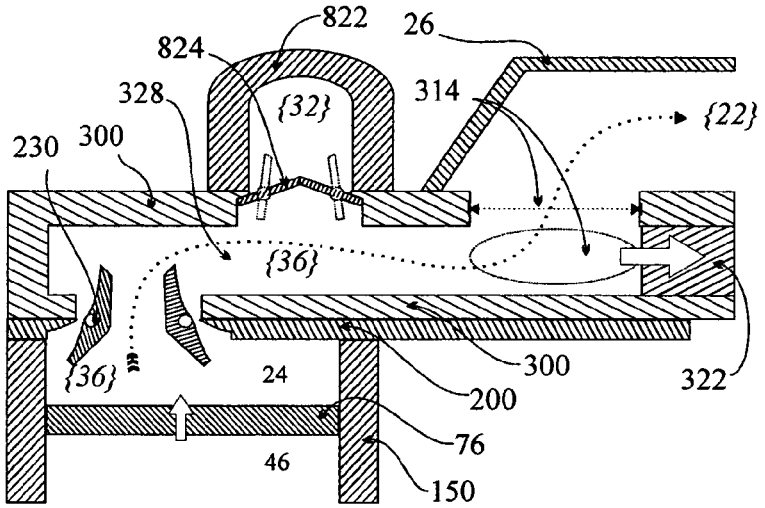

The compressor is "unloaded." The braking piston 322 is withdrawn, as seen in FIG. 22C, so that the vent apertures 314 leading to the fresh air intake manifold 26 are exposed, establishing continuity between the fresh air intake manifold 26—which is at ambient pressure 36—and the primary compressed air compliance chamber 328. Since the pressure in the compressed air collecting duct 822 exceeds the ambient pressure 36 now present in the compliance chamber 328, the primary collecting duct check valve 824 remains shut. During the compression stroke the pressure in the compression chamber 24 portion of the working cylinder 150 rapidly overcomes the ambient pressure 36 present in the primary compliance chamber 328. This opens the compressor outlet valve 320 prior to the engine performing any significant amount of compression work. The contents of the compression chamber 24 are ejected against ambient pressure only—effectively uncoupling the compressor. The uncoupled condition frees the engine to temporarily run in the "sprint" mode, where all power from the expanders is directed to the crank shaft, and none is utilized for compression.

Figure 22D:
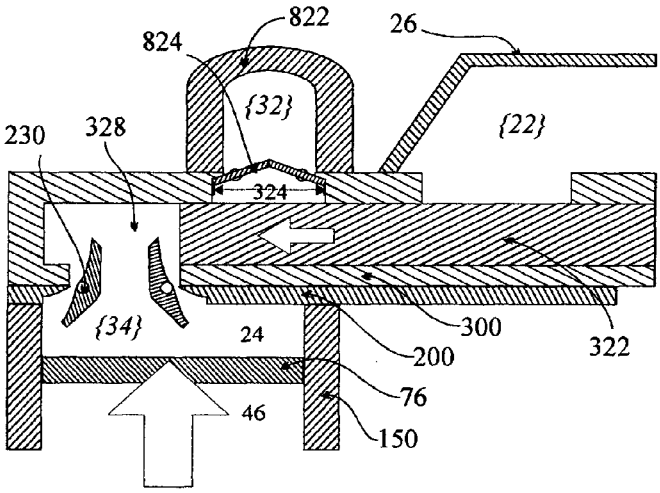

Finally, the intentional loading of the compressor to provide engine braking is illustrated with reference to FIG. 22D. With the intentional loading, the braking piston 322 is inserted so that the compressed air outlet port 324 is covered. Covering the outlet port 324 prevents egress of compressed air from either the compression chamber 24 or the primary compliance chamber 328. The high pressure compressed air 34 thus continues to build, placing increasing loads on the working piston 76 in the cylinder 150, until sufficient pressure builds to push the brake piston 322 away from the compressed air outlet port 324. This allows some portion of the hyper-compressed air to escape into the primary compressed air collecting duct, which decreases the pressure in the compliance chamber 328, allowing the brake piston 322 to again block the outlet port 324 (repeating the cycle until the brake is released), and the brake piston returns to the nominal position seen in FIG. 22A.

Figure 23A:
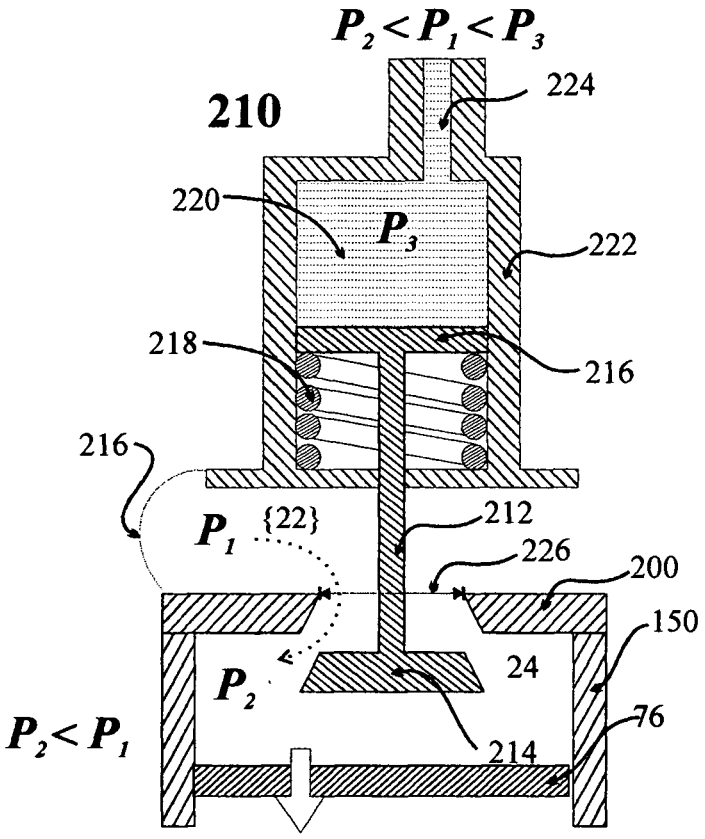
FIGS. 23A-23D are diagrammatic cross-section of an alternative illustrative example of one preferred embodiment of the compressor intake valve, more specifically.
Figure 23B:
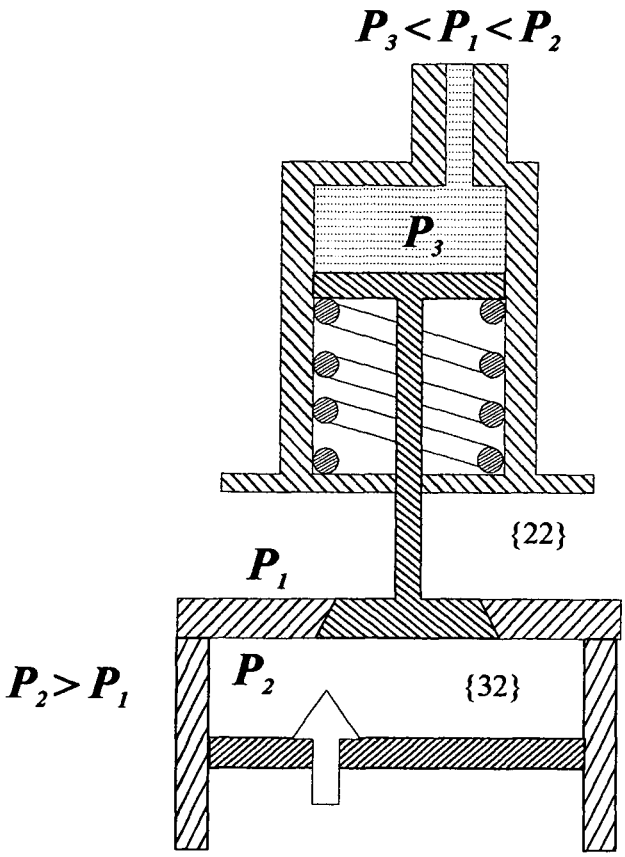
Figure 23C:
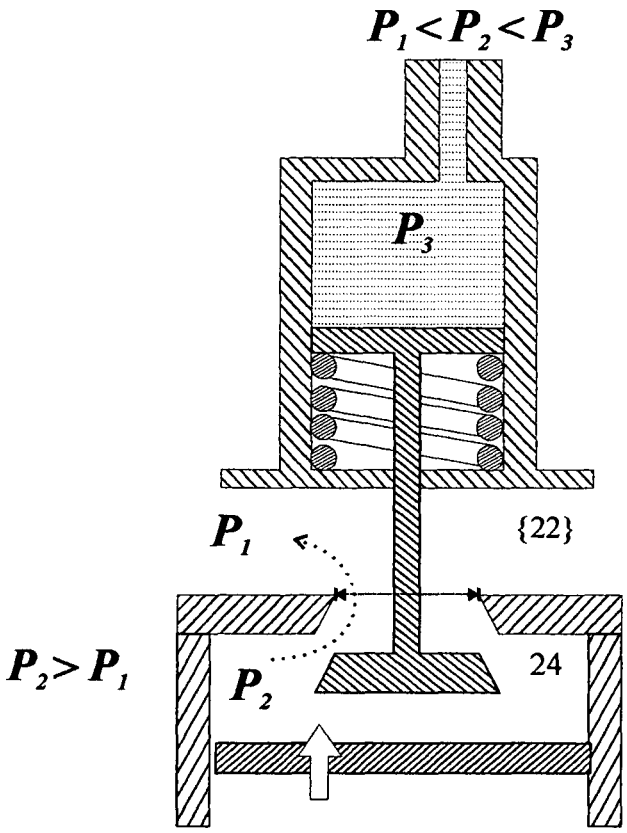
Figure 23D:
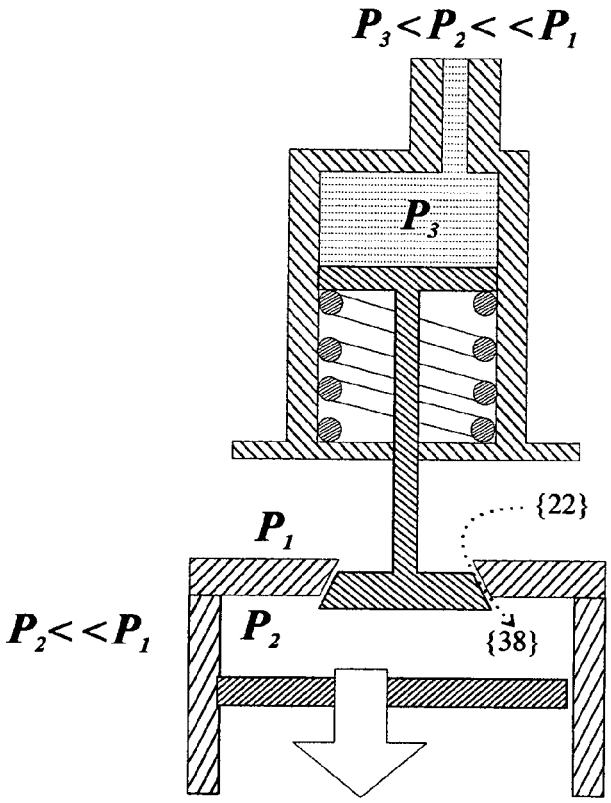

Turning to the disclosure of FIGS. 23A-23D, there are provided a series of diagrammatic cross-sections of a preferred embodiment of the compressor intake valve 210. Passive butterfly valves are depicted in FIGS. 20A-C, 21A-D and 22A-D, while this alternative example places a variable pressure bias on a familiar poppet valve. FIG. 23A depicts the intake valve 210 in the open position during a normal intake stroke. FIG. 23B depicts the intake valve 210 in the closed position during a normal compression stroke. FIG. 23C shows the intake valve 210 in a forced open position during a compressor unloading stroke (venting compression). FIG. 23D depicts the intake valve 210 in a restricted open position during a compressor loading stroke (restricted intake).

Unloading the compressor provides maximum temporary power by uncoupling compressor and expander functions. This is accomplished by allowing regurgitation of fresh air back through the intake valve 210 into the intake manifold. No significant compression work is performed by the engine to detract from the ultimate power available from expansion. On the other hand, loading the compressor provides engine braking. This can be done by restricting air flow during either intake or compression. This provides additional braking force that is not specifically regenerative. Restricting intake creates a suction retard of the engine. Although no specific energy is captured, it may be beneficial to the engine because the sub-atmospheric expansion of ambient intake gasses causes cylinder cooling.

Referring specifically to FIG. 23A, there is shown a variable bias poppet-style compressor intake valve 210. The valve head 214 is disengaged from the bore of the valve seat 226 of the compressor head 200. Descent of piston 76 creates suction that decreases the pressure P2 in the compression chamber 24 portion of the working cylinder 150, below the ambient pressure P1 in the intake manifold 216, thereby opening the valve. The valve head 214 is connected to a valve piston 216 contained in the valve compliance chamber 220 by way of a valve stem 212. The forces acting on the valve piston 216 are the sum of the closing force of the valve spring 218 and the compliance chamber fluid pressure P3. Compliance chamber pressure is controlled through an actuation port 224 placed in the valve housing 222. The valve spring 218 accelerates closure of the intake valve 210 at the end of the intake stroke when the pressure differential between the compression chamber 24 and the intake manifold 216 falls. The intake stroke thus induces opening of valve 210 and the flow of fresh air 22 from the intake manifold 216 into the compression chamber 24 portion of the working cylinder 150.

FIG. 23B shows the compressor intake valve 210 during a typical compression stroke where the intake valve is closed. Closure is caused by the reversal of the differential pressure across the intake valve 210 during the compression stroke. It is accelerated by the action of the intake valve spring 218. FIG. 23C depicts the valve's regurgitation induced by increased compliance chamber pressure P3. This allows escape of un-compressed fresh air from the "compression" chamber back into the intake manifold. This functionally uncouples the compressor from the expander, while allowing the working piston to continue its reciprocating motion (necessary for expander function).

FIG. 23D depicts valvular restriction induced by decreased compliance chamber pressure P3. Decreased compliance pressure, P3, decreases the opposing force on the valve spring 218, which places a stronger closing bias on the valve 210. This limits entry of fresh air 22 through the restricted valve opening causing the descending piston 76 to create a significant vacuum 38 in the compression chamber, thus placing a retarding load on the engine.

The compressor outlet valve will now be described. FIGS. 24A-C provide diagrammatic cross-sections of an example of one preferred embodiment of the compressor outlet valve 230. Rather than the primary compliance chamber 328 associated with butterfly valves depicted in FIGS. 20A-C, 21A-D and 22A-D, this example places a variable pressure bias on a familiar poppet valve. FIG. 24A depicts the outlet valve 230 in the closed position during a normal intake stroke, and FIG. 24B depicts the outlet valve in the open position during a normal compression stroke. FIG. 24C depicts the outlet valve 230 in a forced closed position during a compressor loading stroke (breaking compression). Loading the compressor provides maximum temporary engine braking. This is accomplished by preventing egress of compressed air 32 through the outlet valve 230 into the primary compressed air collection duct 822. Maximum compression work is performed by the engine to enhance braking. Although this may not provide additional regenerative braking, it could be used as the primary or even sole form of vehicular braking.

FIG. 24A depicts a variable bias poppet-style compressor outlet valve 230 during a typical intake stroke. The valve head 234 is engaged within the bore of the valve seat 246 of the compressor head 200. The differential pressure between the compressed air collecting duct 822 (pressure P1) and the working cylinder 150 during intake (pressure P2) urges the valve head 234 into the valve seat 246. This is reinforced by the forces generated by the valve spring 238 and the compliance chamber 240 (pressure P3). The valve head 234 is connected to a valve piston 236 contained in the valve compliance chamber 240 by way of a valve stem 232. Compliance chamber 240 pressure is controlled through an actuation port 244 placed in the valve housing 242.

A typical compression stroke where the outlet valve 230 is forced open by increasing compression chamber 24 (pressure P2) is seen in FIG. 24B. Valve closure is caused by the reversal of the differential pressure across the intake valve 230 during the compression stroke.

In FIG. 24C, valvular restriction is induced by increased compliance chamber pressure P3. Increased compliance pressure, P3, increases the opposing force on the valve piston 236, which places a stronger closing bias on the valve 230. This limits escape of compressed air 32 through the restricted valve opening, causing the ascending piston 76 to create a significantly increased pressure 34 in the compression chamber 24, and thus placing a significant retarding load on the engine. This braking enhancement does not increase the total energy captured through regenerative braking, but it does allow the energy to be captured more rapidly. This enhancement may entirely eliminate the need for conventional vehicular brakes.

FIGS. 25A-D are diagrammatic depictions of the simultaneous positions of the eight working cylinders 150 of the parallel cycle engine 10 at one instant of the thermodynamic cycle, according to the method and apparatus of this disclosure. (The left and right cylinder blocks 100*a*, 100*b* are shown in phantom.) The four cylinders 150*a*, 150*b*, 150*c*, 150*d*, of each cylinder block are depicted separately for illustrative purposes only. The cylinders are arranged in the cylinder blocks 100*a*, 100*b* in a two-by-two, "cloverleaf" pattern as shown in FIG. 10. The respective linear throw crank mechanisms 70 are depicted in corresponding FIGS. 25A, 25B, 25C, 25D by one of their paired sun gears 72*a*, 72*b*, 72*c*, 72*d*, and by one of their paired planet gears 74*a*, 74*b*, 74*c*, 74*d*. The double headed, double sided working members 760*a*, 760*b*, 760*c*, 760*d*, are composed of paired piston heads 76*a*, 76*b*, 76*c*, 76*d*, connecting rods 78*a*, 78*b*, 78*c*, 78*d*, and wrist pin articulations 770*a*, 770*b*, 770*c*, 770*d*. The external aspects of the working cylinders 150*a-d* are closed by their respective cylinder isolation grates 600*a*, 600*b*, 600*c*, 600*d*, forming the expansion chambers 64. The internal aspects of the working cylinders 150*a-d* are closed by their respective compressor heads 200*a*, 200*b*, 200*c*, 200*d*, forming the compression chambers 24. The working members 760*a-d* and respective planet gears 74*a-d* are each 90° out of phase with their neighbors.

The first topmost diagram (FIG. 25A) shows the piston head 76*a* of a double-sided double-headed working member 760*a* at completion of the power stroke relative to the expansion chamber 64 of the working cylinder 150*a* of the left cylinder block 100*a*, and completion of the compression stroke relative to the compression chamber 24 of the same working cylinder 150*a*. The contents of the expansion chamber 64 consist of expanded motive fluid 42 that is in the process of becoming exhaust gas 62. Because there is zero clearance in both expansion and compression chambers, there is substantially zero volume in the compression chamber aspect of the left working cylinder 150*a*.

The reciprocal event, completion of the intake stroke relative to the compression chamber 24 is occurring in the working cylinder 150*a* of the right cylinder block. The compression chamber portion 24 is completely filled with fresh air 22, and all the exhaust gas has been expelled from the empty, zero volume, expansion chamber 64.

Figure 25A:
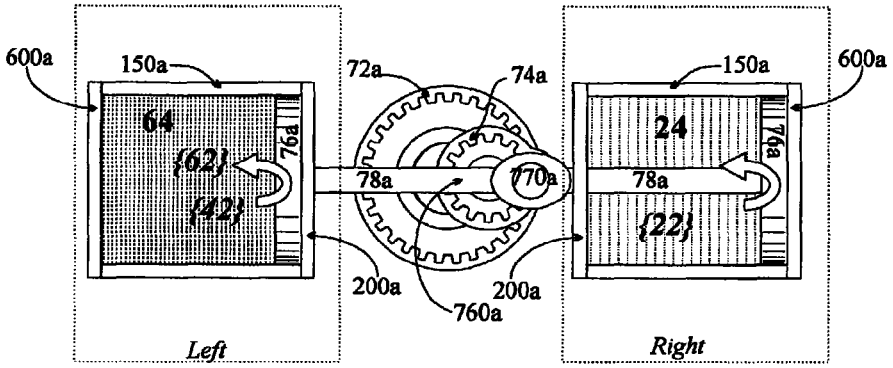
FIGS. 25A-25D are semi-diagrammatic depictions of the simultaneous positions of the working cylinders of a parallel cycle engine according to the present disclosure, shown at one instant of the thermodynamic cycle, more specifically.

The second diagram (FIG. 25B) depicts a second working member 760*b* that is positioned 90° to the "left" from its mate in FIG. 25A, and is traveling left (as show by large open arrows). The piston head 76*b* in the left hand working cylinder 150*b* has completed one-half of the exhaust stroke relative to its expansion chamber 64 and contains exhaust gas 62. The same left piston head 76*b* has completed one-half the intake stroke relative to its compression chamber 24 and is filled with fresh air 22. The piston head 76*b* of the right-hand working cylinder 150*b* has completed one-half of the power stroke relative to its expansion chamber 64, and contains motive fluid 42. The same right piston head 76*b* has completed one-half of the compression stroke relative to its compression chamber component 24 and is filled with compressed air 32.

The remaining diagrams of the figure (FIGS. 25C and 25D) are mirror images of the prior two diagrams (FIGS. 25A and 25B) respectively. This follows because each cylinder pair is 90° out of phase with its neighbor.

Figure 25B:
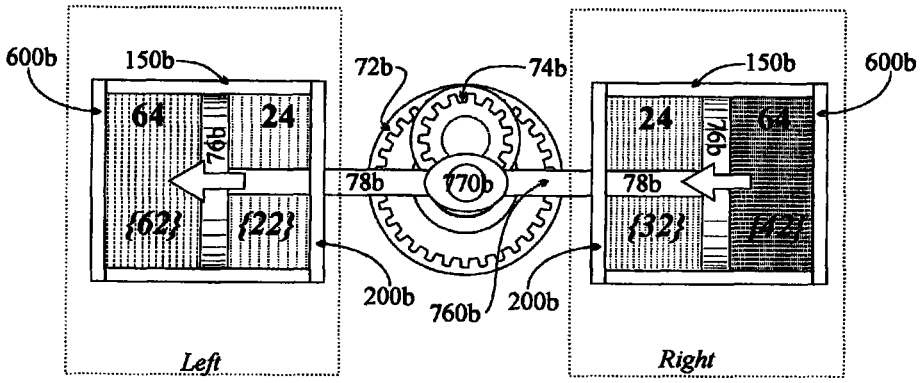
Figure 25C:
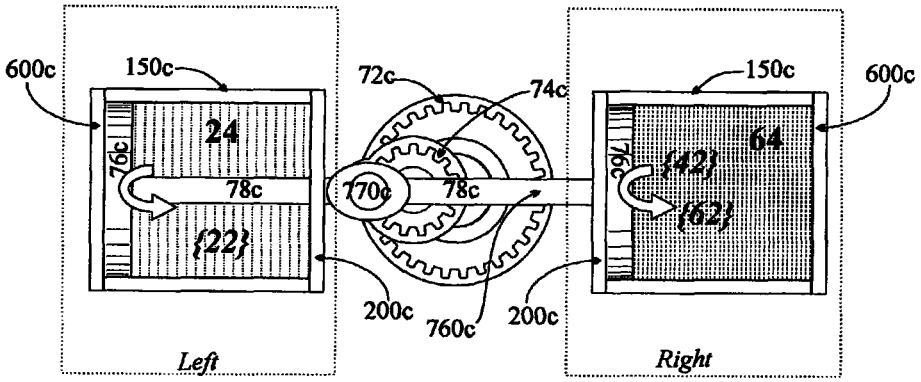
Figure 25D:
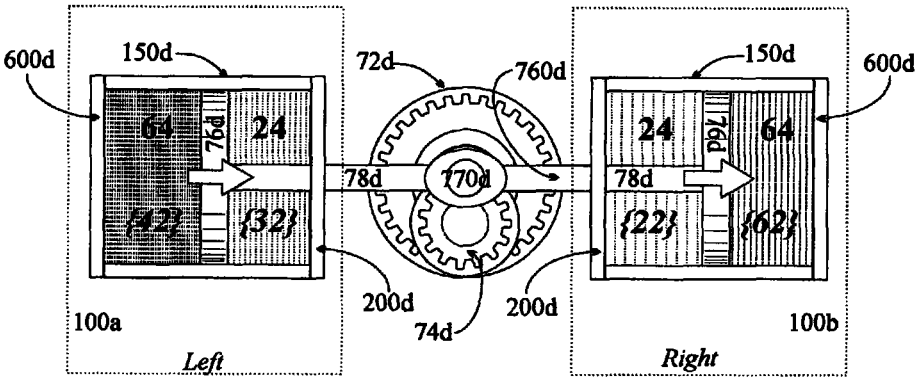

Thus, the first cylinder pair 150*a* seen in FIG. 25A has the left-hand piston head 76*a* at bottom-dead-center, having completed the compound power/compression stroke. The opposite is true of the associated right-hand piston head 76*a*, at top-dead-center, having completed the compound exhaust/intake stroke. While the above is occurring in the cylinder pair 150*a* of FIG. 25A, second cylinder pair 150*b* of FIG. 25B is 90° out-of-phase, with the left-hand piston head 76*b* one-half way through the compound exhaust/intake stroke. The associated right-hand piston head 76*b* is one-half the way down the compound power/compression stroke. Again, in FIGS. 25C and 25D, third and fourth cylinder pairs 150*c* and 150*d* are 180° out-of-phase with cylinder pairs 150*a* (FIG. 25A) and 150*b* (FIG. 25B) respectively. Thus, all four thermodynamic phases (intake, compression, power, and exhaust) are occurring simultaneously within each cylinder pair 150*a-d* at all times. Likewise, each double-headed-double-sided working member 760*a*, 760*b*, 760*c*, 760*d* is simultaneously exposed to all four thermodynamic phases.

It is evident from the foregoing that each side of each piston head 76 of each double-headed, double-sided piston working member 760 is always exposed to one of the four strokes (intake, compression, power or exhaust)—except for the instantaneous transition at "top-dead-center" from power to exhaust and exhaust to power (in the expander portion). Because the double-headed, double-sided working member 760 is a single, rigid entity, the force placed on the wrist pin is the sum of the pressures in the two compression chambers and two expansion chambers acting on the working member's two piston heads. Finally, the strictly rectilinear motion of the working member 760, as the planet gear 74 revolves around the sun gear 72, is also evident.

This configuration yields two desirable consequences. First, power is always being applied to the crank shaft 702 from each pair of cylinders 150*a-d*. Also, a portion of the force necessary for compression comes directly from the opposite side of a compressing piston head, rather than indirectly from another working member piston via the crankshaft 702. With this configuration, the crankshaft 702 bears less internal force necessary to drive compression of other pistons. Because the crankshaft 702 carries a reduced internal load, a lighter crankshaft can be employed.

Figure 26:
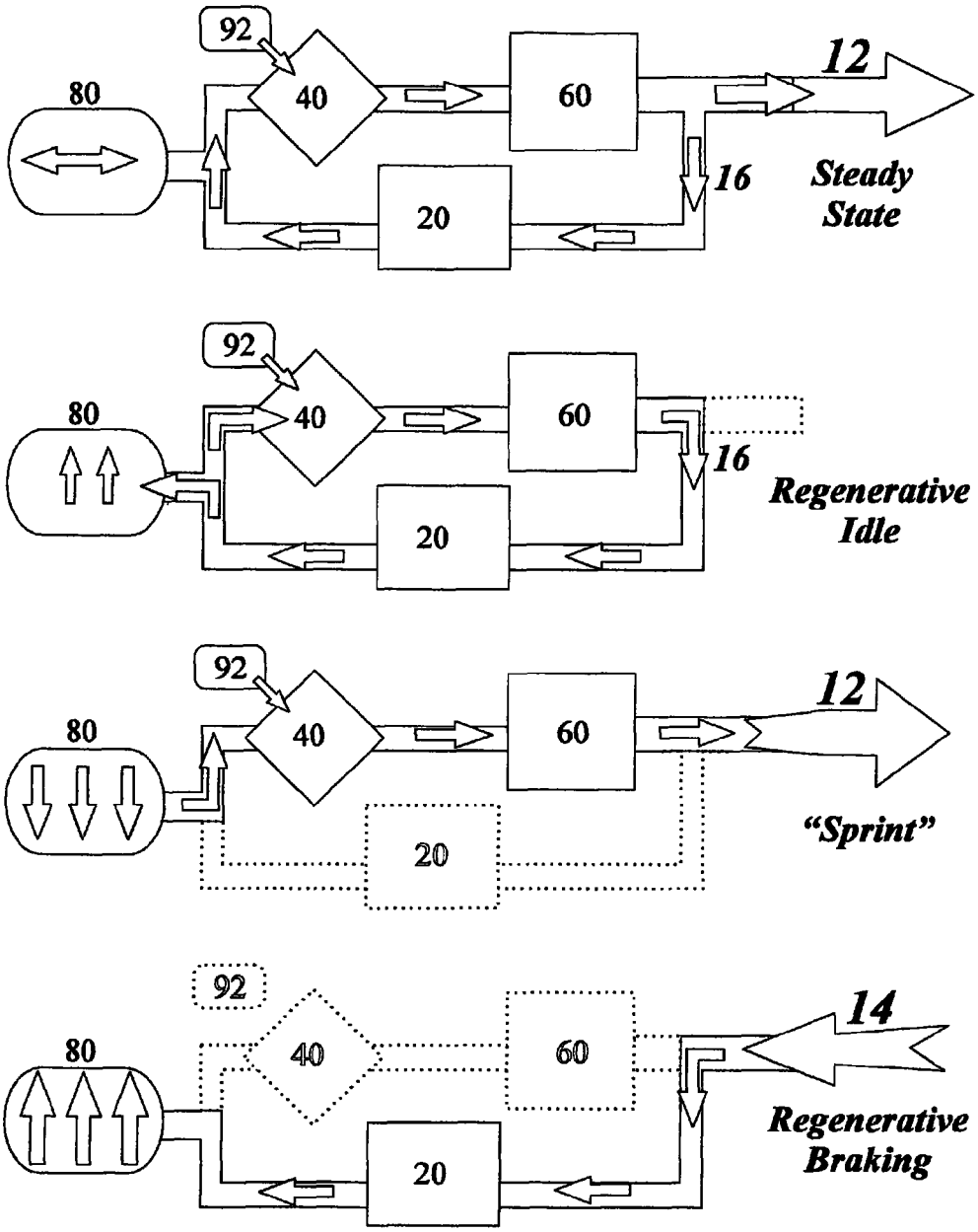
FIG. 26 is a series of diagrammatic depictions, viewed from the top of the Figure and progressing downward, of the energy flow which occurs during the general operating modes of the parallel cycle engine according to the present disclosure.

FIG. 26 is a diagrammatic depiction of the energy flow (open arrows) during the general operating modes of the disclosed parallel cycle engine 10. "Steady state" nominal operating conditions are depicted in the topmost diagram.

Energy is obtained from the combustion of fuel 92 in the combustion chamber 40, using compressed air coming directly from the compressor 20 as the oxidant. Following conversion to torque in the expander 60, a portion of the energy is used to perform external work 12 while a portion is used internally 16 to drive the compressor 20. In the steady state, the level of compressed air in the compressed air reservoir 80 has minimal variation. Notably and advantageously, during "steady state" operation the amount of power generated is also modulated by the flow of motive fluid into the expander 60.

The second diagram, denoted "regenerative idle," is mode of operation unique to the parallel cycle engine disclosed hereby. It depicts one method of increasing the level of compressed air in the reservoir 80 to nominal, or supra-normal, levels. In this mode, the energy is supplied by combustion of fuel 92, but the entire energy output 16 of the expander 60 is directed to driving the compressor. In this mode the energy derived from fuel combustion is converted to compressed air and stored in the reservoir 80 for later use. The regenerative idle of the presently disclosed parallel cycle engine 10 must not be confused with idling of conventional Otto and Diesel engines, which require energy consumption (burning fuel) just to stay running. The disclosed parallel cycle engine 10 has no such requirement to keep idling. In this sense, it behaves more like an electric, or compressed air motor.

The third diagram, denoted "sprint," is another unique mode of operation for this inventive parallel cycle engine 10. In this sprint mode, all power 12 from the expander 60 is directed to external work. No work is done to drive the compressor 20. Power can come from either the combustion of fuel 92 or from compressed air stored in the reservoir 80—or both. This mode is available when bursts of maximum power are required, for example, during passing or freeway merging by a passenger vehicle. The duration of sprint mode is determined by the amount of compressed air available in the reservoir 80. The duration can be increased by increasing the amount of compressed air above nominal levels by regeneration from either idling or braking (further described below). Again, it should be remembered that the amount of power utilized during sprint mode is also modulated by the flow of motive fluid into the expander 60. Sprint mode allows the disclosed engine 10 to be sized relative to the expected "average" requirements, rather occasional, temporary maximum demands.

The bottom-most diagram, denoted "regenerative braking," is yet another unique, and perhaps the most advantageous mode of operation (in vehicular applications, at least), of the presently disclosed engine 10. In this mode, external energy 14 is utilized to exclusively drive the compressor 20, converting the external energy 14 into compressed air that is stored in the compressed air reservoir 80. In vehicular applications, the external energy would come in the form of vehicular kinetic energy that must be shed during vehicular braking. Alternating between "sprint" and "regenerative braking" would be particularly advantages in stop-and-go applications, such as city busses or taxis.

The amount of external energy that can be converted and stored is obviously related to the ability to "load" compressor 20 and the volume/strength of the reservoir 80. There are two general methods for increasing the load on the compressor 20: (i) increasing the rate of compression (rpm), and (ii) increasing the degree of compression (compression ratio). Both are directly applicable to the disclosed parallel cycle engine 10. There is no theoretical limit to the amount and rate of energy conversion and storage by the parallel cycle engine 10, therefore there is no specific reason that the disclosed engine could not assume all breaking responsibilities for vehicular applications.

Figure 27A:
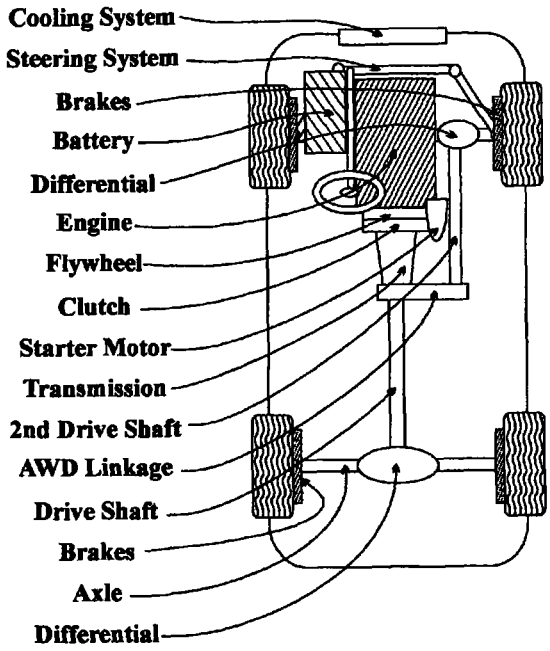
FIGS. 27A-27C provide a diagrammatic comparison of the major components of various vehicular platforms, where
Figure 27B:
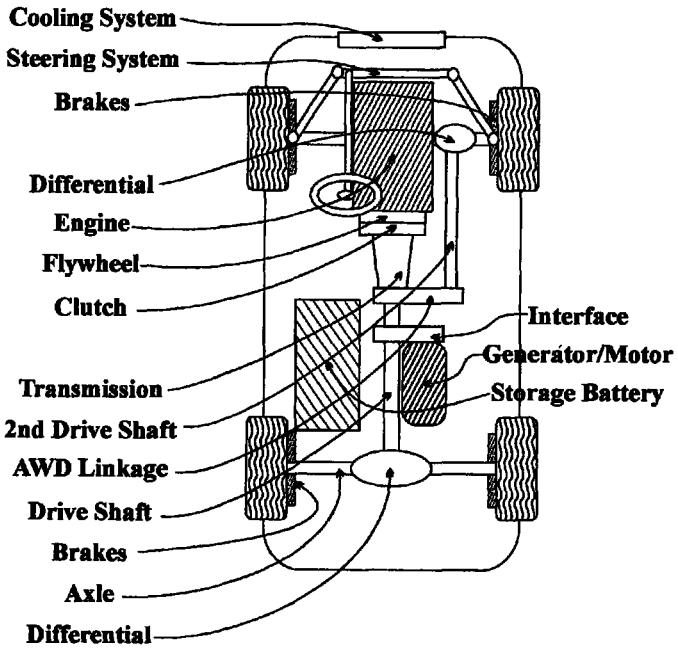
Figure 27C:
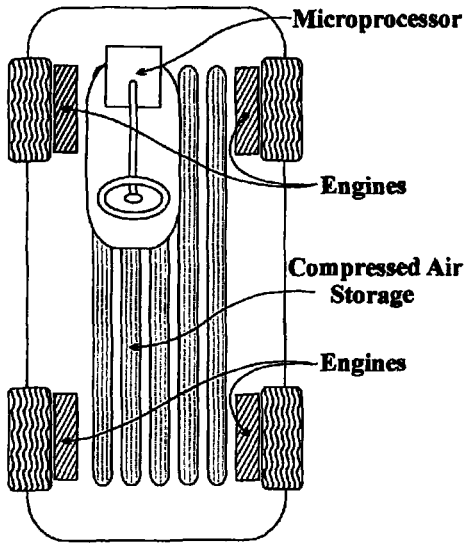

Considered together, FIGS. 27A-C are a diagrammatic comparison of the major components of various vehicular platforms. FIG. 27A is a conventional all-wheel drive vehicle. FIG. 27B is a gas-electric hybrid all-wheel drive vehicle. Lastly, FIG. 27C is one preferred embodiment of the disclosed parallel cycle engine.

Referring jointly to FIGS. 27A and B, the familiar, major components are diagramed and listed. The gas-electric hybrid adds a generator/motor, a larger battery, and an interface mechanism to the conventional platform. The conventional battery and starter motor have been replaced with larger devices. Referring then to the vehicle of FIG. 27C, four smaller parallel cycle engines 10 are directly attached to the wheels. A suitable microprocessor, known in the art, integrates all input from the operator. Compressed air reservoirs 80 are also depicted. Depending on the application, each engine may require a clutch and transmission. Likewise, each engine may maintain its own combustion chamber, or the four engines may share a single combustion chamber.

Thus, as now will be evident to a person skilled in the art, the general thermodynamic processes, and the structure and co-operation of structure, of the parallel cycle internal combustion engine 10 are new and unique. Contrasting the function and structure of the disclosed parallel cycle engine 10 with conventional Otto and Diesel machines will organize and emphasize the numerous useful innovations and characteristics of the present invention.

The function, and general thermodynamic considerations, of the inventive apparatus and method are now further elaborated. Comparisons and contrasts with long-used Otto and Diesel engine cycles also can be drawn.

The disclosed parallel cycle internal combustion engine, like the familiar Otto and Diesel cycle engines, produces power through the expansion of a motive fluid caused by the addition of heat generated by the combustion of fuel using atmospheric oxygen as the oxidant. Similar to the Otto and Diesel cycle engines, the disclosed parallel cycle internal combustion engine also enhances fuel combustion by compressing air prior to combustion. Despite certain basic similarities, there are two critical areas that distinguish the disclosed parallel cycle engine 10 from conventional Otto and Diesel cycle engines: (i) the method by which the basic thermodynamic functions of compression, combustion, and expansion (power) are accomplished, and (ii) the capacity for energy storage. (Refer to FIG. 1)

In Otto and Diesel engines, compression, combustion and expansion are sequential, discrete, dependent events performed within a common structure. In the disclosed parallel cycle engine 10, compression, combustion and expansion are simultaneous, continuous, independent processes performed in separate structures. Otto and Diesel engines momentarily store small amounts of energy in a fly-wheel during operation. The disclosed engine can store large amounts of energy for protracted periods that extend beyond intervals of active engine operation. All advantages associated with the disclosed parallel cycle engine are derived from this ability to independently control continuously variable thermodynamic processes, coupled with the capacity to store energy.

Performance of simultaneous, continuous thermodynamic processes in separate structures of the disclosed parallel cycle engine 10 allows independent, ongoing control of each process (compression, combustion, and expansion). The sequential, discrete thermodynamic events of the Otto and Diesel engines are strictly dependent on the previous event. Combustion is strictly dependent on the oxygen present in the cylinder following the preceding compression stroke. Similarly, power (expansion) is strictly dependent on the amount of heat added from combustion. Likewise, power for the subsequent compression stroke is strictly dependent on the previous power stroke. Independent control of these thermodynamic events is virtually precluded by Otto and Diesel architecture.

Further, power generation of Otto and Diesel engines is ultimately limited by fixed, factory set parameters (bore, stroke, and compression ratio). The amount of oxygen available for fuel combustion—per power stroke—is limited to the oxygen present in the cylinder at the end of the intake stroke. Variation of compression and expansion ratios is also virtually precluded by Otto and Diesel architecture. The dependent, fixed nature of "per-stroke" thermodynamic events of conventional engines limits the basic ability to control power output to varying the rate of "per-stroke" events, i.e. varying the engine's crankshaft revolutions per minute (rpm). In order for naturally aspirated Otto cycle engines to achieve the high output benchmark of 100 horsepower per liter, crankshaft speeds in excess of 8,000 rpm are required.

It has been recognized for more than 125 years that two of the four strokes of conventional engines were "non-productive" (exhaust and suction intake). It is known that power output can be increased by increasing the number of power strokes per crankshaft revolution. In traditional crankcase scavenged two-stroke engines, the downward motion of the piston during the power stroke causes slight compression of the fresh air in the crankcase. During the final phase of piston descent of the power stroke, an exhaust port is first exposed allowing exhaust gas to escape. Final descent (bottom dead center) exposes the crankcase port, and slightly compressed crankcase air washes out the remaining exhaust gas. The upstroke causes the formal compression of the air fuel mixture and ignition occurs at top-dead-center, initiating another power stroke. The two stroke engine has no active valves, only the piston covering and uncovering ports, and is simple to build and maintain. The power stroke per revolution allows greater development of power than 4 stroke engines. Elimination of complex valves also allows higher engine revolutions per minute (rpm). There are significant drawbacks, however, with the two-stroke engine. It is quite inefficient and its high emissions have caused many applications to be banned. Although a two-cycle engine should theoretically increase power output over four-cycle engines by 100%, the inefficiency associated with the flushing process lowers the increase to around 30%.

It is evident that the two-stroke engine has the same fundamental characteristics of conventional four-stroke (Otto and Diesel) machines, i.e. compression, combustion and expansion are sequential, discrete, dependent events performed within a common structure. Although the disclosed parallel cycle engine 10 provides one power stroke per crankshaft revolution (per cylinder), its thermodynamic architecture and ability to store energy is fundamentally distinct from conventional two-stroke engines. The disclosed parallel cycle engine 10 shares the advantages of increased power and simplified valve mechanisms, but is lacks the specific drawbacks of two-stroke engines that are related to inefficiency and pollution.

One of the most important restricting factors of conventional thermodynamic engine architectures is the limited time available to accomplish their cyclic events. Otto and Diesel engines must complete their four stroke cycles (intake, compression, power, exhaust) within two revolutions of the crankshaft. For an engine running at a modest 3000 rpm, 12000 strokes must be performed in one minute, or 200 strokes per second. This means that a maximum of 5 milliseconds is available to create the conditions required for to each intake, compression, power (expansion) and exhaust stroke. Even less time is available for combustion.

Such time constraints also place further demands and limitations relative to temperature, structure, and energy storage. The rapid turnover of thermodynamic events generally requires active heat rejection in Otto and Diesel engines. Opportunities for heat regeneration are limited because the common structure must be kept relatively cool, and the time available for per-stroke regeneration is restricted. The rapid creation and elimination of thermodynamic environments required by conventional engines place serious constraints on the time available for fuel combustion. Fuels must burn quickly, and must resist pre-ignition. In Otto cycle (spark ignition) engines, a synchronized ignition system is required.

The presently described parallel cycle internal combustion engine 10 eliminates or drastically reduces these restrictions, because combustion is an ongoing process—analogous to a blowtorch or a rocket. The parallel cycle internal combustion engine 10 can burn virtually any fluid fuel completely and without knock. Greater flexibility in fuel options make the parallel cycle internal combustion engine 10 particularly well suited to future fuels and fuel sources, including oil shale, oil tar, bio-fuels, synthetic fuels, ethanol, natural gas, gas-to-liquid, coal-to-liquid, methyl hydrates, and hydrogen.

Expansion and compression ratios are fundamental in determining an engine's power and efficiency. The greater the expansion ratio, the more efficient the engine, because, at bottom-dead-center of the expansion stroke, there is little residual pressure (and heat) to be exhausted. Allowing full expansion, however, decreases the mean pressure during the expansion stroke, decreasing power. To get the most power, pressure must be increased during piston descent leaving higher residual cylinder pressure (and heat) that must be exhausted before it can perform additional engine work. In conventional Otto and Diesel machines, expansion and compression ratios are established by the fixed bore and stroke of the engine, and are not directly modified during operation.

It is advantageous for an engine to have the capacity to independently, and continuously vary the effective compression and expansion ratios during operation. In addition to independence of expansion and compression functions, the disclosed parallel cycle engine 10 allows continuous variability of expansion and compression ratios. This results in a significant increase in the dynamic power range of the disclosed engine. The capability of continuous variability is the result of a unique combination of structure and function, as well as the cooperation of unique structures.

Another innovation of the disclosed parallel cycle engine 10 is the design feature that "piggy-backs" the expansion 64 and compression 24 chambers within the same working cylinder 150 (see FIG. 25). The net force on each double sided piston head 76 is the sum of expansion chamber 64 force acting upon the expander face 762 and compression chamber 24 force acting upon the compressor face 764 of the working piston head 76. The novel compressor regulator 300 permits temporary suspension of compression work, permitting unopposed expansion work. The compressor regulator 300 is also capable of applying increasing impedance to the compressor outlet valve 230 during the compression stroke. This places a controllable, variable load on the piston head 76, varying the compression pressure/ratio, thereby controlling the braking forces of the engine.

The compressor regulator 300 is also capable of impeding inflow of ambient air through the compressor intake valve 210 into the compression chamber 24, creating sub-atmospheric pressure, or suction, within the compression chamber 24 placing an additional braking force on the engine during the intake stroke. Although the engine braking caused by the forced expansion of ambient air during intake is not regenerative, it has the advantage of cooling the cylinder.

In a fashion analogous to dynamic compression ratio variability, the expansion ratio of the apparatus and method of the present disclosure is also continuously variable. The inlet control damper 580 regulates the time that high pressure motive fluid of the inlet manifold 460 flows into the expansion chamber 64. If the flow of motive fluid into the expansion chamber 64 is terminated after the piston 75 travels only about 5% of the power stroke, the expansion ratio would be an efficient 20. If, on the other hand, motive fluid was allowed to flow into the expansion chamber 64 for half of the expansion stroke, a powerful expansion ratio of 2 would result, but with significantly decreased efficiency. The decreased efficiency is the result of the residual hot, high pressure motive fluid that resides in the expansion chamber at bottom dead center (before initiation of the exhaust stroke). The maximum expander power would occur at an expansion ratio of unity (1), but this would come at the expense of efficiency. In certain applications it would be useful to regenerate this residual heat and pressure by inserting a turbocharger at the exhaust manifold exit. If maximum expander power was combined with suspension of compression, the temporary net power output would be significantly increased (sprint mode). This could be sustained as long as stored compressed air was available.

Just as the intake valve 210 of the compressor 20 can be impeded to create suction within the compression chamber 24, the inlet control damper 580 can restrict inlet of motive fluid to the extent that the degree of expansion exceeds the degree of initial compression. This creates suction during the terminal phase of the expansion stroke, and rather than producing power, the expander will consume power, acting as a further engine brake. Again, this braking action would not be regenerative, but it would have a cooling effect on the expansion chamber.

A key difference between Otto and Diesel engines is the method of heat addition. Otto cycle engines add heat through the explosive ignition of the air fuel mixture residing within the working cylinder's clearance volume at approximately top-dead-center of the compression stroke. Pressure and temperature rapidly reach a maximum before there is any appreciable descent of the piston during the power stroke. This is termed constant volume heat addition. In order to detonate the compressed air-fuel mixture, an ignition system is required to supply the spark (spark ignition).

Diesel engines compress fresh air to a greater extent, and, as a result, the compressed air is at a higher temperature. Fuel spontaneously ignites when it comes into contact with the hot compressed air (compression ignition). Fuel is injected into the hot compressed air and burns during a portion of piston descent during the power stroke. Fuel is injected in such a way that maintains pressure during the initial portion of the power stroke. This is termed constant pressure heat addition.

In contrast, the disclosed parallel cycle engine 10 operates under both "constant volume" and "constant pressure" heat addition concepts. During operation, compressed air 32 enters the combustion chamber 40 through a pressure activated, one way valve 410 when the pressure of the combustion chamber 40 falls below the pressure in the main compressed air channel 82. Entry of compressed air into the combustion chamber is thus passive flow down a pressure gradient. Entry of compressed air triggers the injection of an appropriate amount of fuel resulting in combustion and heat addition—creating the motive fluid 42. As the pressure of the combustion chamber 40 increases, entry of compressed air and fuel stops. This is analogous to constant volume heat addition. The motive fluid 42 is fed into the expansion chambers 64 by the inlet control damper 580 cooperating with the rotating disk valve 500. This is associated with a fall in combustion chamber 40 pressure, and the process is repeated. It can be appreciated by those skilled in the art that the combustion chamber 40 pressure level oscillates about the level of compressed air 32 pressure in the main compressed air channel 82. Whether combustion actually ceases at some point during the oscillations, or merely fluctuates, depends on several parameters.

This oscillation, or pulsation, may accelerate or dampen to converge to a steady state where the exit of motive fluid 42 from the combustion chamber 40 is balanced by the entry of compressed air 32. It can be appreciated by those skilled in the art that in the steady state the combustion chamber 40 pressure equilibrates at a level somewhat lower than the level of compressed air 32 pressure in the main compressed air channel 82. This is analogous to constant pressure heat addition.

There would be a need for initial ignition of the air-fuel mixture that enters the combustion chamber 40 with either constant pressure or constant volume heat addition processes. Many methods are available in prior art. Operating conditions will dictate whether any supplemental ignition or catalyst is required to maintain appropriate combustion. During steady state after initial warm up, it is anticipated that the high temperature of the recently compressed air 32 will be sufficient to support intermittent ignition, if necessary. This is entirely analogous to the requirements of conventional Diesel engines.

Those skilled in the art will understand that although, on average, the pressure of compressed air 32 entering must be somewhat higher than the pressure of the motive fluid exiting the combustion chamber 40. However, the volume of motive fluid 42 exiting the combustion chamber is substantially greater than the volume of entering compressed air. Combustion of fuel enhances the ability of the compressed air to perform external work predominantly by increasing its volume, rather than its pressure. This is similar to the basic process of constant pressure heat addition utilized by Diesel engines. The critical difference, however, is that Diesel engines add heat as discrete events that occur in lock-step with the other thermodynamic functions. The disclosed parallel cycle engine adds heat as a continuous and controllable independent process.

Temperature control is important in all types of engines. Although an increase in temperature of the motive fluid is the defining concept of internal combustion engines, accumulation of excess engine heat must be prevented. There are three basic problems associated with excess temperature: (i) pre-ignition of fuel, (ii) loss of structural integrity and (iii) decrease in oxygen density. First, pre-ignition causes engine knock that is associated with loss of power, increased emissions, and increased engine wear. Second, it is axiomatic that excess temperature is structurally disadvantageous: metals melt and lubricants burn. Finally, oxygen availability is decreased as described by the ideal gas law:

$$P(\text{pressure})\cdot V(\text{volume})=n(\text{number of molecules})\cdot R(\text{gas constant})\cdot T(\text{temperature})$$

In conventional engines, at the end of the intake stroke, where pressure (P) and volume (V) are constrained, an increase in temperature (T) must be accompanied by a proportional decrease in the number of gas molecules (n). If the working cylinder (manifold and valves) are hot from previous combustions, air is heated as it travels into the cylinder during intake. Hot intake air has less oxygen to support the subsequent combustion.

To prevent pre-ignition, loss of structural integrity and a decrease in oxygen density, conventional engines must transfer (reject) excess heat to the environment through either passive or active cooling systems. Because heat is a form of energy, heat rejection is also energy rejection. The problem is compounded if an active heat rejection system is employed. In this situation, additional energy is required to run the system used to remove excess heat (energy). The water-cooling system of conventional automobiles requires pumps, radiators, additional weight and aerodynamic compromise in order to eliminate excess heat. It would be advantageous to be able to reclaim the energy lost in heat rejection.

In contrast, the presently disclosed parallel cycle engine 10 advantageously can retain heat rejected by conventional engines and convert that heat into useful work. First, because combustion is an ongoing process in a separate combustion chamber, with no moving parts, and no particularly tight tolerances, it can be constructed of heat resistant materials that would be problematic in conventional engines. Rather than being cooled, the combustion chamber of the disclosed parallel cycle engine 10 can be insulated to minimize the loss of heat (energy). More importantly, the independent thermodynamic architecture of the disclosed parallel cycle engine provides freedom from the time constraints of conventional engines, thereby offering a unique opportunity for regenerative temperature management, such as water injection or an internal heat sink. Injection of water into the combustion chamber decreases the temperature by converting (regenerating), rather than removing (rejecting), energy. This is accomplished by using a portion of the motive fluid's energy to induce a phase change in water transforming a liquid to a gas. Utilizing motive fluid energy to provide the water's latent heat of vaporization lowers the temperature. Since it adds active molecules to the motive fluid, pressure will tend to be maintained.

Referring again to the ideal gas law ($P \cdot V = n \cdot R \cdot T$), given a constant volume ($V_C$) of the motive fluid, removal of heat (energy) from the system will not only lower temperature ($T_2$), it will also lower the pressure (P2).

$$P_1 \cdot V_C = n_1 \cdot R \cdot T_1 \rightarrow \text{remove heat} \rightarrow {}^{*}P_2 \cdot V_C = n_1 \cdot R \cdot T_2$$

$$P_2 = P_1 \cdot (T_2/T_1)$$

The resultant decrease in pressure $P_2$ is proportional to the decrease in temperature. Although a decrease in temperature is required, the associated decrease in pressure is not welcome because it reduces the force available for expansion (power). This is to be expected from basic thermodynamic principles because heat rejection removes energy from the system.

If, however the same reduction in temperature was achieved by utilizing motive fluid heat to effect a phase change in water then:

$$P_1 \cdot V_C = n_1 \cdot R \cdot T_1 \rightarrow \text{add water/form steam} \rightarrow P_3 \cdot V_C = n_2 \cdot R \cdot T_2 N_2 = n_1 + H_2O(\text{steam molecules})$$

$$P_3 = P_1 \cdot (T_2/T_1) \cdot (n_2/n_1)$$

The resultant heat regenerated pressure $P_3$ (Equation 2) is greater than the heat rejected pressure $P_2$ (Equation 1) because the number of active molecules has increased ($n_2 > n_1$). The disclosed parallel cycle engine 10 is capable of temperature reduction through heat regeneration, rather than heat rejection. This, again, is to be expected because energy is converted, not removed. The only way to support the ability to do work (pressure·volume) and reduce temperature is to increase the number of active gas molecules.

An essential element of the disclosed parallel cycle engine is the capability of long term storage of significant amounts of energy as compressed air. Other than the fly-wheel, conventional engines lack any inherent means of energy storage. Auxiliary devices such as electric motor/generators and batteries are necessary if any energy storage is contemplated.

When alternate sources of energy are available, it would be advantageous to harvest that energy and save it for future use. The most obvious application is the kinetic energy that must be shed during vehicular deceleration. Vehicles that could take major advantage of this capability would include city buses and taxies. Another example of intermittent alternative energy sources is wind that can support fixed instillations.

Compressed air is an excellent method of energy storage because it is the immediate precursor of motive fluid. Expansion of pressurized working gas is the prime motive force of all heat engines. Compressed air is therefore the elemental thermodynamic energy currency of heat engines. Manipulation of compressed air requires minimal complexity: it flows down pressure gradients, its flow is easily modulated by simple valves, and compressed air is easily stored. With compressed air, no additional auxiliary devices are required, and no inter-conversion energy loss occurs, as is found with alternative storage systems such as an electric motor/generator, battery, flywheel, and so on.

Compressed air storage eliminates the need for a "hybrid" vehicle, in that the disclosed invention functions as a "hybrid" engine. The disclosed parallel cycle engine can absorb energy faster, and with more control than the small generators found on today's hybrid vehicles. This represents a significant advancement in that more vehicular kinetic energy can be regenerated, and, when combined with non-regenerative engine braking functions, can completely eliminate the need for conventional friction brakes.

Compressed air is also convenient in that, as a fluid, it can be stored in irregularly shaped structures such as the vehicular frame. An important quality of the disclosed parallel cycle engine is that the compressed air storage reservoir 80 stems from the main compressed air channel 82. This allows direct flow for compressed air between the compressor 20 and the combustor 40. The reservoir acts as a compliance estuary that maintains pressure, rather than a compressed air flow conduit.

In the disclosed parallel cycle engine 10, compressed air does not flow through the reservoir 80. The reservoir is a compliance chamber, not a flow conduit. Because of this arrangement, the reservoir can consist of small diameter, flexible tubes that may be housed within a tubular frame, rather than a single, large, container. LaPlace defined the relationship between wall tension, pressure, and radius in cylinders:

$$\text{Tension(dynes/cm)} = \text{Pressure(dyne/cm}^2) \cdot \text{Radius(cm)}$$
(Law of Laplace)

The wall tension is proportional to the radius. A single large compressed air tank would have increased wall tension, presenting a greater safety hazard than multiple small filaments. Further, all larger compressed air conduits would be fit with strategically located ports that could be triggered to decompress during a collision with technology similar to airbag deployment.

With respect to storage of energy obtained through regenerative braking, the vehicular kinetic energy is defined by the equation:

$$E(\text{kinetic energy})=1/2\cdot M(\text{vehicular mass})\cdot V^2(\text{vehicular velocity})$$

The energy of compressed air is defined by the equation:

$$E(\text{potential})=P(\text{reservoir pressure})\cdot V(\text{reservoir volume})$$

The volume of the reservoir can be reduced in proportion to an increase in pressure within the reservoir. If structures are designed to accommodate increased pressure, the volume can be decreased. From the Laplace relationship above, the advantage of multiple small tubes for storing high pressure is again demonstrated.

The ultimate utility of regenerative compression braking depends on two factors: (i) the speed of conversion of vehicular kinetic energy into compressed air, and (ii) the capacity of the compressed air reservoir. Ideally, all the kinetic energy of a high velocity vehicle can be rapidly captured with no need for conventional brakes.

It may be advantageous to have a plurality of reservoirs at different pressures to serve other vehicular functions. First, a reservoir of appropriate pressure and volume capacity may be useful to handle all energy available during a high speed, panic stop. Second, a reservoir may take the form that facilitates heat exchange to serve as a source of heat (extracted from highly compressed ambient air), or cooling (associated with expansion of cooled compressed air). Finally, a reserve reservoir may be maintained to insure compressed air to start the disclosed parallel cycle engine should the pressure in the main reservoir be depleted.

It may be convenient to have the capability to recharge a depleted main compressed air reservoir 80 by an external device. In addition, means to temporarily exclude a depleted main reservoir would also be useful in certain applications. This would insure that the disclosed engine could operate on the flow of compressed air directly from the compressor to the combustor without bleeding off into a depleted main reservoir.

The compressed air temperature involved in the apparatus and method is now further explained. The separate compressor 20 has a superficial resemblance to add-on devices in conventional engines that boost air intake pressure above ambient. It is important to understand that the compressor 20 of the disclosed engine does not function as a separate, additional preliminary compressor occasionally appended to conventional engines to increase performance (blower or turbocharger). As such, temperature considerations are different, and specifically, there is no need for an intercooler. As noted above, power output of conventional engines is predicated on the amount of fuel burned, which is strictly dependent on the number of oxygen molecules present in the working cylinder at the end of the intake stroke. One method of enhancing output of conventional engines is to increase the pressure in the working cylinder at the end of intake, thereby increasing the number of oxygen molecules. Auxiliary compressors such as turbochargers or superchargers are employed to this end.

The process of pre-compressing air increases the energy density of the working gas by increasing both pressure and temperature. As noted from the ideal gas law, ($P\cdot V=n\cdot R\cdot T$), for a given pressure, increasing the temperature decreases the air density in general, and the number of oxygen molecules in particular. Although initial compression increases both pressure and temperature, to be most useful, heat rejection is generally used to reduce the pre-compressed air temperature before the second compression is performed in the working cylinder. The heat rejection is accomplished by the intercooler. Although energy is lost by heat rejection, the gain in energy that results from the increased oxygen density more than offsets the energy associated with pre-compression and heat loss.

This is not a consideration in the disclosed parallel cycle internal combustion engine 10 since combustion is an independent continuous process. Combustion is predicated on the rate of compressed air flow into the combustion chamber, not the "per-stroke" number of oxygen molecules in the compression chamber at the end of the intake stroke. The parallel cycle internal combustion engine 10 does not contemplate a second compression. Energy does not need to be removed from the compressed air during its transit through the main compressed air channel 82 from the compressor 20 to the combustion chamber 40, rather, heat loss should be minimized. Heat conservation can be accomplished in two ways: (i) insulation 914 of the connecting passages 82, and (ii) locating the compressed air reservoir 80 as an estuary of a connecting passage, as perhaps best shown in FIG. 2. In a steady state, air from the compressor 20 has a comparatively short, direct, insulated route to the combustion chamber 40 with minimal entry into the compressed air reservoir 80.

Some further explication of the mode and manner of operation of the presently disclosed engine system here is offered. The parallel thermodynamic process architecture of the disclosed engine 10 allows at least three novel and useful modes of operation not available in conventional Otto and Diesel cycle engines: (i) regenerative idle, (ii) sprint, (iii), and regenerative engine braking.

Conventional engines are required to "idle" during brief periods when power demand ceases. The only reason this fuel consumptive (wasting) process is necessary, is the sequential, discrete and dependent thermodynamic cycles of current Otto and Diesel cycle engines. Depending on several factors, the use of fuel for idling is not considered a complete waste in that re-starting the engine consumes extra fuel, can be erratic, takes time, may involve manual cranking, and, if starter motors are utilized, present an additional drain on the battery. The disclosed parallel cycle engine 10 does not require an "idle" mode any more than an electric motor. Neither is dependent on previous cycles to sustain current activity.

Because expansion (power) is a continuous process, the parallel cycle internal combustion engine 10 can function at relatively low revolutions per minute without stalling, and without the need for a flywheel or clutch. The engine starts when a valve initiates the flow of working gas into the expander, and stops when flow is terminated. Accordingly, a starter motor is not required, and the parallel cycle internal combustion engine 10 has no need to idle.

Although the disclosed parallel cycle engine 10 is not required to wait in an energy wasting "idle" mode, it is capable of performing an energy storing, or "regenerative' idle. In this mode, external power output is suspended, and all energy from fuel combustion is devoted to internal regeneration of compressed air stores. This is beneficial in at least two circumstances: (i) when the compressed air reservoir is depleted and (ii) when periods of enhanced power output are anticipated.

The sequential, discrete, and fixed thermodynamic cycles of contemporary Otto and Diesel cycle engines have no direct method of temporarily increasing power output. In general, the size of the engine must accommodate an expected temporary maximum power, rather than the average, or even optimal power utilization. To get power beyond the limits set by the bore and stroke, conventional engines must employ auxiliary devices, such as superchargers and blowers, to increase the number of oxygen molecules (per cycle) available for combustion. The disclosed parallel cycle engine 10, with independence of expansion and compression functions, can disengage compressor function (and energy requirements) thereby directing all expander power to performing external work (sprint mode). The duration of sprint mode is clearly predicated on the amount of compressed air stored in the reservoir. Sprint mode would be helpful in vehicles for any acceleration, such as passing and freeway merging, and in aircraft during take-off.

The disclosed parallel cycle engine 10 is capable of a regenerative braking mode. Because conventional Otto and Diesel engines have no inherent capacity to store energy, they are not capable of regenerative braking. Current gas-electric hybrid vehicles can accommodate some degree of regenerative braking, but this is only accomplished by adding: (i) a secondary energy system (electric motor/generator and large capacity battery), and (ii) a complex interface to exchange mechanical energy between the gasoline engine, electric motor/generator, and the wheels. Further, there is limited ability for the generator to capture vehicular kinetic energy. This means that conventional, energy wasting friction brakes are still required, and that the majority of higher speed vehicular kinetic energy is still shed through non-regenerative friction braking, rather than being captured through regeneration. Kinetic energy is defined by:

$$E(\text{kinetic energy})=1/2\cdot M(\text{vehicular mass})\cdot V^2(\text{vehicular velocity})$$

It is evident that the kinetic energy that must be shed during vehicular braking is proportional to the square of the velocity. This energy must be shed quite rapidly. The limited capacity of the electric generator found on current hybrid vehicles precludes complete regenerative braking for anything other than slow vehicular velocities.

The disclosed parallel cycle engine 10 has the inherent capacity of directing an external source of power 14 to the compressor 20 and disengaging all expansion activities. When coupled with the appropriate compressed air storage reservoir 80, the engine itself can be utilized for direct regenerative braking. There is no need for a second energy system or complex interface apparatus. The amount and rate of regenerative braking is predicated on the capacity of the reservoir 80 and the rate and ratio of compression. The higher the rate and ratio of compression, the higher the rate at which kinetic energy can be removed from the vehicle (regeneration). Because the disclosed parallel cycle engine 10 has a compressor regulating interface 300 capable of a continuously variable compression ratio, the compression ratio can be controlled to provide any load on the compressor 20, thereby providing an arbitrary and varying degree of regenerative braking. In addition, those skilled in the art will recognize that adding a continuously variable transmission would be particularly advantageous in further modulation of compressor load by varying the rpm's (load) driving the compressor. One or both of these methods, (increasing rate and ratio of compression), provides the opportunity of complete regenerative braking at any speed. This would offer the possibility of major reduction or elimination of friction braking systems, and the capacity of complete capture of the significant amount of energy available in vehicles traveling at high velocity. Alternating between sprint and regenerative braking modes would provide a major advantage to vehicles performing frequent stop and go activities like city busses, delivery trucks, or taxis.

Regenerative activity is not limited to vehicular braking; it can be employed to harvest any intermittent external energy source. Fixed power generators that, for example, may run on natural gas, can be coupled to windmills, providing the ability to harvest and store intermittent wind energy.

A significant benefit of the disclosed parallel cycle engine 10 is the ability to store energy as compressed air. Several factors will determine the size, number, and configuration of compressed air storage reservoirs. In certain applications, maintenance of a reserve reservoir may be beneficial. This would be dedicated to initiating engine 10 activity. Other applications may require a source of cabin heat and cabin air conditioning. A reservoir that functions as a heat exchanger would serve this purpose. Hot, compressed air would enter the heat exchanger, which would heat cooler ambient air as a heat source. Once the temperature of the compressed air has been reduced to ambient, allowing the ambient temperature compressed air to expand (into the cabin), permits cooling. The degree of compression dictates the heating and cooling capacity of the heat exchanger reservoir.

From a safety standpoint, two features are paramount. First, the explosive effect of reservoir rupture, (for example during a collision), is related to the wall tension in the reservoir. Recalling again the LaPlace relationship, wall tension is directly related to the reservoir diameter. Therefore, multiple small tubes would be preferable a single large tube in storing compressed air. These small tubes would be located throughout the vehicle, particularly a tubular frame, in mobile applications. These small tubes would bud off a main channel, much like the fronds of a fern, or the alveoli of a lung. This allows multiple small tubes to act as an estuary, with capacitance rather than conductance function.

Second, larger compressed air channels would be fitted with strategically located emergency relief valves that would provide controlled decompression if excess pressure developed, or if a collision was sensed. These emergency relief valves would be activated by the same sensors that activate the air bags. Certain applications may couple an air bag with the emergency relief valve to provide additional cushioning during a collision, or if flotation was required.

As suggested by FIG. 27, the disclosed parallel cycle engine 10 invites major innovations in vehicular design. The compact nature of the disclosed engine, coupled with its expanded dynamic range, suggests placing a smaller engine at each wheel. A clutch and transmission, preferably continuously variable, would be required for regenerative idle mode and reverse drive. A microprocessor would receive and integrate a variety of inputs from operator controls and vehicular sensors. It would also control the output of each of the four independent engines. In the preferred embodiment, the engines would be small, modular and accessible, allowing for straight forward maintenance, repairs and replacements.

The microprocessor would have an extensive repertory of actions. Although specific sensing and control algorithms would need to be developed, they could surely be based on existing video games, arcade rides, or aircraft control systems. Once developed, they would obviously be easier to duplicate than conventional structural control devices.

With complete independent control of each wheel, steering could be accomplished by varying the speed of each wheel, eliminating the need for a steering mechanism. Maneuverability would be enhanced because, for example, the right sided wheels could be turning forward while the left sided wheels turn in reverse—a "pirouette." Some wheels can be pulling, while others are pushing, and others are trailing passively.

The compressed air reservoir would replace the electric battery, and a starter motor is not required. A flywheel is not required. Since the engine utilized compressed air, no gas-electric interface mechanism is needed. Complete regenerative braking eliminates the need for conventional friction brakes. Regenerative temperature control eliminates the need for a cooling system and allows more aerodynamic vehicular design. Since power is controlled by the microprocessor, and a small engine drives each wheel directly, all mechanisms required to distribute power from a centrally located engine to the peripheral wheels are unnecessary—allowing removal of drive shafts, axles, and differentials.

In summary, a vehicle based on the disclosed engine would have enhanced performance and efficiency with decreased emissions and complexity. The simplicity of the proposed vehicle should translate into improved reliability and decreased manufacturing costs. Although the proposed vehicle would be radically different that existing platforms, it could immediately integrate into existing infra-structure while being positioned to accommodate fuels of the future.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all patents and publications cited above are hereby incorporated by reference.

What is claimed is:

1. A parallel cycle internal combustion steam engine system comprising:

a compressor for compressing air according to a compression ratio;

a main compressed air channel for conveying compressed air from said compressor toward a combustion chamber;

a reservoir, in fluid communication with said main compressed air channel at a location between said compressor and said combustion chamber, for storing compressed air compressed by said compressor;

a valve for regulating flow of compressed air between said main compressed air channel and said reservoir;

the combustion chamber for combusting air received from said reservoir or from said compressor with a fuel to create a motive fluid;

a one-way valve which prevents backflow of compressed air from said combustion chamber toward said compressor or said reservoir;

a valve for regulating flow of compressed air between said main compressed air channel and said combustion chamber;

an expansion chamber, separate from said combustion chamber, in which the motive fluid expands according to an expansion ratio as a result of combustion;

an inlet manifold, in fluid communication with said combustion chamber, through which motive fluid flows from said combustion chamber to said expansion chamber; and a timing valve for regulating intake of motive fluid from said inlet manifold into said expansion chamber;

wherein thermodynamic functions of intake, compression, combustion, and expansion are performed continuously and independently in distinct parallel zones, and said compression and expansion ratios are independently variable.

2. A system according to claim 1 wherein a volume flow of motive fluid into said expansion chamber substantially exceeds a volume flow of compressed air into said combustion chamber.

3. A system according to claim 2 further comprising a liquid water supply for controllably supplying water into said inlet manifold for phase-change temperature control of said motive fluid.

4. A system according to claim 1 further comprising at least one dual-chamber cylinder comprising:

a substantially closed cylinder head;

a substantially closed cylinder base; and a double-sided piston head disposed for reciprocating motion through a piston displacement within said dual-chamber cylinder, said double-sided piston head dividing said dual-chamber cylinder into said expansion chamber and a compression chamber;

wherein said expansion chamber comprises an expander variable space between said reciprocating piston head and the closed cylinder head of said cylinder, and said compression chamber comprises a compressor variable space between said reciprocating piston head and said closed cylinder base, and whereby said cylinder integrates therein said expansion and compression functions wherein only expansion or exhaust of motive fluid occurs in said expander variable space, and only intake or compression of air occurs in said compressor variable space.

5. A system according to claim 4 wherein:

said motive fluid expands within said expansion chamber thereby to move said double-sided piston head within said dual-chamber cylinder;

said piston head is operatively connected to a crankshaft, said crankshaft rotatable by forces external to the engine system thereby to move said piston head; and said compressor comprises said piston head moving through said compression chamber within said dual-chamber cylinder.

6. A system according to claim 5 further comprising:

a pair of opposed cylinder blocks, each said cylinder block containing at least four said dual-chamber cylinders, and each cylinder in a cylinder block being operatively paired with a corresponding cylinder in the other block;

a pair of operatively connected said double-sided piston heads associated with each pair of cylinders;

a crankshaft between said cylinder blocks;

a linear throw crank mechanism associated with each said pair of piston heads for operatively engaging each pair of piston heads with said crankshaft;

wherein a net force generated by an operative pair of piston heads is transmitted to the crankshaft via said throw crank mechanism, thereby rotating said crankshaft; and wherein intake, compression, expansion, and exhaust functions are substantially continuously and simultaneously performed within each operative pair of dual-chamber cylinders.

7. A system according to claim 6 wherein:

a double-sided piston head and expansion chamber of each said cylinder perform an expansion function while said piston head and compression chamber of said cylinder simultaneously perform a compression function; and a piston head and expansion chamber of each cylinder perform an exhaust function while said piston head and compression chamber of said cylinder simultaneously perform an intake function.

8. A system according to claim 6 wherein said at least four dual-chamber cylinders comprise four cylinders disposed mutually parallel in each of said opposed cylinder blocks in a two-by-two array, and further wherein opposed operative pairs of cylinders are disposed coaxially, said apparatus further comprising:

a crankcase between said separate cylinder blocks; and two said crankshafts disposed though said crankcase, each of said crankshafts operatively associated with two of said operative pairs of double-sided piston heads and two of said opposed operative pairs of cylinders;

wherein each opposed cylinder independently performs functions of intake, compression, expansion and exhaust for each rotation of an operatively associated crankshaft.

9. A system according to claim 8 wherein said linear throw crank mechanism converts reciprocating motion of said double-sided piston heads into rotary motion of said crankshaft, and further comprising:

a rod connecting each said operative pair of piston heads thereby to comprise a working member; and a connector, connecting said throw crank mechanism to said rod, comprising:

a central articulating aperture defined on said rod connecting the operative pair of piston heads, medially along the length of said working member; and a crank wrist pin, rotatably received in said central articulating aperture, for operatively connecting said working member with said throw crank mechanism and which undergoes linear travel collinearly with axes of said cylinders.

10. A system according to claim 9 wherein said linear throw crank mechanism further comprises an internal planetary gear set comprising a planet gear engaged with and revolvable interiorly within an internally toothed sun gear, and further wherein:

said sun gear is fixed and defines a sun gear pitch circle diameter corresponding approximately to said piston displacement, and said throw crank mechanism further comprises a main crank having a central portion secured to one of said crankshafts and a peripheral portion rotatably connected at a center of said planet gear;

said main crank defines a functional crank arm length corresponding to approximately one-fourth said sun gear pitch circle diameter, and said planet gear defines a planet gear pitch circle diameter corresponding to approximately one-half said sun gear pitch circle diameter;

said linear throw crank mechanism further comprises a pair of planet cranks, each said planet crank comprising a central portion secured to a corresponding one of said planet gears and a peripheral portion engaged with said working member via said crank wrist pin; and each said planet crank defines a planet crank arm length corresponding approximately to said functional crank arm length of said main crank.

11. A system according to claim 10 wherein said linear throw crank mechanism comprises an external planetary gear set comprising a planet gear engaged with and revolvable exteriorly around an exteriorly toothed sun gear, and further wherein:

said sun gear is fixed and defines a sun gear pitch circle diameter corresponding approximately to one-fifth said piston displacement, and said throw crank mechanism further comprises a main crank having a central portion secured to one of said crankshafts and a peripheral portion rotatably connected at a center of said planet gear;

said main crank defines a functional crank arm length corresponding to approximately 125% of said sun gear pitch circle diameter;

said throw crank mechanism further comprises a pair of planet cranks, each said planet crank comprising a central portion secured to a corresponding one of said planet gears and a peripheral portion engaged with said crank wrist pin; and each said planet crank defines a planet crank arm length corresponding approximately to said functional crank arm length of said main crank.

12. A system according to claim 8 further comprising:

a high-pressure inlet manifold associated with each opposed cylinder block and in fluid communication with said expansion chambers in each opposed cylinder block;

an exhaust manifold associated with each opposed cylinder block and in fluid communication with said expansion chambers; and wherein said timing valve for regulating intake comprises a single valve on each said opposed cylinder block, said single valve regulating a flow of motive fluid from said inlet manifold into all said expansion chambers, and said single valve also regulating a flow of exhaust gasses from all said expansion chambers into said exhaust manifold.

13. A system according to claim 12 wherein said single valve on each said cylinder block comprises:

a valve cradle disposed substantially parallel and adjacent to said cylinder heads, said valve cradle defining therein grate apertures opening into each of said expansion chambers; and a rotating disk valve rotatably mounted adjacent said valve cradle, said rotating disk valve defining therein a plurality of inlet apertures and a plurality of exhaust apertures; wherein said disk valve is mounted for timed rotation to align periodically said inlet apertures with said grate apertures, and to align periodically said exhaust apertures with said grate apertures, thereby fluidly connecting serially said inlet manifold and said exhaust manifold with said expansion chambers.

14. A system according to claim 13 further comprising an inlet control damper, rotatably mounted adjacent said disk valve, for controlling duration of flow of motive fluid from said high pressure inlet manifold into said expansion chambers during an expansion stroke, said damper comprising a damper disk rotatably mounted adjacent said disk valve, said damper disk comprising four symmetrically arrayed apertures separated radially by four flanges;

wherein said damper is controllably rotatable variably to occlude, with said flanges, said central inlet apertures of said disk valve.

15. A system according to claim 13 wherein said grate apertures comprise a plurality of grate apertures extending radially from a center of said valve cradle, each grate aperture aligned with one of said expansion chambers.

16. A system according to claim 15 wherein:

said grate apertures comprise generally arcuate apertures, each said grate aperture subtending approximately 30° of angular width, and wherein said grate apertures are separated by intervening valve cradle subtending approximately 60° of angular width;

said grate apertures comprise four grate apertures comprising a radial length approximately equal to diameters of said cylinders; and said grate apertures comprise:

four inlet grate apertures, one said inlet grate aperture in communication with a corresponding expansion chamber; and four exhaust grate apertures, one said exhaust grate aperture in communication with a corresponding expansion chamber, and wherein pairs of said inlet grate apertures and said exhaust grate apertures are arrayed radially from a center of said valve cradle.

17. A system according to claim 13 wherein said inlet apertures and said exhaust apertures of said rotating disk valve comprise:

three generally arcuate central inlet apertures, each said inlet aperture subtending approximately 30° angular width; and three generally arcuate peripheral exhaust apertures, each said peripheral exhaust aperture subtending approximately 30° angular width;

said inlet and outlet apertures symmetrically arrayed radially from a center of said disk valve, wherein said central inlet apertures are separated by intervening disk valve subtending approximately 90° of angular width, and said peripheral exhaust apertures are separated by intervening disk valve subtending approximately 90° of angular width, and wherein said central inlet apertures are defined radially inward from said peripheral exhaust apertures, and further wherein said central inlet and peripheral exhaust apertures are evenly staggered at angular offsets of 60°, whereby each central inlet apertures is diametrically associated on said disk valve with a corresponding peripheral exhaust outlet.

18. A system according to claim 17 wherein:

said high-pressure inlet manifold substantially encloses a circular central portion, containing said central inlet apertures, of said rotating disk valve, and said exhaust manifold substantially encloses an annular peripheral portion, containing said peripheral exhaust apertures, of said disk valve;

said high-pressure inlet manifold receives motive fluid from said combustion chamber, and when said disk valve rotates, motive fluid is controllably admitted into said expansion chambers from said inlet manifold via said central inlet apertures; and when said disk valve rotates, exhaust gas is controllably released from said expansion chambers and into said exhaust manifold via said peripheral exhaust apertures.

19. A system according to claim 17 further comprising a rotator mechanism that rotates said disk valve at approximately one-third a rate of rotation of said crankshafts, said rotator mechanism comprising:

a disk valve drive shaft rotatably mounted in said crankcase and engaged centrally with said disk valve;

a disk valve drive gear engageable with said disk valve drive shaft;

paired primary crankshaft gears, one said crankshaft gear mounted on each of said crankshafts within said crankcase, said crankshaft gears mutually engaged to synchronize said crankshafts; and gears that operatively engage at least one said crankshaft gears with said disk valve drive gear, said gears comprising a member selected from the group consisting of bevel gears, worm gears, and crossed helical gears;

wherein said gears are configured such that said crankshafts rotate approximately three times faster than said disk valve drive shaft.

20. A parallel cycle internal combustion engine comprising:

a compressor for compressing air;

a main compressed air channel for conveying compressed air from said compressor toward a combustion chamber;

a reservoir, in fluid communication with said main compressed air channel at a location between said compressor and said combustion chamber, for storing compressed air compressed by said compressor;

the combustion chamber for combusting air received from said reservoir or from said compressor with a fuel to create a motive fluid;

a one-way valve which prevents backflow of compressed air from said combustion chamber toward said compressor or said reservoir;

at least one expansion chamber, separate from said combustion chamber, in which the motive fluid expands as a result of combustion;

an inlet manifold, in fluid communication with said combustion chamber, through which motive fluid flows from said combustion chamber to said at least one expansion chamber;

a timing valve for regulating intake of motive fluid from said inlet manifold into said at least one expansion chamber; and a compressed air reservoir isolation valve for regulating flow of compressed air from said reservoir to said main compressed air channel;

wherein said reservoir isolation valve when open allows flow of stored compressed air from said reservoir to said combustion chamber via said main compressed air channel, thereby permitting the thermodynamic function of combustion to be performed wholly independently from operation of said compressor, and wherein when said reservoir isolation valve is closed thermodynamic functions of intake, compression, combustion, and expansion are performed continuously and independently controllably variable in distinct parallel zones.

21. An apparatus according to claim 20 further comprising:

at least one operative pair of coaxially opposed dual-chamber cylinders;

a double-headed double-sided piston working member cooperative with each pair of dual-chamber cylinders, each said working member comprising:

a first double-sided piston head disposed for reciprocating motion through a piston displacement within a first one of said dual-chamber cylinders, said double-sided piston head dividing said first dual-chamber cylinder into a first said expansion chamber and a first compression chamber; and a second double-sided piston head, operatively connected to said first double-sided piston head, and disposed for reciprocating motion through a piston displacement within a second one of said dual-chamber cylinders, said second double-sided piston head dividing said second dual-chamber cylinder into a second said expansion chamber and a second compression chamber; and wherein each of said expansion chambers comprises an expander variable space between a corresponding said reciprocating piston head and a closed cylinder head of a corresponding one of said cylinders, and each of said compression chambers comprises a compressor variable space between a corresponding said reciprocating piston head and a closed cylinder base of a corresponding one of said cylinders;

wherein said compressor comprises said piston heads moving through said compression chambers within said dual-chamber cylinders; and further wherein each double-headed double-sided piston working member simultaneously and substantially continuously performs expansion and compression functions for both cylinders of a corresponding one of said at least one pair of coaxially opposed dual-chamber cylinders.

22. An apparatus according to claim 21 wherein:

said motive fluid expands within said expansion chambers thereby to move said double-sided piston heads within corresponding ones of said dual-chamber cylinders; and each said double-headed double-sided piston working member is operatively connected to a corresponding rotatable crankshaft, said crankshaft rotatable to move said working member.

23. A system according to claim 22 further comprising:

a pair of opposed cylinder blocks, each said cylinder block containing at least four said dual-chamber cylinders, and each cylinder in a cylinder block being operatively paired with a corresponding cylinder in the other block, and wherein each said crankshaft is between said cylinder blocks;

a linear throw crank mechanism, associated with each said piston working member, for operatively engaging each working member with its corresponding crankshaft;

wherein a net force generated by each said piston working member is transmitted to its corresponding crankshaft via said linear throw crank mechanism, thereby rotating said crankshaft; and wherein intake, compression, expansion, and exhaust functions are substantially continuously and simultaneously performed within each operative pair of dual-chamber cylinders.

24. A parallel cycle internal combustion engine comprising:

a pair of opposed cylinder blocks, each said cylinder block containing at least four dual-chamber cylinders, and each cylinder in a cylinder block being operatively paired with a corresponding cylinder in the other block, wherein each said dual-chamber cylinder defines:

a compression chamber for compressing air; and an expansion chamber in which a motive fluid expands as a result of combustion, wherein only expansion or exhaust of motive fluid occurs in said expansion chamber, and only intake or compression of air occurs in said compression chamber;

at least two crankshafts operatively disposed between said cylinder blocks;

a main compressed air channel for conveying compressed air from said compression chambers toward at least one combustion chamber;

a reservoir, in fluid communication with said main compressed air channel between said compression chambers and said combustion chamber, for storing compressed air compressed by said dual-chamber cylinders;

the at least one combustion chamber for combusting air received from said reservoir or from said compression chambers with a fuel to create a motive fluid;

an inlet manifold, in fluid communication with said combustion chamber, through which motive fluid flows from said combustion chamber to said expansion chambers;

a timing valve for regulating intake of motive fluid from said inlet manifold into said expansion chambers; and a compressed air reservoir isolation valve for regulating flow of compressed air from said reservoir to said main compressed air channel;

wherein said reservoir isolation valve when open allows flow of stored compressed air from said reservoir to said combustion chamber via said main compressed air channel, thereby permitting the thermodynamic function of combustion to be performed wholly independently from an operation of said compressor, and wherein when said reservoir isolation valve is closed, or when said reservoir isolation valve is open and a pressure in said reservoir is substantially equal to a pressure in said main compressed air channel, thermodynamic functions of intake, compression, combustion, and expansion are performed continuously and independently in distinct parallel zones.

25. An apparatus according to claim 24, further comprising at least four double-headed double-sided piston working members, each said working member operatively connected to one of said crankshafts, each said working member cooperative with an associated pair of dual-chamber cylinders, and each said working member comprising:

a first double-sided piston head disposed for reciprocating motion through a piston displacement within a first one of said dual-chamber cylinders, said double-sided piston head dividing said first dual-chamber cylinder into a first said expansion chamber and a first compression chamber; and a second double-sided piston head, operatively connected to said first double-sided piston head, and disposed for reciprocating motion through a piston displacement within a second one of said dual-chamber cylinders, said second double-sided piston head dividing said second dual-chamber cylinder into a second said expansion chamber and a second compression chamber;

wherein each double-headed, double-sided piston working member simultaneously and substantially continuously performs expansion and compression functions for both cylinders of said associated pair of dual-chamber cylinders.

* * * * *